US008624936B2

(12) United States Patent
Kimura

(10) Patent No.: US 8,624,936 B2
(45) Date of Patent: Jan. 7, 2014

(54) DISPLAY PANEL CONTROL DEVICE, LIQUID CRYSTAL DISPLAY DEVICE, ELECTRONIC APPLIANCE, DISPLAY DEVICE DRIVING METHOD, AND CONTROL PROGRAM

(75) Inventor: Hiroaki Kimura, Kanagawa (JP)

(73) Assignee: NLT Technologies, Ltd., Kanagawa (JP)

( * ) Notice: Subject to any disclaimer, the term of this patent is extended or adjusted under 35 U.S.C. 154(b) by 1135 days.

(21) Appl. No.: 12/256,067

(22) Filed: Oct. 22, 2008

(65) Prior Publication Data

US 2009/0109247 A1 Apr. 30, 2009

(30) Foreign Application Priority Data

Oct. 24, 2007 (JP) ..... 2007-276078

(51) Int. Cl.
*G09G 5/10* (2006.01)

(52) U.S. Cl.
USPC ..... 345/690

(58) Field of Classification Search
USPC ..... 345/690, 98
See application file for complete search history.

(56) References Cited

U.S. PATENT DOCUMENTS

| | | | | |
|---|---|---|---|---|
| 7,262,824 | B2 * | 8/2007 | Sasabayashi et al. | 349/129 |
| 2003/0156092 | A1 * | 8/2003 | Suzuki et al. | 345/98 |
| 2006/0119617 | A1 * | 6/2006 | Toyooka et al. | 345/619 |
| 2006/0227249 | A1 * | 10/2006 | Chen et al. | 348/631 |
| 2009/0040376 | A1 * | 2/2009 | Kobayashi | 348/452 |
| 2009/0322720 | A1 * | 12/2009 | Inoue | 345/208 |
| 2010/0164996 | A1 * | 7/2010 | Tomizawa et al. | 345/690 |
| 2011/0075060 | A1 * | 3/2011 | Sasabayashi et al. | 349/38 |

FOREIGN PATENT DOCUMENTS

| | | | |
|---|---|---|---|
| JP | 2001-125067 | A | 5/2001 |
| JP | 2003-084739 | A | 3/2003 |
| JP | 2004-253827 | A | 9/2004 |
| JP | 2004-287139 | A | 10/2004 |
| JP | 2006-30741 | A | 2/2006 |
| JP | 2006-171749 | A | 6/2006 |
| JP | 2007-093939 | A | 4/2007 |
| JP | 2007-206279 | A | 8/2007 |
| WO | 03/098588 | A1 | 11/2003 |
| WO | 2006/098244 | A1 | 9/2006 |

OTHER PUBLICATIONS

Japanese Office Action for corresponding Japanese Application No. 2007-276078 mailed Jun. 19, 2012.

* cited by examiner

*Primary Examiner* — Quan-Zhen Wang
*Assistant Examiner* — Tony Davis
(74) *Attorney, Agent, or Firm* — Sughrue Mion, PLLC

(57) ABSTRACT

To provide a display panel control device capable of preventing generation of step-like tailing and ghost when executing black insertion drive. A first correction device performs first correction on a gradation value of a video signal by considering response delay of the display panel when changing from a second gradation voltage to a first gradation voltage. A second correction device performs second correction on one of or both of the gradation value of the video signal and the gradation voltage of a monochrome image signal by considering accumulative luminance reaching delay of the video part caused due to a difference between each monochrome display luminance of each monochrome image part in different unit frame cycle periods, when the gradation value of the video signal changes from a unit frame cycle period to another unit frame cycle period. A monochrome image insertion drive control device generates the monochrome image inserted video signal including the video part and the monochrome image part to which the first correction or the second correction is performed, and controls the monochrome image insertion drive of the display panel.

23 Claims, 47 Drawing Sheets

FIG. 2

| INPUTTED VIDEO SIGNAL [8 bit] | VIDEO DISPLAY SIGNAL [8 bit] |
|---|---|
| 0 | 0 |
| 1 | 2 |
| 2 | 3 |
| 3 | 4 |
| 4 | 6 |
| 5 | 7 |
| 6 | 8 |
| 7 | 10 |
| :<br>: | :<br>: |
| 249 | 253 |
| 250 | 254 |
| 251 | 255 |
| 252 | 255 |
| 253 | 255 |
| 254 | 255 |
| 255 | 255 |

FIG. 3

| INPUTTED VIDEO SIGNAL [8 bit] | VIDEO DISPLAY SIGNAL [10 bit] |
|---|---|
| 0 | 0 |
| 1 | 3 |
| 2 | 7 |
| 3 | 14 |
| 4 | 18 |
| 5 | 21 |
| 6 | 25 |
| 7 | 28 |
| ⋮ | ⋮ |
| 249 | 997 |
| 250 | 1001 |
| 251 | 1006 |
| 252 | 1010 |
| 253 | 1014 |
| 254 | 1019 |
| 255 | 1020 |

FIG. 4 n-FRAME INPUTTED SIGNAL (n-1)-FRAME INPUTTED SIGNAL

| | 0 | 32 | 64 | 96 | 128 | 160 | 192 | 224 | 255 |
|---|---|---|---|---|---|---|---|---|---|
| 0 | 0 | 36 | 74 | 111 | 145 | 182 | 212 | 239 | 255 |
| 32 | 0 | 32 | 69 | 107 | 143 | 179 | 210 | 238 | 255 |
| 64 | 0 | 27 | 64 | 102 | 140 | 176 | 208 | 237 | 255 |
| 96 | 0 | 22 | 57 | 96 | 134 | 171 | 205 | 235 | 255 |
| 128 | 0 | 15 | 50 | 89 | 128 | 166 | 202 | 234 | 255 |
| 160 | 0 | 10 | 46 | 83 | 121 | 160 | 196 | 231 | 255 |
| 192 | 0 | 3 | 40 | 77 | 115 | 153 | 192 | 228 | 255 |
| 224 | 0 | 0 | 32 | 68 | 106 | 140 | 186 | 224 | 255 |
| 255 | 0 | 0 | 20 | 56 | 92 | 136 | 177 | 218 | 255 |

VIDEO DISPLAY SIGNAL

FIG. 5 n-FRAME INPUTTED SIGNAL (n-1)-FRAME INPUTTED SIGNAL

| | 0 | 128 | 256 | 384 | 512 | 640 | 768 | 896 | 1023 |
|---|---|---|---|---|---|---|---|---|---|
| 0 | 0 | 144 | 296 | 444 | 580 | 728 | 848 | 956 | 1023 |
| 128 | 0 | 128 | 276 | 428 | 572 | 716 | 840 | 952 | 1023 |
| 256 | 0 | 108 | 256 | 408 | 560 | 704 | 832 | 948 | 1023 |
| 384 | 0 | 88 | 228 | 384 | 536 | 684 | 820 | 940 | 1023 |
| 512 | 0 | 60 | 200 | 356 | 512 | 664 | 808 | 936 | 1023 |
| 640 | 0 | 40 | 184 | 332 | 484 | 640 | 784 | 924 | 1023 |
| 768 | 0 | 12 | 160 | 308 | 460 | 612 | 768 | 912 | 1023 |
| 896 | 0 | 0 | 28 | 272 | 424 | 560 | 744 | 896 | 1023 |
| 1023 | 0 | 0 | 80 | 224 | 368 | 544 | 708 | 872 | 1023 |

VIDEO DISPLAY SIGNAL

NORMAL DRIVE

BLACK INSERTION DRIVE

BLACK INSERTION DRIVE
(FIRST OVERSHOOT DRIVE)

CORRECTION AMOUNT OF SECOND OVERSHOOT DRIVE

TAILING CAUSED BY BLACKENING

FIG. 26

| INPUTTED VIDEO SIGNAL [8 bit] | HALFTONE DISPLAY SIGNAL [8 bit] |
|---|---|
| 0 | 16 |
| 1 | 16 |
| 2 | 16 |
| 3 | 16 |
| 4 | 15 |
| 5 | 15 |
| 6 | 15 |
| 7 | 15 |
| ⋮ | ⋮ |
| 249 | 1 |
| 250 | 1 |
| 251 | 1 |
| 252 | 1 |
| 253 | 0 |
| 254 | 0 |
| 255 | 0 |

FIG. 27

| INPUTTED VIDEO SIGNAL [10 bit] | HALFTONE DISPLAY SIGNAL [10 bit] |
|---|---|
| 0 | 64 |
| 1 | 64 |
| 2 | 63 |
| 3 | 63 |
| 4 | 62 |
| 5 | 62 |
| 6 | 61 |
| 7 | 60 |
| ⋮ | ⋮ |
| 1017 | 3 |
| 1018 | 3 |
| 1019 | 2 |
| 1020 | 2 |
| 1021 | 1 |
| 1022 | 1 |
| 1023 | 0 |

BLACK INSERTION DRIVE
(FIRST OVERSHOOT DRIVE)

SHIFT DISTANCE CALCULATING BLOCK

DISPLAY PANEL CONTROL DEVICE, LIQUID CRYSTAL DISPLAY DEVICE, ELECTRONIC APPLIANCE, DISPLAY DEVICE DRIVING METHOD, AND CONTROL PROGRAM

CROSS-REFERENCE TO RELATED APPLICATION

This application is based upon and claims the benefit of priority from Japanese patent application No. 2007-276078, filed on Oct. 24, 2007, the disclosure of which is incorporated herein in its entirety by reference.

BACKGROUND OF THE INVENTION

1. Field of the Invention

The present invention relates to a display panel control device, a liquid crystal display device, an electric appliance, a display device driving method, and a control program.

2. Description of the Related Art

A hold-type display device holds an image as a still image within a frame period, and displays a dynamic image by switching a screen for every frame. With dynamic image displays provided on the hold-type display device, still images are switched and displayed continuously without a break from frame to frame. Thus, human beings whose eyesight moves by following the dynamic image display perceive still images held still as images that are superimposed on one another in a shifted manner, and recognize that state as dynamic image blur.

In a liquid crystal display device as an example of such hold-type display device, there has been proposed black insertion drive which drives the device by inserting black display to video display of a frame period, in order to improve the dynamic image blur.

With the black insertion drive for the liquid crystal display device, a black display signal is written to pixels of a liquid crystal display panel after a video signal is written thereto, by providing a video display period and a black display period within one frame. Therefore, it is necessary to increase a panel writing frequency, so that the hold time of the liquid crystal is shortened.

Therefore, as depicted in Japanese Unexamined Patent Publication 2004-253827 (Patent Document 1), for example, there has been proposed a technique to increase the response speed by performing overshoot drive in the black insertion drive with which black display and video display are repeated alternately by each sub-frame.

In the liquid crystal display device of Patent Document 1, a black display signal is inserted by a black inserting device after converting a video signal to "N×"-speed by a frame frequency converting device. Thereafter, information necessary for emphasis conversion (overshoot) is obtained by an emphasis converting device from an OS (overshoot) table memory so as to perform emphasis conversion processing on the video signal.

With this emphasis conversion processing, when writing a black display signal after writing of a video signal, the emphasis conversion processing (overshoot drive) is applied on the video signal by using an emphasis conversion parameter that is set by considering gradation luminance (of the black display) to which the liquid crystal can actually reach within a black display period (paragraph number 0074). Even if the liquid crystal does not completely respond and reach a black gradation (0-gradation) within the black display period, it is possible to perform the emphasis conversion processing to display image data in a following video display period based on the actual finally-reached gradation (0-gradation).

That is, with the technique depicted in Patent Document 1, the emphasis conversion processing (overshoot) is performed based on a single OS table memory and, even if the gradation value of the black signal is unreached during one frame period, the amount of overshoot applied to the video signal is downwardly-adjusted from 118-gradation (that is original amount to be applied) to 70-gradation (FIG. 14 and FIG. 18 of Patent Document 1) so as to prevent whitening of the pixels.

However, even when normal overshoot (emphasis adjustment) is applied on the video signal in the black insertion drive with the liquid crystal display device of Patent Document 1, there is delay caused in response of the liquid crystal if there is a difference generated in the gradation voltage values (gradation voltages) of the video signals between a given frame and another frame. Because of this, it is not possible to reach a prescribed luminance within a video display period of another frame. As a result, as shown in FIG. 47, there are points that need to be improved in the video display, such as generation of step-like tailing, etc., and ghost generated in scroll-display of letters, which causes bad influences on the image quality.

Particularly, the technique of Patent Document 1 takes no consideration over the unreached response of the gradation value of the video signal, other than applying the conversion adjustment by normal overshoot. Thus, when the gradation value of the video signal is increased in a next frame, it is not possible to reach the prescribed luminance (transmittance), thereby generating the tailing and ghost.

Further, with the technique of Patent Document 1, the overshoot amount of a prescribed gradation is reduced to equalize each gradation voltage for each frame. However, unreached response to be in the black display (insufficient blackening of black display) is not improved, and the luminance (transmittance) does not completely respond to reach the black gradation (0-gradation) within the black display period (sub-frame period) (FIG. 14, FIG. 18, etc., of Patent Document 1). Therefore, the step-like tailing is also generated in the video display with this technique.

Particularly, when there is a difference generated in the gradation values (gradation voltages) in the video display of each frame, not only unreached response of the black display but also there is a difference generated in the luminance (blackening of the black display) of the black display in each frame, as shown in FIG. 47. This results in having ghost at the time of video display, which is a point that needs to be improved. In addition, the difference in the blackening states of the black displays gives influences accumulatively in the following frames, and the luminance of the video display changes accumulatively in accordance with the influences. This is a cause for generating the tailing, and the ghost in the scroll display of letters.

Further, even if the luminance of each video display in each frame is made almost uniform, the ghost-like tailing cannot be improved.

SUMMARY OF THE INVENTION

The present invention has been designed to overcome the points of the above-described technique which need to be improved. An exemplary object of the invention is to provide a display panel control device, a liquid crystal display device, an electronic appliance, a display device driving method, and a control program, which are capable of preventing generation of step-like tailing in video display and generation of ghost in scroll display of letters when executing the black insertion drive.

A display panel control device according to an exemplary aspect of the invention is a display panel control device which supplies, to a display panel, a monochrome image inserted video signal in which a unit cycle period including a first gradation voltage video part for providing video display according to a gradation value of a video signal and a second gradation voltage monochrome image part for providing monochrome display according to a gradation value of a monochrome image signal are repeated, and performs a display drive control for the display panel by monochrome image insertion drive which starts insertion of monochrome image display scanning at an arbitrary timing of video display scanning. The display panel control device includes: a first correction device which performs a first correction on a gradation value of the video signal so as to increase a change amount between the first gradation voltage and the second gradation voltage; a second correction device which performs a second correction on one of or both of the gradation value of the monochrome image signal and the gradation value of the video signal that is corrected by the first correction so as to increase the change amount between the first gradation voltage and the second gradation voltage when the gradation value of the video signal changes from a given unit frame cycle period to another unit frame cycle period; and a monochrome image insertion drive control device which generates the monochrome image inserted video signal including the video part and the monochrome image part to which the first correction or the second correction is performed, or generates the monochrome image inserted video signal including the video part to which the first correction is performed and the monochrome image part to which the second correction is performed, and performs the display drive control on the display panel by the monochrome image insertion drive performed.

A display device driving method according to another exemplary aspect of the invention is a display device driving method for driving a display device which supplies, to a display panel, a monochrome image inserted video signal in which a unit cycle period including a first gradation voltage video part for providing video display according to a gradation value of a video signal and a second gradation voltage monochrome image part for providing monochrome display according to a gradation value of a monochrome image signal are repeated, and performs a display drive control for the display panel by monochrome image insertion drive which starts insertion of monochrome image display scanning at an arbitrary timing of video display scanning. The method includes: a first correcting step which performs a first correction on a gradation value of the video signal so as to increase a change amount between the first gradation voltage and the second gradation voltage; a second correcting step which performs a second correction on one of or both of the gradation value of the monochrome image signal and the gradation value of the video signal that is corrected by the first correction so as to increase the change amount between the first gradation voltage and the second gradation voltage when the gradation value of the video signal changes from a given unit frame cycle period to another unit frame cycle period; and a monochrome image insertion drive control step which generates the monochrome image inserted video signal including the video part and the monochrome image part to which the first correction or the second correction is performed, or generates the monochrome image inserted video signal including the video part to which the first correction is performed and the monochrome image part to which the second correction is performed, and performs the display drive control on the display panel by the monochrome image insertion drive.

A control program according to still another exemplary aspect of the invention is a control program for enabling a computer, which is provided to a display panel control device that supplies, to a display panel, a monochrome image inserted video signals in which a unit cycle period including a first gradation voltage video part for providing video display according to a gradation value of a video signal and a second gradation voltage monochrome image part for providing monochrome display according to a gradation value of a monochrome image signal are repeated, and performs a display drive control by monochrome image insertion drive which starts insertion of monochrome image display scanning at an arbitrary timing of video display scanning for the display panel, to execute functions including: a first correcting function which performs a first correction on a gradation value of the video signal so as to increase a change amount between the first gradation voltage and the second gradation voltage; a second correcting function which performs a second correction on one of or both of the gradation value of the monochrome image signal and the gradation value of the video signal that is corrected by the first correction so as to increase the change amount between the first gradation voltage and the second gradation voltage when the gradation value of the video signal changes from a given unit frame cycle period to another unit frame cycle period; and a monochrome image insertion drive control function which generates the monochrome image inserted video signal including the video part and the monochrome image part to which the first correction or the second correction is performed, or generates the monochrome image inserted video signal including the video part to which the first correction is performed and the monochrome image part to which the second correction is performed, and performs the display drive on the display panel control by the monochrome image insertion drive.

Operations and other benefits of the present invention will be made obvious in "DETAILED DESCRIPTION OF THE EXEMPLARY EMBODIMENTS" described below.

BRIEF DESCRIPTION OF THE DRAWINGS

FIG. 2 is an explanatory diagram showing an example of a data structure of a first LUT (lookup table) of a timing controller of the liquid crystal display device of FIG. 1;

FIG. 3 is an explanatory diagram showing an example of the data structure of the first LUT (lookup table) of the timing controller of the liquid crystal display device of FIG. 1, showing a case where the resolution is increased to 10 bits;

FIG. 4 is an explanatory diagram showing an example of a data structure of a second LUT (lookup table) of the timing controller of the liquid crystal display device of FIG. 1;

FIG. 5 is an explanatory diagram showing an example of the data structure of the second LUT (lookup table) of the timing controller of the liquid crystal display device of FIG. 1, showing a case where the resolution is increased to 10 bits;

FIG. 23 is an illustration for describing an example of a screen display when performing the black insertion drive in the liquid crystal display device according to the first exemplary embodiment of the invention, in which

FIG. 26 is an explanatory diagram showing an example of a data structure of a third LUT (lookup table) of a timing controller of the liquid crystal display device of FIG. 25;

FIG. 27 is an explanatory diagram showing an example of the data structure of the third LUT (lookup table) of the timing controller of the liquid crystal display device of FIG. 25, showing a case where the resolution is increased to 10 bits;

DETAILED DESCRIPTION OF THE EXEMPLARY EMBODIMENTS

Figure 1:
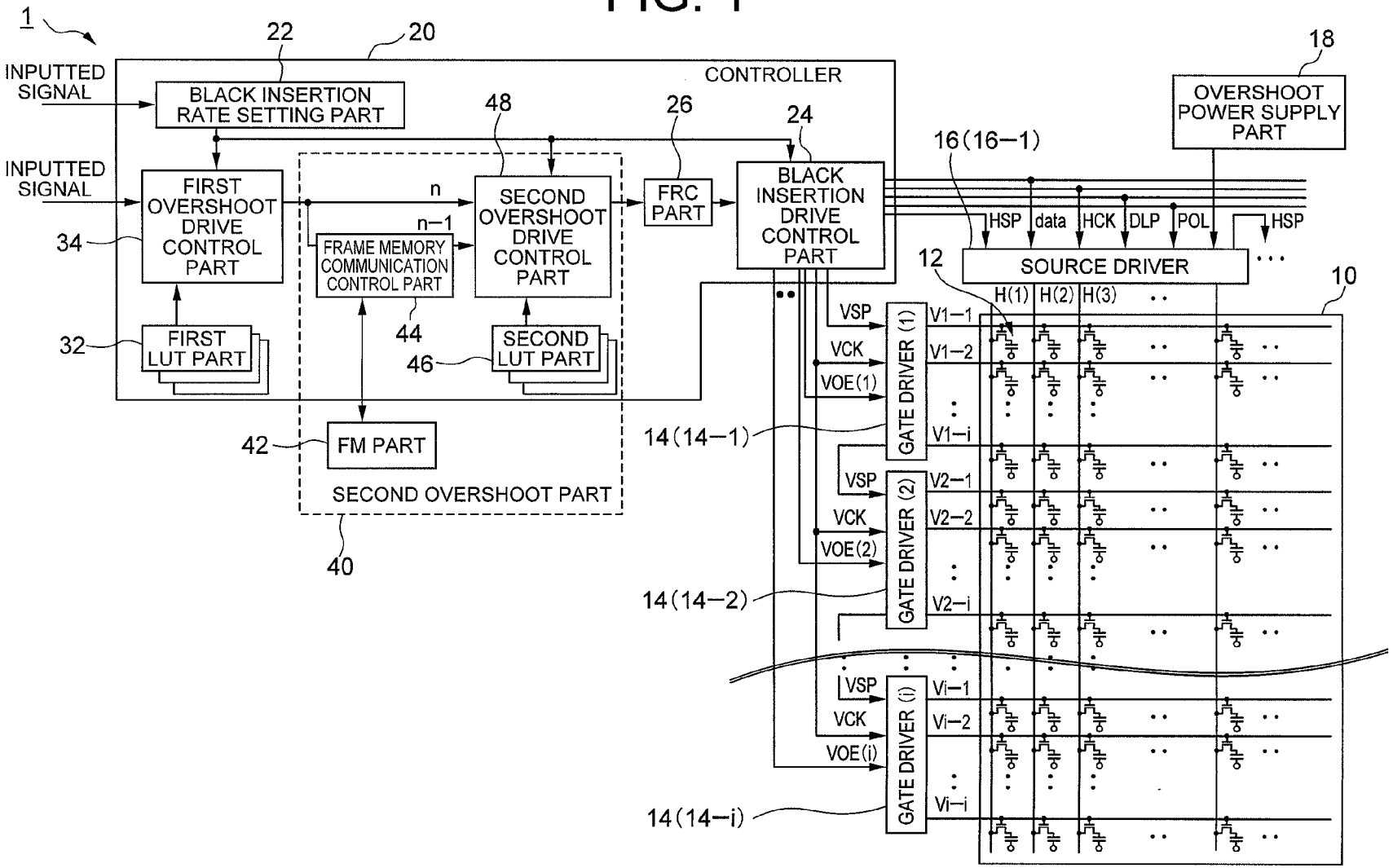
FIG. 1 is a block diagram showing an example of a schematic structure of a liquid crystal display device according to a first exemplary embodiment of the invention.

It is to be understood that contents of explanations provided hereinafter are not to unjustifiably limit the contents of the present invention depicted in the scope of the appended claims. Further, note that not all the structures explained herein may necessarily be the essential feature elements of the present invention.

Basic Structure of Display Panel Control Device

First, the basic structure of the display panel control device will be described. The display panel control device (for example, reference numeral 20 shown in FIG. 1) according to the present invention is designed as a control device which supplies, to a display panel, a monochrome image inserted video signal in which a unit cycle period (for example, a frame cycle) including a first gradation voltage video part for providing video display according to a gradation value of a video signal and a second gradation voltage monochrome image part for providing monochrome display according to a gradation value of a monochrome image signal are repeated, and performs a display drive control by monochrome image insertion drive which starts insertion of monochrome image display scanning at an arbitrary timing of the video display scanning for the display panel.

As the basic structure, the display panel driving device is structured to include a first correction device (for example, a structure configured with reference numerals 32, 34 shown in FIG. 1), a second correction device (for example, a structure configured with reference numeral 40 shown in FIG. 25, reference numeral 60 shown in FIG. 25, etc.), and a monochrome image insertion drive control device (for example, reference numeral 24, and the like shown in FIG. 1)

This first correction device performs first correction (first overshoot drive) on the gradation value of the video signal so as to increase a change amount between a first gradation voltage and a second gradation voltage, by considering response delay of the display panel when changing from the second gradation voltage to the first gradation voltage.

The second correction device described above performs second correction (second overshoot drive or third overshoot drive) on one of or both of the gradation value of the video signal that is corrected by the first correction and the gradation value of the monochrome image signal so as to increase the change amount between the first gradation voltage and the second gradation voltage, by considering accumulative luminance reaching delay of the video part caused due to a difference between each monochrome display luminance of each monochrome image part in different unit frame cycle periods, when the gradation value of the video signal changes from a unit frame cycle period to another unit frame cycle period.

The monochrome image insertion drive control device generates the monochrome image inserted video signal including the video part and the monochrome image part to which the first correction or the second correction is performed, or generates the monochrome image inserted video signal including the video part to which the first correction is performed and the monochrome image part to which the second correction is performed, and controls the display drive of the display panel by the monochrome image insertion drive.

With such display panel control device, it is possible with the first correction device to correct response delay from the monochrome display to the video display based on current frame video information, and to suppress deterioration of the luminance when inserting the monochrome image to the display panel whose response speed is relatively slow. Further, it is possible with the second correction device to correct accumulative luminance reaching delay caused due to a difference between blackening of the monochrome display after the video display of a previous frame and blackening of the monochrome display after the video display of a current frame so as to improve the step-like tailing and the ghost in letter scroll caused due to insufficient blackening of the monochrome image display.

Note here that "unit cycle period" may be a frame cycle or other kinds of unit cycle, such as a plural-frame cycle, a sub-frame, a field, a sub-field, or a horizontal scanning period. Further, "unit frame cycle period" may be a frame cycle or other kinds of unit cycle, such as a sub-frame. Furthermore, "unit frame cycle period" may be a frame period that is the same as the "unit cycle period" or may simply be a unit.

Further, the second correction device corrects the gradation value of the video signal of another unit frame cycle period (for example, the current frame) based on the gradation value of a given unit frame cycle period (for example, the frame one before), and makes it possible to perform display drive of the video part with a fourth gradation voltage that is different from a third gradation voltage which corresponds to the gradation value corrected by the first correction. The second correction device can correct the gradation value in such a manner that time integrated value of the luminance in the aforementioned another unit frame cycle period (for example, current frame) where display is being changed becomes larger than the time integrated value of the luminance in still another unit frame cycle period (for example, next frame) after display is being changed (for example, FIG. 17, etc.) (second overshoot drive).

At this time, the monochrome image insertion drive control device can control the monochrome image insertion drive based on the monochrome image inserted video signal that contains the video part of the third gradation voltage or the fourth gradation voltage and the monochrome image part of the second gradation voltage.

In this manner, the second correction device corrects the video signal of the current frame based on the video signal of the previous frame so as to prevent the accumulative luminance reaching delay through correcting the response speed of the video display. This makes it possible to improve the step-like tailing and the ghost generated in scroll of letters.

Further, the second correction device corrects the gradation value of the monochrome image signal after the video signal of the given unit frame cycle period based on the gradation value of the video signal of the given unit frame cycle period so as to perform the display drive of the monochrome image part with a fifth gradation voltage that is different from the second gradation voltage (third overshoot drive).

At this time, the monochrome image insertion drive control device can control the monochrome image insertion drive based on the monochrome image inserted video signal that contains the video part of the third gradation voltage and the monochrome image part of the fifth gradation voltage.

In this manner, the second correction device corrects the response speed of the video display by correcting the gradation value of the monochrome display after the video display of the previous frame based on the gradation value of the video display of the previous frame so as to prevent the accumulative luminance reaching delay. This makes it possible to improve the step-like tailing and the ghost generated in scroll of letters.

Such operations and other benefits will be made obvious further from each of exemplary embodiments described below.

Hereinafter, an example of more detailed exemplary embodiment in which the "display panel control device" of the present invention is applied to "liquid crystal display device" will be described in a concrete manner by referring to the accompanying drawings.

First Exemplary Embodiment

First, specific structures of the liquid crystal display device according to this exemplary embodiment will be described starting from the overall structure. Then, detailed structure of a controller, functions of a black insertion drive control part, and entire schematic operations as will be described.

(Overall Structure of Liquid Crystal Display Device)

The overall structure of the liquid crystal display device according to this exemplary embodiment of the invention will be described by referring to FIG. 1. FIG. 1 is a block diagram showing an example of the overall structure of the liquid crystal display device according to the first exemplary embodiment of the invention.

The liquid crystal display device 1 of the exemplary embodiment is capable of performing the first and second overshoot drives in the black insertion drive. As shown in FIG. 1, the liquid crystal display device 1 is structured to include a liquid crystal display panel 10, gate drivers 14 (14-1 to **14-*i*) for driving pixels 12 of the liquid crystal display panel 10, source drivers 16 (16-1, - - - ), an overshoot power supply part 18 used for overshoot drive, a controller 20 for controlling the gate drivers 14 and the source drivers 16, and an FM (frame memory) part 42** for temporarily storing video information of video signals.

In this exemplary embodiment, it is preferable for the liquid crystal display panel 10 to be a panel with which overshoot drive from black display to white display can be performed easily, e.g., a normally-black panel such as ISP.

Here, the specific structure of the liquid crystal display panel 10 will be described.

As shown in FIG. 1, the liquid crystal display device 1 according to the first exemplary embodiment is structured to include: the display panel 10 in which i-number (i is a natural number) of gate line groups, each group being a block of j-number (j is a natural number) of gate lines, i.e., gate lines V(1-1) to V(**1-*j*), V(2-1) to V(2-*j*), - - - , V(i-1) to V(i-j) (these may be expressed as "i×j"-number (m is a natural number) of gate lines V1-Vm), and n-number (n is a natural number) of source lines H1-Hn are arranged to cross with each other in a grid-like form, and the pixel 12 is formed at each intersection point between the gate lines V(1-1) to V(1-*j*), V(2-1) to V(2-*j*), - - - , V(i-1) to V(i-j) and the source lines H1-Hn; the source drivers 16 (16-1 to 16-*k*) which are connected to the respective source lines H1-Hn to supply video signals; a plurality of gate drivers 14 (14-1 to 14-*i*) which are respectively provided to each of the gate line groups (a plurality of gate lines V(1-1) to V(1-*j*), V(2-1) to V(2-*j*), - - - , V(i-1) to V(i-j), which are separated into i-number of groups), and successively supply gate-on signals (Vg) to the corresponding gate lines V(1-1) to V(1-*j*), V(2-1) to V(2-*j*), - - - , V(i-1) to V(i-j); and the overshoot power supply part 18 for supplying the power for the overshoot drive to the source drivers 16**.

As shown in FIG. 1, the j-number of gate lines from the top of the first group, i.e., the gate lines V(1-1) to V(**1-*j*), are connected to the gate driver 14-1 (gate driver 1), and the (j+1)-th to the (j+j)-th gate lines of the second group, i.e., the gate lines V(2-1) to V(2-*j*) are connected to the gate driver 14-2, and the {(i−1)j+1}-th to (i×j)-th gate lines of the last i-th group, i.e., the gate lines V(i-i) to V(i-j), are connected to the gate driver 14-*i*** ((2j+1)-th to (i-j)-th gate lines are not illustrated in the drawing).

Regarding the pixels forming the liquid crystal display panel 10 according to this exemplary embodiment, source electrodes of thin film transistors (TFTs) are connected to the source lines H1-Hn, gate electrodes of the TFTs are connected to the gate lines V(i-1) to V(i-j), and the drain electrodes of the TFTs are connected to a pixel electrode that is formed on one of array substrates. A liquid crystal layer is sealed between the pixel electrode formed on one of the array substrates and a common electrode formed in a counter substrate (the other substrate).

On the display panel 10, videos are displayed through controlling the light transmittance of a liquid crystal layer by a potential difference between the pixel electrode and the common electrode. When the video signals are written to the pixels, the gate-on signals (Vgl to Vgm) transmitted via the gate lines V(i-1) to V(i-j) turn on the TFTs. With this, gradation voltages according to the video signals from the source lines H1-Hn are applied to the pixel electrode, and the light transmittance of the liquid crystal layer is controlled by the potential difference between the common electrode that is set to a constant voltage and the pixel electrode to which the gradation voltages are applied so as to achieve video display according to the video signals.

(Detailed Structure of Controller)

Next, the detailed structure of the controller will be described.

The controller 20 has a function as a timing controller. As shown in FIG. 1, it is structured to include: a black insertion rate setting part 22; a first overshoot drive control part 34; a first LUT (lookup table) part 32 utilized for controlling a first overshoot drive; a frame memory communication control part 44; a second LUT (lookup table) part 46 utilized for controlling a second overshoot drive; a second overshoot drive control part 48; an FRC (frame rate control) part 26 for performing frame modulation control; and a black insertion drive control part 24 for performing black insertion drive control by inserting a black signal to the video signal.

An FM (frame memory) part 42, the frame memory communication control part 44, the second LUT part 46, and the second overshoot drive control part 48 together may also be referred to as a second overshoot part 40.

The black insertion rate setting part 22 has functions of: storing information for one frame of the video signal inputted successively for each frame; comparing the video signal of one frame out of the video signals with the video signal of the frame one before that is stored temporarily; and setting the black image insertion rate based on the changed data number. Based on the setting set by the black insertion rate setting part 22, the black insertion drive control part 24 generates various signals.

More specifically, the black insertion rate setting part 22 compares current frame data "data (n)" with the previous frame data "data (n−1)", and counts the changed data for one frame. It is also possible to have a function of judging whether it is a static image or a dynamic image through leveling the counted information by obtaining running average of several frames, for example, and judging the threshold value.

The video signals are inputted to the first overshoot drive control part 34. The first overshoot drive control part 34 corrects the gradation value of the inputted video signal to the gradation value for the first overshoot drive based on the set value of the first LUT part 32 set in advance according to the black insertion rate that is determined by the black insertion rate setting part 22, and supplies the video signal (first corrected video signal) to the second overshoot drive part 48.

The first overshoot drive control part 34 corrects the response delay from the black display (or prescribed gradation display) to the video display based on the current frame video information. The first overshoot drive control part 34 makes it possible to input, to the liquid crystal display panel 10, the voltage value of the video signal that is corrected to be more deviated from the voltage of the black display, compared to the case where the black insertion display is not performed.

The first LUT part 32 determines the correction value of the gradation value to be corrected by the first overshoot drive control part 34, and it includes a plurality of LUTs. In the LUT of the first LUT part 32, the overshoot correction values corresponding to inputted video signals are determined by measurements conducted in advance. FIG. 2 and FIG. 3 show examples of the LUT of the first LUT part 32. Referring to the LUT shown in FIG. 2, when the inputted video signal is of 249-gradation, the video signal when inserting black is converted to the signal of 253-gradation (first correction).

Further, the first LUT part 32 is structured to include a plurality of kinds of LUTs for corresponding to the black insertion rates. The first LUT part 32 may be structured to be capable of switching as necessary to the LUT that corresponds to the changed black insertion rate, when the black insertion rate is changed by the black insertion rate setting part 22. With this, when the black insertion rate is changed by the black insertion rate setting part 22, the first overshoot drive control part 34 can appropriately select the LUT that corresponds to the black insertion rate.

Further, when the resolution of the gradation becomes insufficient because of the overshoot, it is preferable to perform multi-gradation processing by a multi-gradation display method executed by the FRC part 26 or the like. The LUT of FIG. 3 as an example of the LUT of the first LUT part 32 is an example of the LUT that is utilized when the resolution is increased to 10 bits by the FRC part 26.

Figure 9:
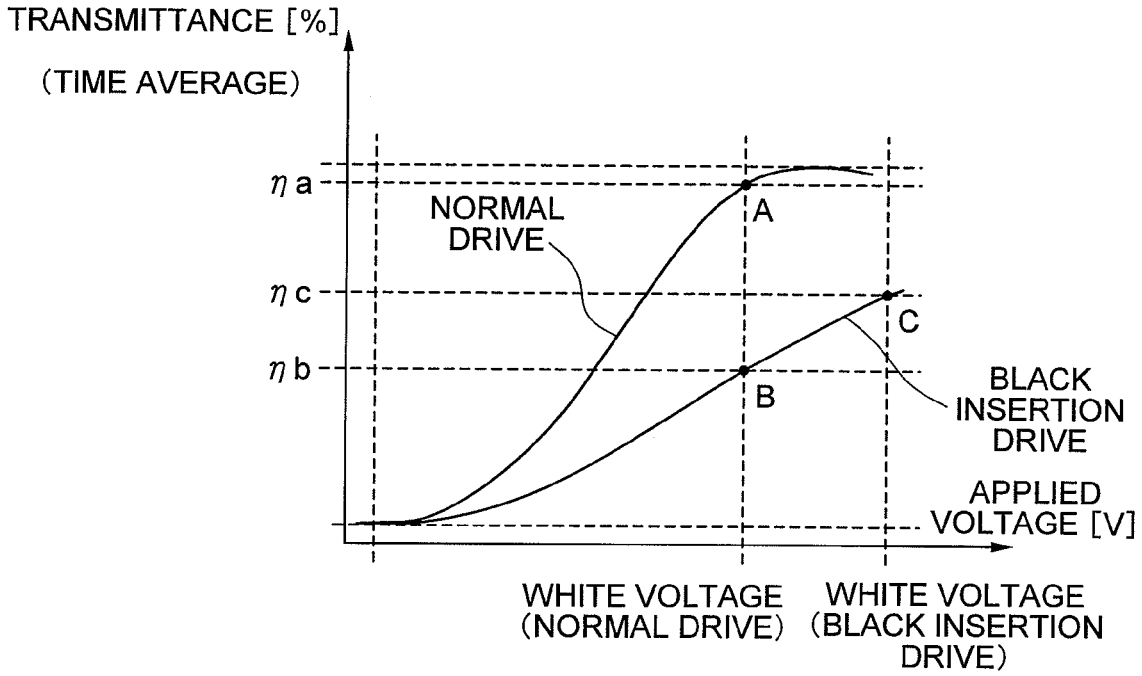
FIG. 9 is an explanatory diagram showing a correlation between the applied voltage and transmittance of the liquid crystal display device.
Figure 10:
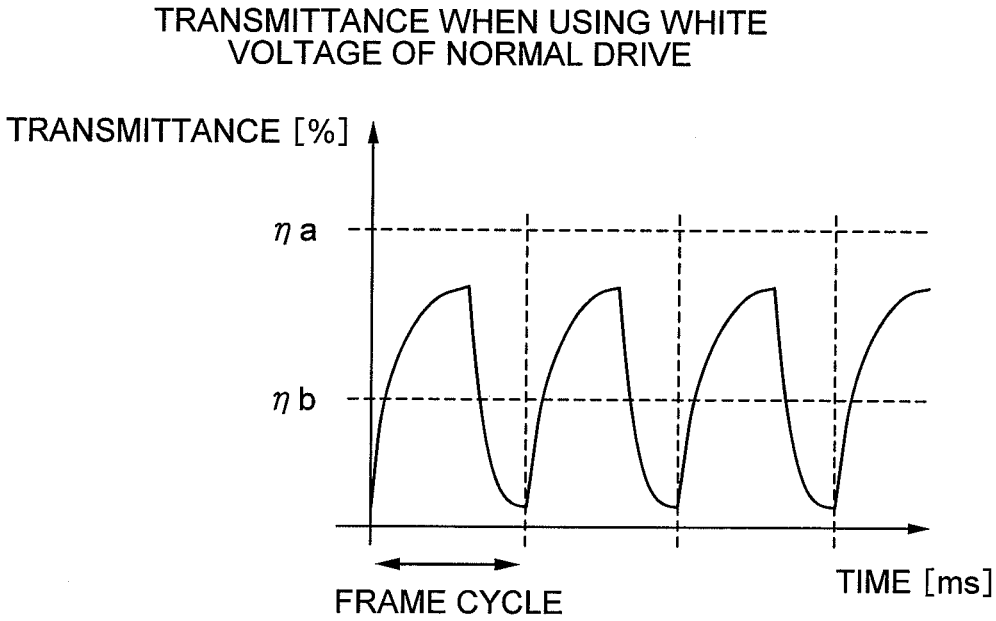
FIG. 10 is an explanatory diagram showing changes in the transmittance in accordance with time (frame cycle) in a case where white voltage of normal drive is used in the liquid crystal display device.
Figure 11:
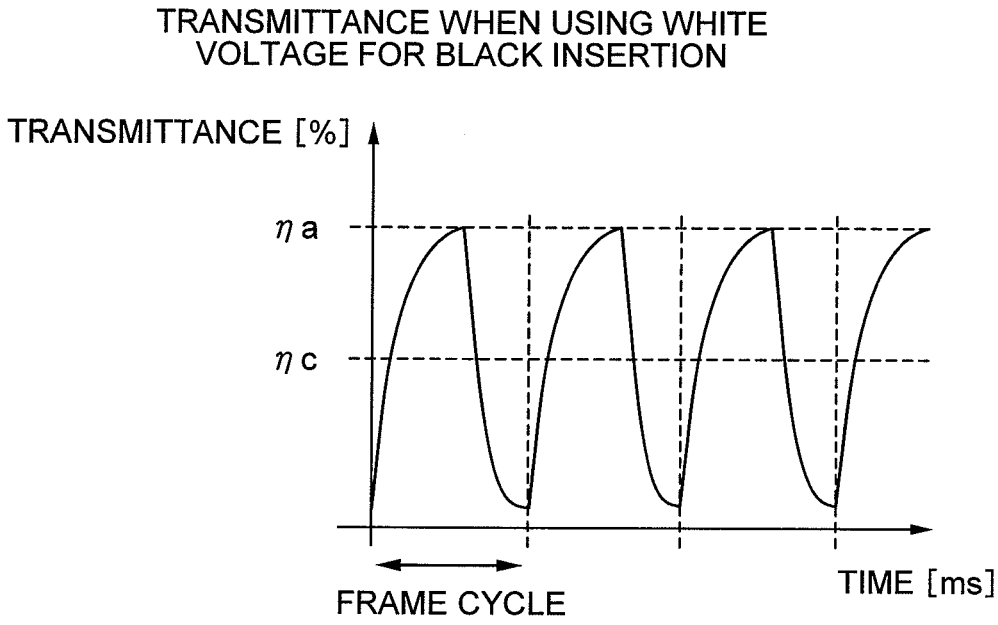
FIG. 11 is an explanatory diagram showing changes in the transmittance in accordance with time (frame cycle) in a case where the white voltage of the black insertion drive of the liquid crystal display device is increased.

Furthermore, as shown in FIG. 9-FIG. 11, when a larger panel applied voltage is required than the voltage of the liquid crystal display panel used in normal drive, it is necessary to prepare in advance for the gradation voltages by investigating the voltages necessary for the overshoot drive.

In the second overshoot part 40, the first corrected video signal is stored temporarily in the FM (frame memory) part 42 via the frame memory communication control part 44, and the video signal (first corrected video signal) of the previous frame (n−1) stored temporarily to the FM part 42 and the video signal (first corrected video signal) of the current frame (n) from the first overshoot drive control part 34 are supplied to the second overshoot drive control part 48.

The second overshoot drive control part 48 compares the video information (gradation value) of the video signal (first corrected video signal) of the previous frame (n-1) with the video information (gradation value) of the video signal (first corrected video signal) of the current frame (n), corrects the gradation value to the value for the second overshoot drive based on the set value of the second LUT 46 that corresponds to the black insertion rate set by the black insertion rate setting part 22, and supplies it to the FRC part 26 as a second corrected video signal.

The second overshoot drive control part 48 corrects, based on the video signal of the previous frame to the video signal of the current frame, the accumulative luminance reaching delay caused due to a difference between blackening of a prescribed gradation display after the video display of the previous frame and blackening of a prescribed gradation display after the video display of the current frame in the video display of the current frame. Further, the second overshoot drive control part 48 performs correction on the video display by the amount exceeding the target luminance.

When there is a change in the video signal of the previous frame and the video signal of the current frame, the second overshoot drive control part 48 can input, to the liquid crystal display panel 10, the voltage value that is corrected from the video signal of the current frame based on the change amount. With those overshot drives, the time for reaching the gradation can be shortened by applying the voltage that exceeds the voltage level of a reaching target.

In this manner, each of the first and the second overshoot drive control parts 34 and 48 determines the correction amount at the time of the black insertion drive based on the inputted video signal.

The second LUT part 46 determines the correction value of the gradation value that is corrected by the second overshoot drive control part 48, and it includes a plurality of LUTs. In the LUT of the second LUT part 46, the overshoot correction values corresponding to inputted video signal of the previous frame and the video information of the current frame are determined by measurements conducted in advance. FIG. 4 and FIG. 5 show examples of the LUT of the second LUT part 46. Referring to the LUT shown in FIG. 4, when the inputted video signal of the previous frame is 32-gradation and the video signal of the current frame is 192-gradation, the current video signal when inserting black is converted to the signal of 210-gradation (second correction).

Further, the second LUT part 46 is structured to include a plurality of kinds of LUTs for corresponding to the black insertion rates. The second LUT part 46 may be structured to be capable of switching as necessary to the LUT that corresponds to the changed black insertion rate, when the black insertion rate is changed by the black insertion rate setting part 22. With this, when the black insertion rate is changed by the black insertion rate setting part 22, the second overshoot drive control part 48 can appropriately select the LUT that corresponds to the black insertion rate.

Further, when the resolution of the gradation becomes insufficient because of the overshoot, it is preferable to perform multi-gradation processing by a multi-gradation display method executed by the FRC part 26 or the like. The LUT of FIG. 5 as an example of the LUT of the second LUT part 46 is an example of the LUT that is utilized when the resolution is increased to 10 bits by the FRC part 26.

The FRC part 26 is a multi-gradation device which generates a specific gradation (intermediate gradation) in a pseudo manner by time average through providing displays of different gradations for each frame by performing frame modulation control.

Note here that it is possible to employ a structure having no FRC part 26, even though the exemplary embodiment has the FRC part 26. In that case, the second corrected video signal from the second overshoot drive control part 48 is directly inputted to the black insertion drive control part 24.

The black insertion drive control part 24 inserts the black signal between lines of the video signal (second corrected video signal), and inputs the black inserted video signal to each source driver.

Further, the black insertion drive control part 24 generates the control signals of the drivers and inputs those to each of the gate drivers 14 and each of the source drivers 16 along with the video signals to which the black signals are inserted at a timing according to the black insertion rate set by the black insertion rate setting part 22. Each of the gate drivers 14 and each of the source drivers 16 write the voltages set by the gradation power supply 18 to the liquid crystal display panel 10 according to the inputted control signals.

The black insertion drive control part 24 performs high-speed drive by inserting a specific gradation display (for example, black) to the video signal (second corrected video signal) from the second overshoot drive control part 48 in a specific proportion.

Further, it is possible with the liquid crystal display device 1 of this exemplary embodiment to reduce the gradation change that cannot be overshoot-driven, by using the overshoot power supply part 18 that can apply more voltage than the voltage normally applied to the pixels 12 of the liquid crystal display panel 10. The overshoot power supply part 18 is capable of applying a voltage that exceeds the voltage to reach a transmission peak, as the voltage to be applied to the display panel in each gradation of the video display.

Here, corresponding relations between the feature elements of this exemplary embodiment and the feature elements of the present invention will be described. The first overshoot drive control part 34 and the first LUT part 32 according to this exemplary embodiment configure the "first correction device" of the present invention. Further, the second overshoot part 40 can configure the "second correction device". The black insertion drive control part 24 configures the "monochrome image insertion drive control device". Furthermore, the black insertion rate setting part 22 configures "the monochrome image insertion rate setting device" Further, the FRC part 26 can configure the "multi-gradation device". Furthermore, the source drivers 16 can configure the "source line driving device", and the gate drivers 14 can configure the "gate line driving device".

The "first correction device" performs the first correction on the gradation value of the video signal so as to increase the change amount between the first gradation voltage and the second gradation voltage, by considering the response delay of the display panel when changing from the second gradation voltage to the first gradation voltage. The "second correction device" performs the second correction on one of or both of the gradation value of the monochrome image signal and the gradation value of the video signal that is corrected by the first correction so as to increase the change amount between the first gradation voltage and the second gradation voltage, by considering the accumulative luminance reaching delay of the video part caused due to a difference between each monochrome display luminance of each monochrome image part in different unit frame cycle periods, when the gradation value of the video signal changes from a unit frame cycle period to another unit frame cycle period. The "monochrome image insertion drive control device" generates the monochrome image inserted video signal including the video part and the monochrome image part to which the first correction or the second correction is performed, or generates the monochrome image inserted video signal including the video part to which the first correction is performed and the monochrome image part to which the second correction is performed, and controls the display drive by executing monochrome image insertion drive on the display panel.

Further, when the "second correction device" functions as the second overshoot part, the second correction device corrects the gradation value of the video signal of aforementioned another unit frame cycle period based on the gradation value of the one unit frame cycle period, and makes it possible to perform display drive of the video part with a fourth gradation voltage that is different from a third gradation voltage which corresponds to the gradation value corrected by the first correction. The second correction device corrects the gradation value in such a manner that time integrated value of the luminance in the aforementioned another unit frame cycle period where display is being changed becomes larger than the time integrated value of the luminance in still another unit frame cycle period after display is being changed. In this case, the "monochrome image insertion drive control device" controls the monochrome image insertion drive based on the monochrome image inserted video signal that contains the video part of the third gradation voltage or the fourth gradation voltage and the monochrome image part of the second gradation voltage.

Further, the "monochrome image insertion drive control device" is capable of setting the insertion rate of the monochrome image signals with respect to the video signals in a unit frame cycle period in accordance with the operating environments. In that case, the "second correction device" performs correction of the gradation value in accordance with the insertion rate set by the monochrome image insertion rate setting device. The "first correction device" performs correction of the gradation value in accordance with the insertion rate set by the monochrome image insertion rate setting device. Thereby, the monochrome image insertion rate is determined depending on the type of the display panel, and the first correction and the second correction can be performed in accordance with the determined rate.

Further, the "multi-gradation device" is a device for implementing multi-gradation by increasing the resolution of the gradations for the inputted video signals. At this time, the "second correction device" performs correction with the gradation value to which multi-gradation processing is performed by the multi-gradation device. Furthermore, the "first correction device" performs correction with the gradation value to which multi-gradation processing is performed by the multi-gradation device.

Moreover, in a case of a liquid crystal display panel of a normally-black mode, the first correction device corrects the gradation value of the video signal in such a manner that the third gradation voltage becomes larger than the first gradation voltage. The second correction device corrects the gradation value of the video signal in such a manner that the fourth gradation voltage becomes larger than the third gradation voltage.

Further, the "source line driving device" supplies, to each source line, a monochrome image inserted video signal which contains a video part and a monochrome image part alternately. The "gate line driving device" may be provided with: a video display scanning executing function which executes video display scanning by successively supplying, to each of the gate lines, a video display gate-on signal for writing only the video part of the monochrome image inserted video signal to the pixels; and a monochrome image display scanning executing function which executes monochrome image display scanning by successively supplying, to each of the gate lines, a monochrome display gate-on signal for writing only the monochrome image part of the monochrome image inserted video signal to the pixels.

(Functions of Black Insertion Drive Control Part)

Next, functions of the black insertion drive control part 24 will be described.

The controller 20 of the liquid crystal display device 1 according to the first exemplary embodiment performs drive control of the black insertion drive by controlling the actions of the source drivers 16 and the gate drivers 14-1 to **14-*i***.

The black insertion drive control part 24 inserts a black image signal to an inputted video signal to generate a black inserted video signal that includes a video signal part and a black image signal part within a horizontal scanning period, and outputs the black inserted video signal to the source drivers 16.

Figure 19:
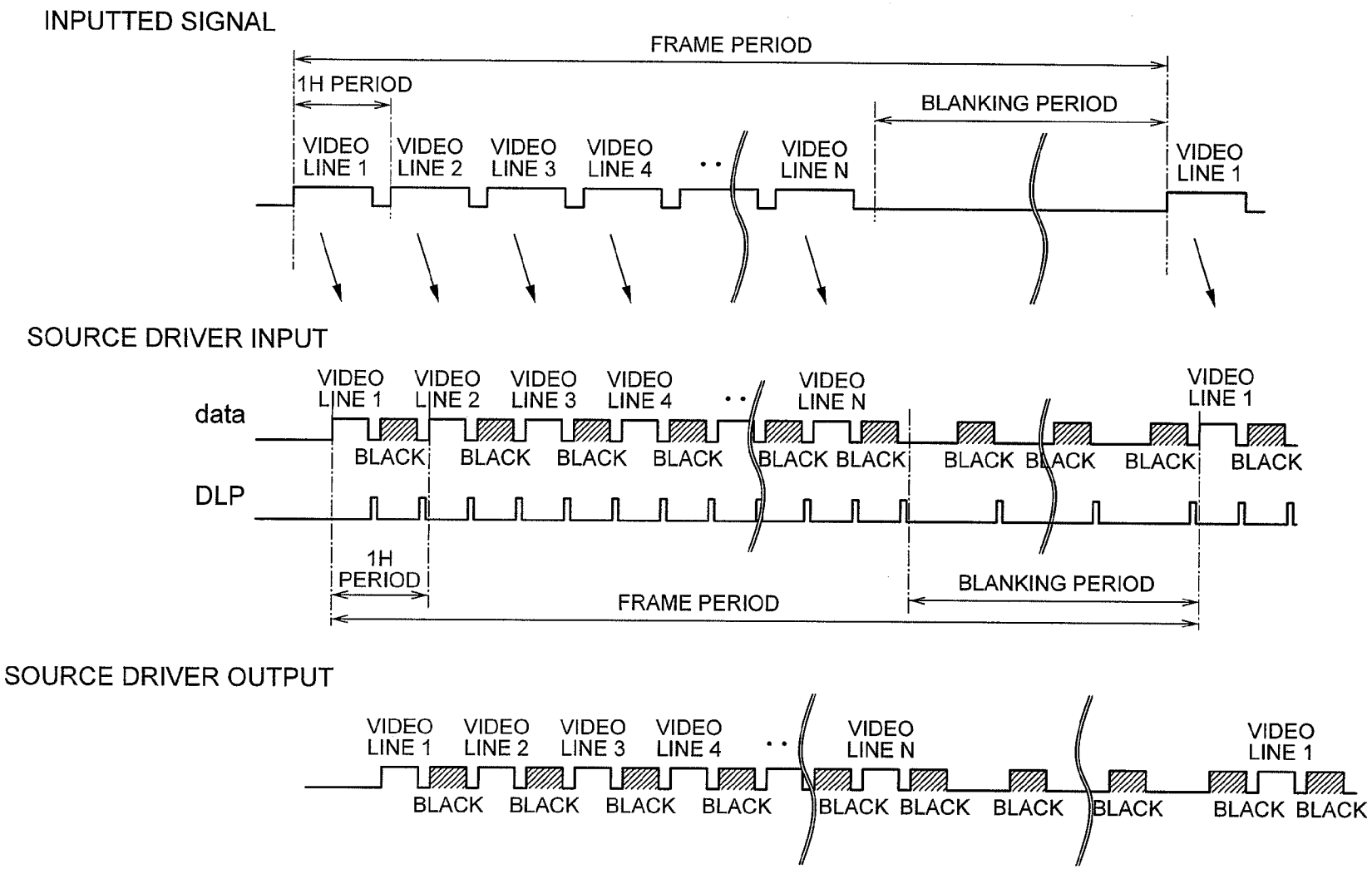
FIG. 19 is an illustration for describing an example of a process of creating a black inserted image signal in the liquid crystal display device according to the first exemplary embodiment of the invention.

As shown in FIG. 19, one frame period is divided into writing periods (horizontal scanning periods) of the same number as that (m) of the gate lines V1 to Vm. Provided that the part corresponding to the writing period of the inputted video signal is a line image part (horizontal scanning period part), the black insertion drive control part 24 has a function of inserting a black image signal between the line image parts of the inputted video signal.

Further, the black insertion drive control part has a function of inserting the black image signal also in a blanking period of the inputted video signal. FIG. 19 shows a case where the black image signal is inputted to the inputted video signal having no output of dummy signals in the blanking period.

The source drivers 16 function as the source line driving device by alternately outputting the line video part and the black image part to the source lines H1-Hn according to the black inserted video signal.

The first exemplary embodiment is so configured that the black image signal generated by the black insertion drive control part 24 is inputted to the source drivers 16 and outputted to the source lines H1-Hn by double-speed drive.

The black insertion drive control part 24 has a function of individually supplying, to the gate drivers 14 (14-1 to **14-*i*), output enable signals for controlling open/close of the gate outputs of the gate drivers 14 (14-1 to 14-*i*). Specifically, the black insertion drive control part 24 has a function of individually supplying a video-display enable signal (VOE_i) for enabling the output of the gate-on signal only in a period where the line image part of the black inserted video signal is supplied to the source lines H1-Hn, or individually supplying a black-display enable signal (VOE_b) for enabling the output of the gate-on signal only in a period where the black image part of the black inserted video signal is supplied to the source lines H1**-Hn.

Thereby, each of the gate drivers 14 (14-1 to **14-*i*) has a function of collectively controlling the outputs for the connected gate lines V(1-1) to V(1-*j*), V(2-1) to V(2-*j*), V(i-1**) to V(i-j).

Specifically, each of the gate drivers 14 (14-1 to **14-*i*) has: a function of being a video display device which successively executes the video display scanning by setting the gate-on signal to the video display gate-on signal with a pulse width for writing only the line image part of the black inserted video signal to the pixels according to VOE_i from the black insertion drive control part 24, and by successively supplying it to the gate lines V(1-1) to V(1-*j*), V(2-1) to V(2-*j*), - - - , V(i-1) to V(i-j); and a function of being a black display device which successively executes the black image display scanning by setting the gate on signal to the black display gate-on signal with a pulse width for writing only the black image part of the black inserted video signal to the pixels according to VOE_b from the black insertion drive control part 24, and by successively supplying it to the gate lines V(1-1) to V(1-*j*), V(2-1) to V(2-*j*), - - - , V(i-1**) to V(i-j).

Further, the black insertion drive control part 24 has a function of outputting, to the gate driver 14-1, a video display scanning start pulse (VSP_i) for writing the video signal and a black display scanning start pulse (VSP_b) for writing the black image signal once for each at a different timing within one frame period. The black insertion drive control part 24 outputs VSP_i to the gate drive 14-1 when starting the video display scanning, and starts supply of VSP_i to the gate driver 14-1 at the same time. When the video display scanning in the gate driver 14-1 is ended, the black insertion drive control part 24 starts supply of VOE_b to the gate driver 14-1, and outputs VSP_b to the gate driver 14-1 at a timing of starting the black image display.

Further, the timing controller 20 includes the black insertion rate setting part 22 which sets the output timing of the black display start pulse (VSP_b) from the black insertion drive control part 24 depending on operational environments.

The black insertion rate setting part 22 includes a function of judging the black image insertion rate by referring to the inputted signal. The black insertion rate setting part 22 includes a function of setting the output timing of VSP_b from the black insertion drive control part 24 in accordance with the judged black image insertion rate.

For example, the black insertion rate setting part 22 can be structured to include a judging part for determining the black insertion rate based on setting information that is selected as designed by a user, or can be structured to include a judging part for judging the optimum image insertion rate through calculating a characteristic value of the inputted video signal inputted successively by each frame, and comparing the characteristic value of the given frame and the characteristic value of the previous frame.

This makes it possible to judge the black image insertion rate for each frame period suited for the drive method of the display panel 10, the use condition, and the like, and to set the output timing of VSP_b that can achieve the judged black image insertion rate. Further, the timing set herein is the timing at which the pixel line for writing the video signal and the pixel line for writing the black image signal are not selected simultaneously.

The gate driver 14-1 receives input of VSP_b from the black insertion drive control part 24 at the timing set by the black insertion rate setting part 22, successively supplies VSP_b based on VOE_b that is supplied in advance, and shift-outputs VSP_b to the gate driver 14-2 when the scanning ends. By successively executing such scanning with the gate drivers 14 (14-1 to **14-*i*), the black image insertion rate for each frame judged by the black insertion rate setting part 22** can be achieved.

Further, the black insertion drive control part 24 supplies, to the source drivers 16, a signal start pulse (HSP) for drive-controlling the source drivers 16, a horizontal clock signal (HCK), a latch signal (DLP), a polarity inversion control signal (POL) along with the black inserted video signal (data), and supplies, to the gate drivers 14-1 to **14-*i*, a scanning start pulse (VSP-i or VSP-b) as a signal for drive-controlling the gate drivers 14-1 to 14-*i***, a vertical clock signal (VCK), an enable signal (VOE_i or VOE_b).

The source driver 16 has the same functions as those used in general. For example, the source driver 16 starts to fetch the data signal upon receiving input of HSP, and successively stores the data signal to an internal register by synchronizing with HCK. Then, the source drive 16 settles the data signal by input of DLP, settles positive/negative from a reference voltage according to POL at the same time, and outputs the gradation voltage according to the data signal to the source lines H1 to Hn.

The polarity inversion signal (POL) is a control signal for settling the polarity (positive/negative form the reference voltage) of the gradation voltage outputted from the source driver 16 to the source lines H1 to Hn. The black insertion drive control part 24 has a function of inverting the writing polarity of the line image part by a frame cycle starting from VSP_i and by inverting the writing polarity of the black image part by a frame cycle starting from VSP_b by controlling POL to execute frame polarity inversion drive such as dot inversion or 1H2V inversion drive.

(Overall Schematic Operations of Controller)

The liquid crystal display device 1 of the above-described structure operates roughly as follows. That is, when the video signal is inputted to the controller 20, the black insertion rate setting part 22 sets the black insertion rate of the video signal in accordance with the number of data by each frame.

Further, the first overshoot drive control part 34 selects and refers to the table corresponding to the black insertion rate from the first LUT part 32 based on the inputted video signal and the black insertion rate set by the black insertion rate setting part 22, and corrects the gradation value of the video signal to obtain the first corrected video signal. The first corrected video signal corrected by the first overshoot drive control part 34 is inputted to the second overshoot part 40.

The second overshoot part 40 further corrects the first corrected video signal to obtain the second corrected signal. Specifically, the frame memory communication control part 44 temporarily stores the first corrected video signal of the previous frame to the FM part 42.

The second overshoot drive control part 48 compares the temporarily stored first corrected video signal of the previous frame and the first corrected video signal of the current frame inputted via the frame memory communication control part 44. At the same time, the second overshoot drive control part 48 selects and refers to the table corresponding to the black insertion rate from the second LUT part 46 based on the inputted video signal and the black insertion rate set by the black insertion rate setting part 22, and corrects the gradation value of the first corrected video signal to obtain the second corrected video signal.

At this time, when the FRC part 26 generates a specific intermediate gradation and performs multi-gradation processing, the second overshoot drive control part 48 can set the gradation value of the second corrected video signal by selecting the optimum table in accordance with the number of multi-gradations.

The black insertion drive control part 24 inserts the monochrome image signal (black image signal) to the video signal (second corrected video signal). That is, the black insertion drive control part 24 generates a black inserted video signal which contains a video display part corresponding to the writing period of the video signal and a black display part corresponding to the writing period of the black image signal alternately in a specific period.

The black insertion drive control part 24 supplies the first gradation voltage that corresponds to the gradation value of the video display to the display panel in a first period of the specific period, and supplies the second gradation voltage that corresponds to the gradation value of the black display to the display panel 10 in a second period continued from the first period of the specific period according to the black inserted video signal so as to perform display drive control of the liquid crystal display panel 10.

Figure 6:
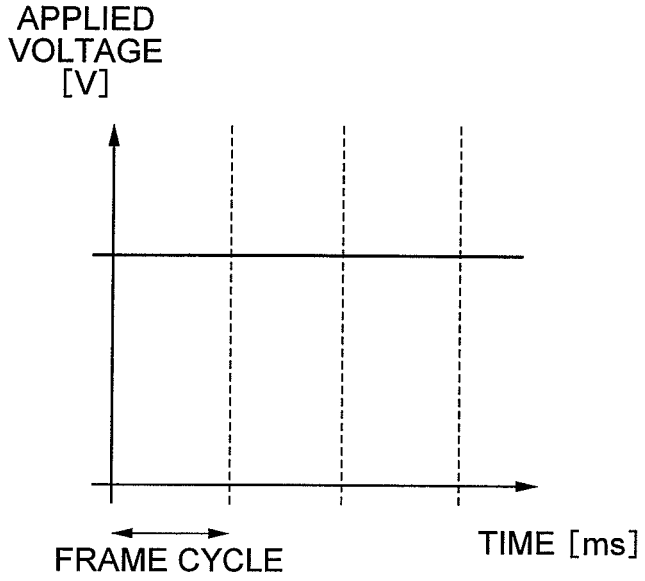
FIG. 6 shows illustrations of a case of normal drive for describing states of applied voltage and luminance when executing black insertion drive in the liquid crystal display device according to the first exemplary embodiment of the invention.
Figure 6:
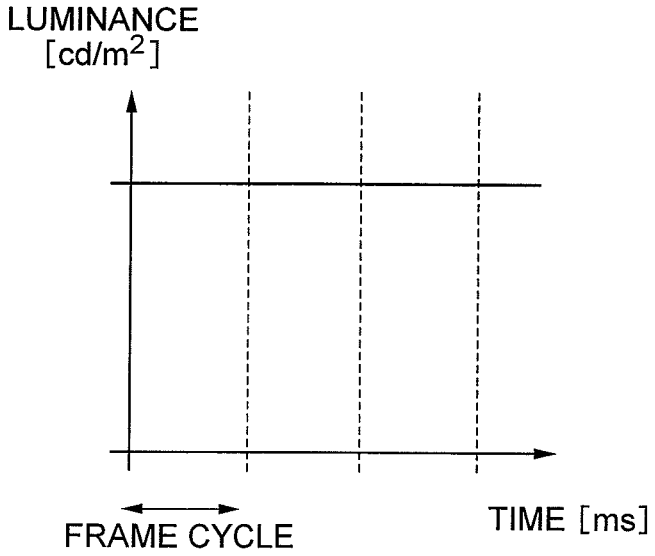
Figure 7:
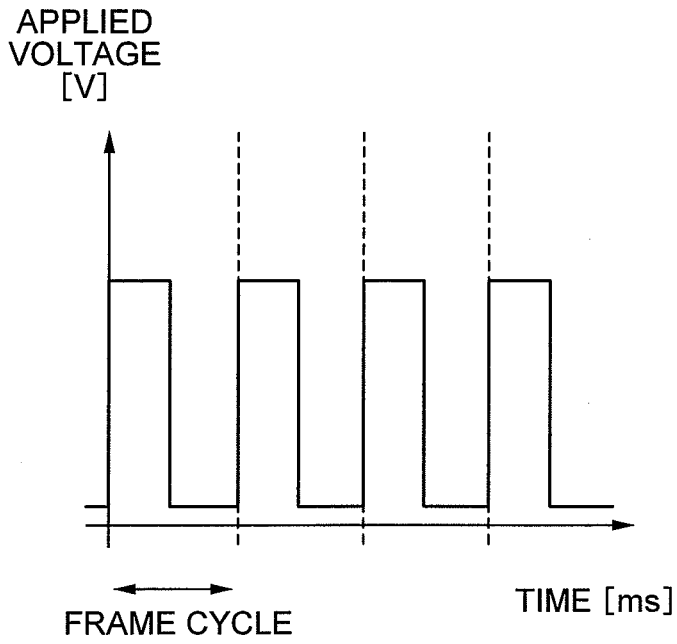
FIG. 7 shows illustrations of a case of black insertion drive executed in a panel whose response speed is relatively slow, which are for describing states of applied voltage and luminance under black insertion drive executed in the liquid crystal display device according to the first exemplary embodiment of the invention.
Figure 7:
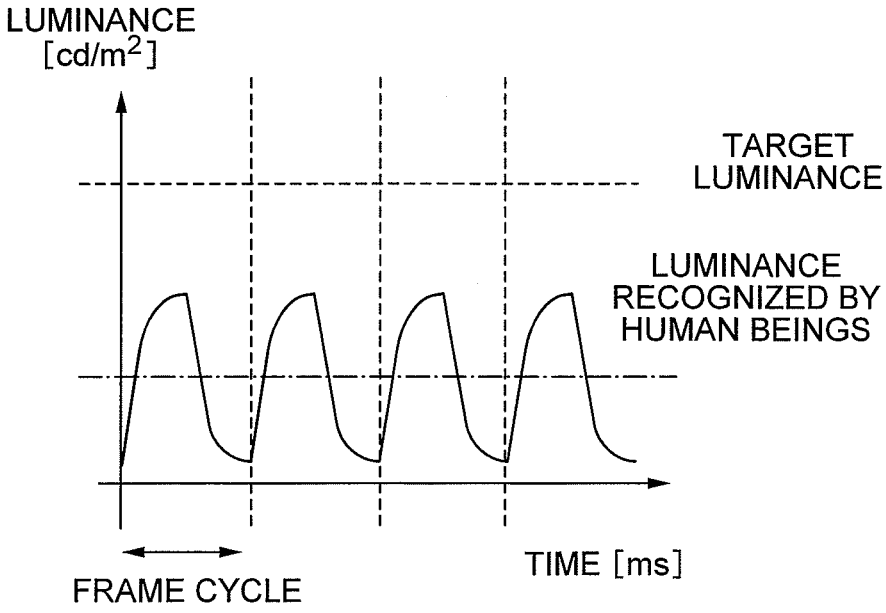
Figure 8:
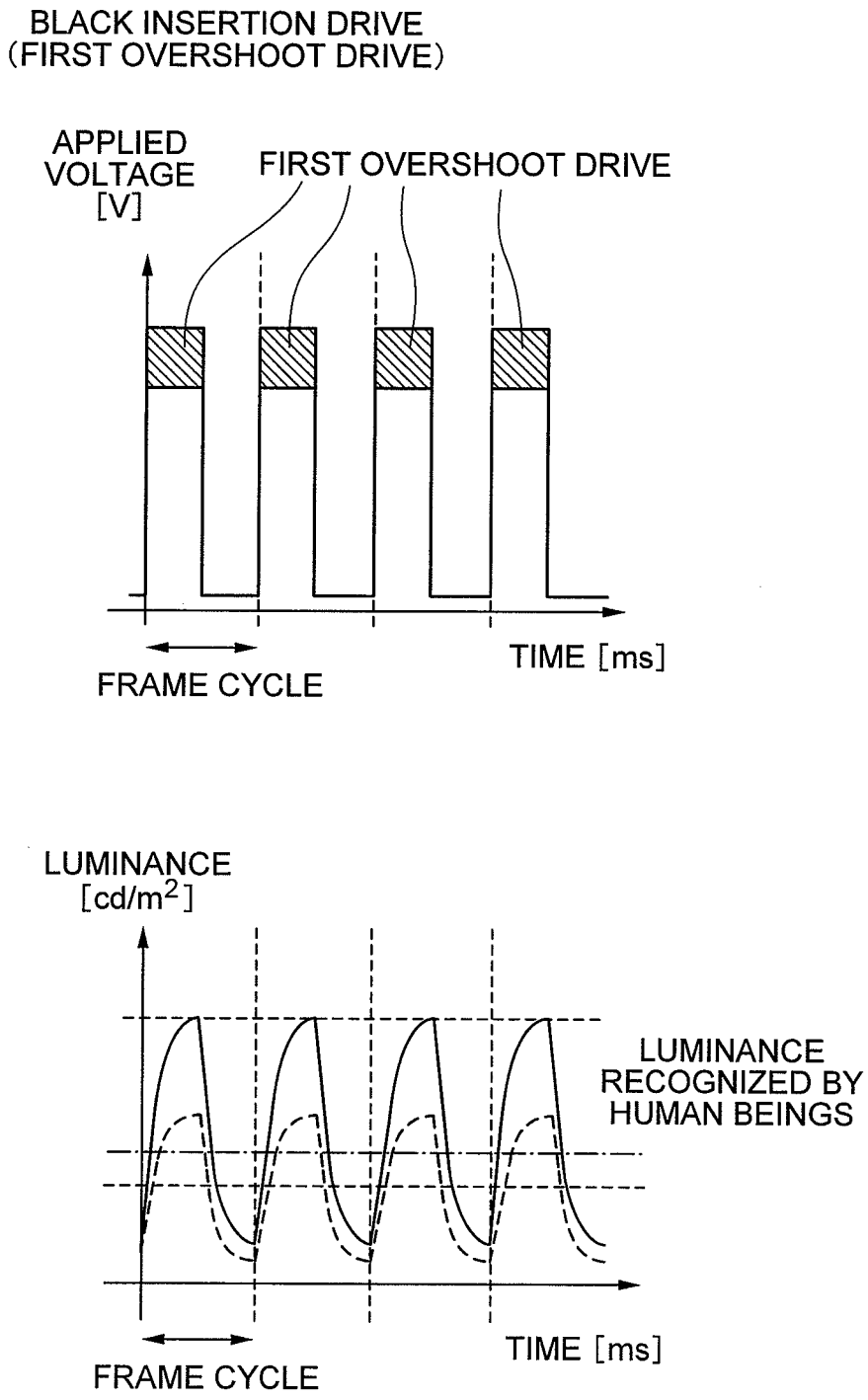
FIG. 8 shows illustrations of a case where a first overshoot drive is employed in the black insertion drive, which are for describing states of applied voltage and luminance when executing the black insertion drive in the liquid crystal display device according to the first exemplary embodiment of the invention.

Here, changes in the luminance occurred at the time of performing the first and the second overshoot drives in the black insertion drive will be described by referring to FIG. 6-FIG. 8. FIG. 6-FIG. 8 illustrate examples of a case where the black insertion drive is employed for a liquid crystal display panel whose response speed is relatively slow.

The black insertion drive is a drive for performing black display between the video displays, with which the panel writing frequency becomes doubled, and the hold time of the liquid crystal is shortened. Therefore, as shown in FIG. 7, the luminance in the video display does not reach the target luminance in the panel with the slow response speed, unlike the case of normal drive shown in FIG. 6. Thus, the luminance in FIG. 7 becomes largely deteriorated compared to the luminance of the normal drive shown in FIG. 6.

With the first overshoot drive of the exemplary embodiment, however, it is possible to convert the applied voltage of the video signal into the second gradation voltage that is larger than the first gradation voltage through performing the first correction on the gradation value of the video display after the black display as shown in FIG. 8. This makes it possible to speed up the response of the video display so as to improve the luminance.

Figure 12:
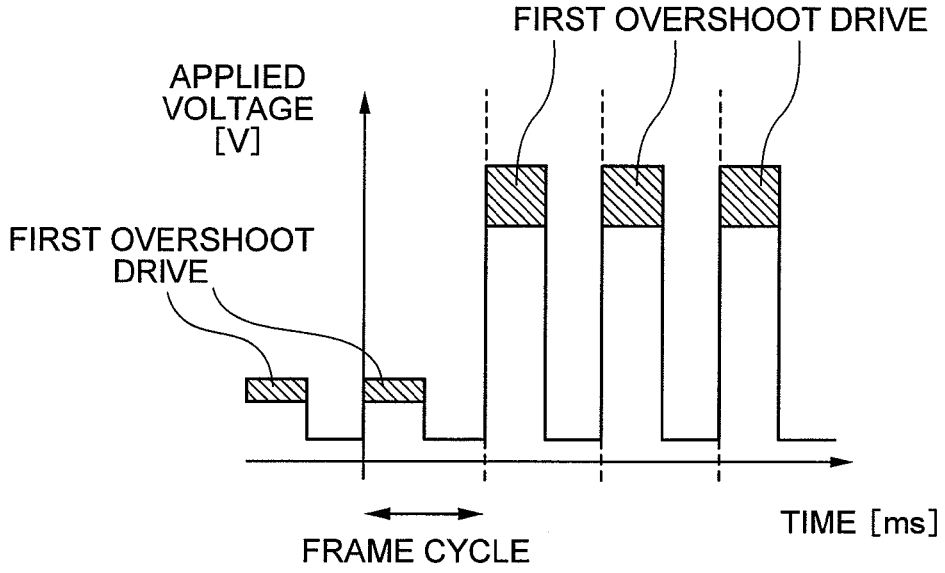
FIG. 12 shows illustrations for describing an example of the first overshoot drive in the black insertion drive of the liquid crystal display device according to the first exemplary embodiment of the invention.
Figure 12:
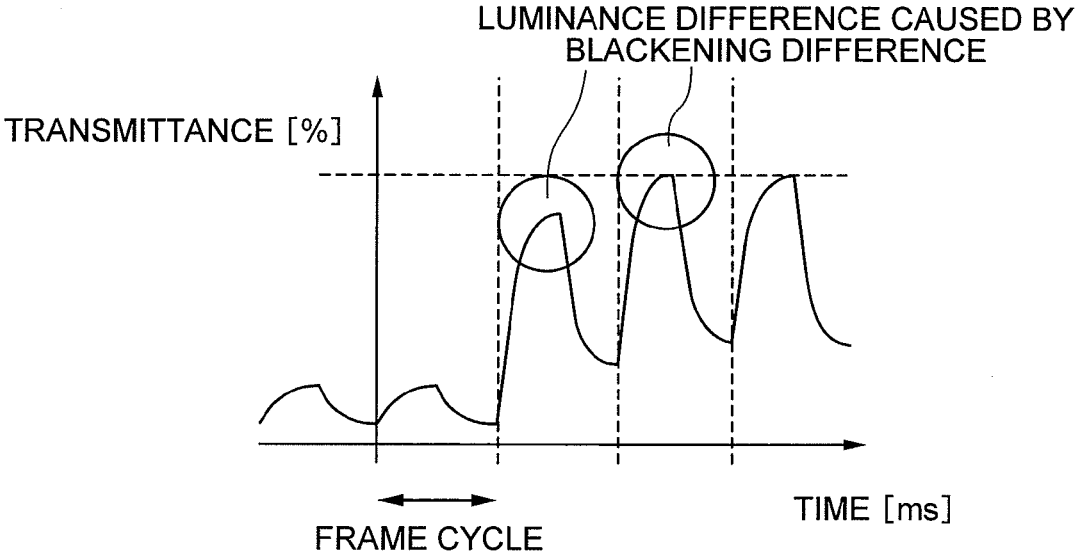
Figure 12:
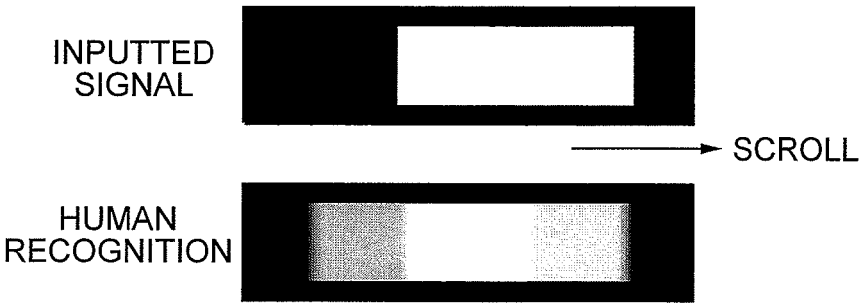

However, as shown in FIG. 12, if blackening of the black display is not completed with the panel whose response speed is relatively slow, display becomes accumulatively changed due to a difference between the blackening and blackening of black display after the previous video display by simply executing the first overshoot drive. This causes step-like tailing and ghost in letter scroll. Further, step-like tailing and ghost in letter scroll occur not only by the accumulative luminance changes of the video display but also by the difference in the blackening of the black displays.

Figure 14:
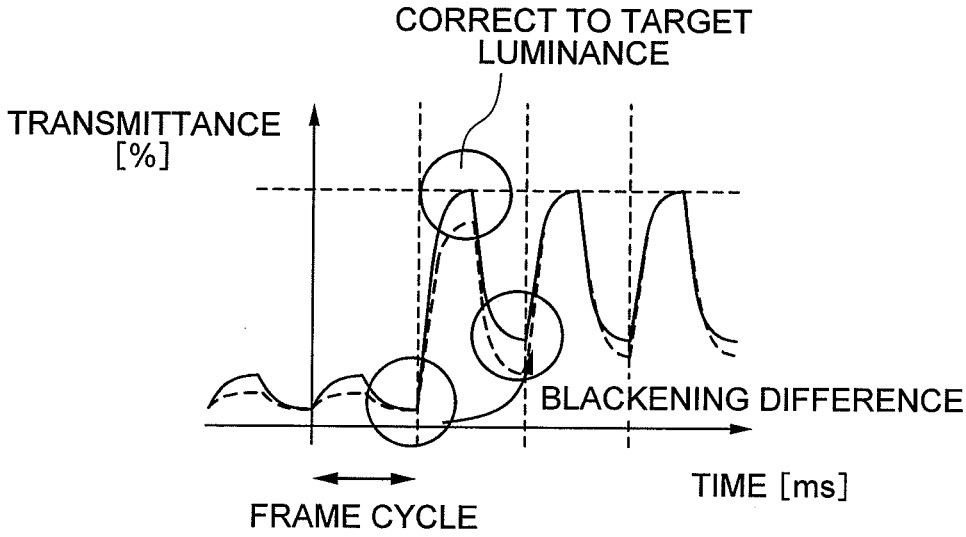
FIG. 14 shows illustrations for describing an example of a correction amount of the second overshoot drive in the black insertion drive of the liquid crystal display device according to the first exemplary embodiment of the invention.
Figure 14:
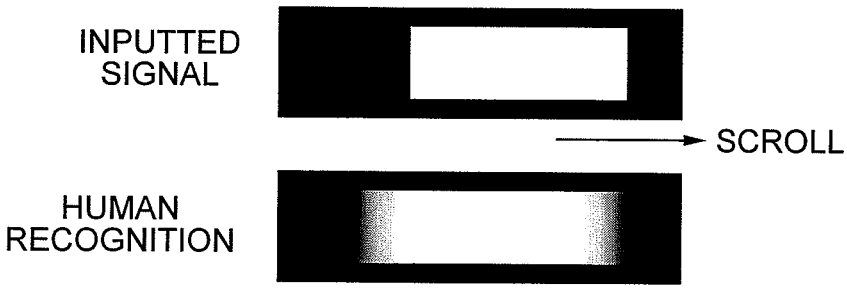

Therefore, as shown in FIG. 14, when the second overshoot drive is only performed to a level of the target luminance of the video signal, the step-like tailing and ghost in letter scroll still occur due to the differences between the blackening of the black displays, even though the step-like tailing and ghost in letter scroll caused due to the accumulative luminance changes in the video display can be lightened.

Figure 13:
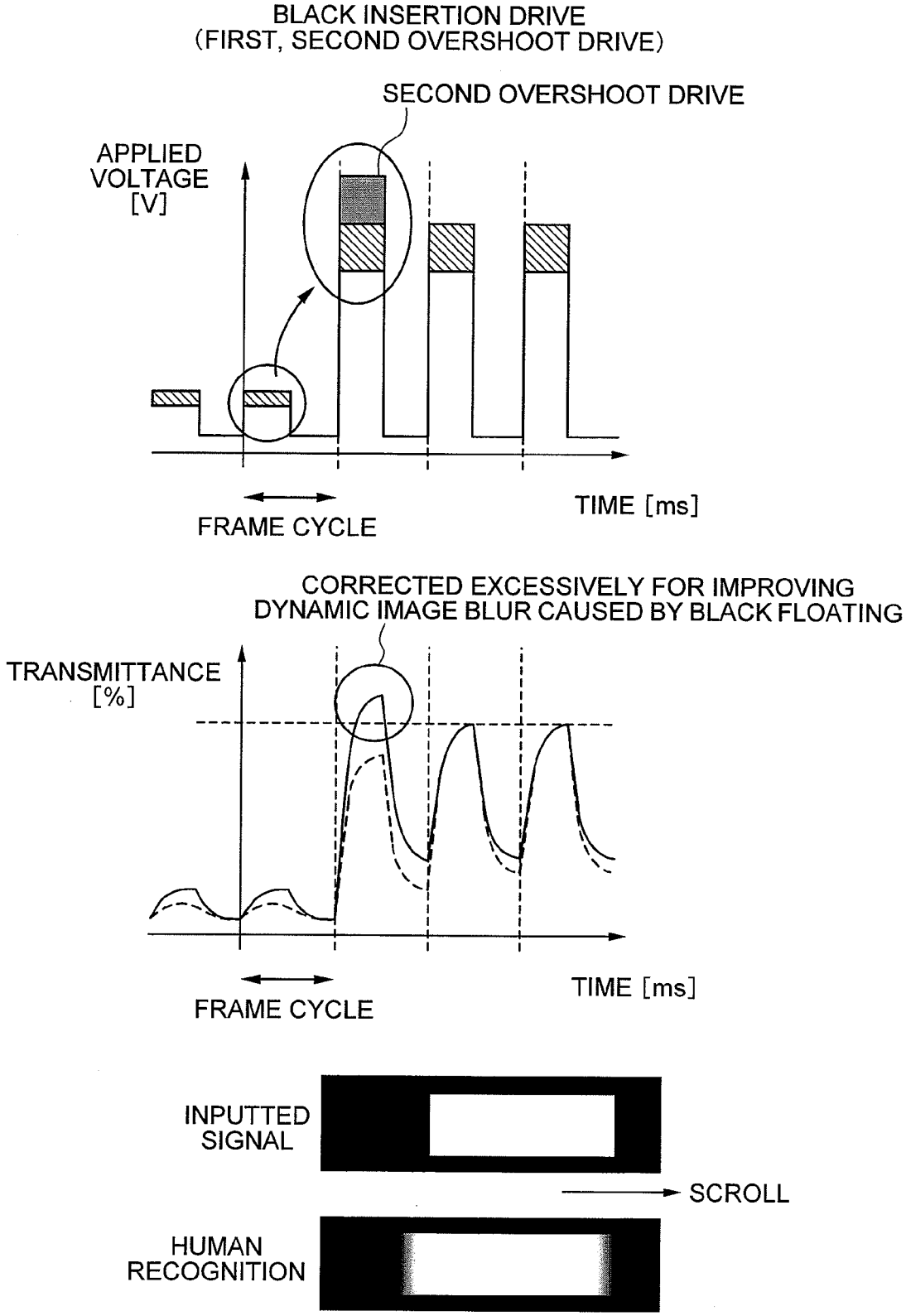
FIG. 13 shows illustrations for describing an example of second overshoot drive in the black insertion drive of the liquid crystal display device according to the first exemplary embodiment of the invention.
Figure 15:
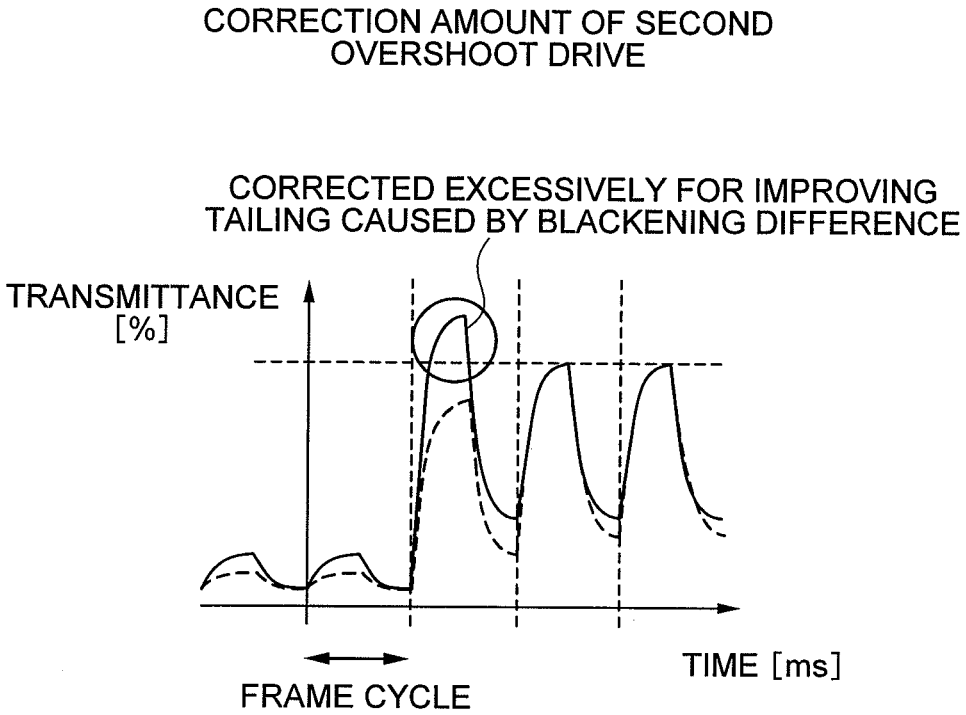
FIG. 15 shows illustrations for describing an example of the correction amount of the second overshoot drive in the black insertion drive of the liquid crystal display device according to the first exemplary embodiment of the invention.
Figure 15:
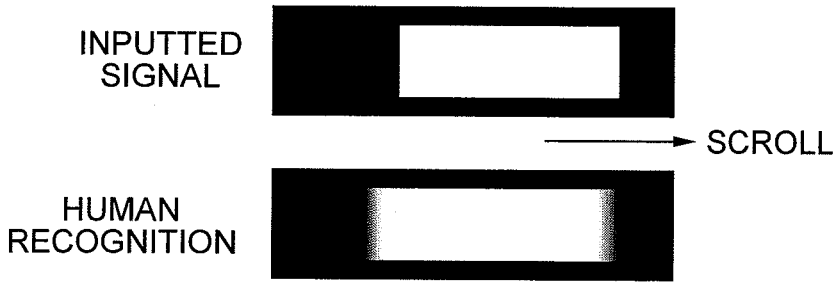

Thus, as shown in FIG. 13 and FIG. 15, the second over shoot drive performs correction in such a manner that the video display shifts the luminance that exceeds the target luminance so as to further lighten the step-like tailing and ghost in letter scroll that occur due to the differences between the blackening of the black displays.

Figure 16:
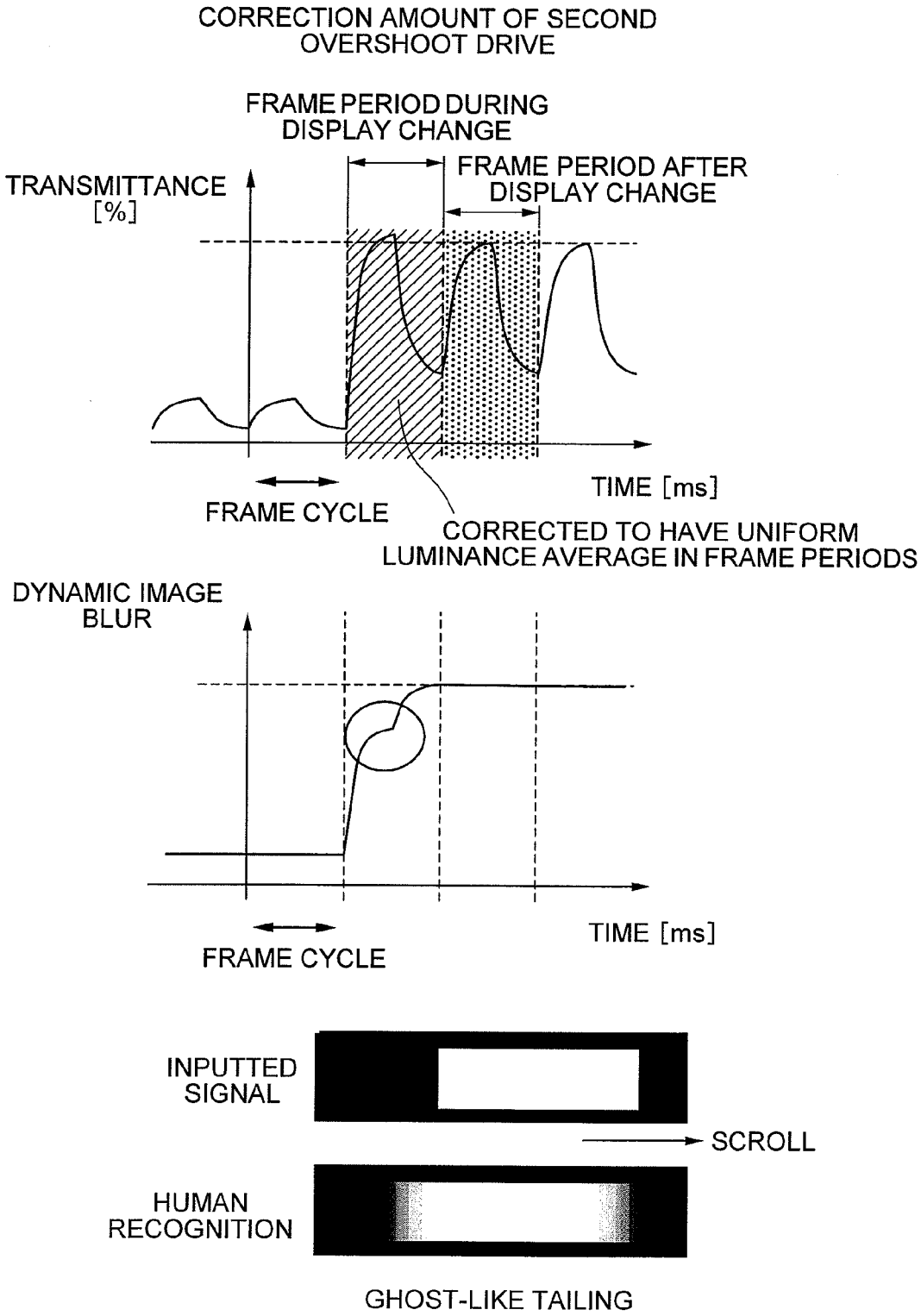
FIG. 16 shows illustrations for describing an example of the correction amount of the second overshoot drive in the black insertion drive of the liquid crystal display device according to the first exemplary embodiment of the invention.

Further, ghost-like tailing also occurs in the video display due to unreached luminance of the black display. As shown in FIG. 16, the ghost-like tailing cannot be overcome even if the mean values of the luminance of the frame periods during the display change and after the display change are made almost equivalent. This is because when the transmittance of black display of pseudo-impulse type drive changes, the transmittance change timing of the black display become different from the transmittance change timing of the video display, so that the dynamic image tailing of the hold-type display device shifts in two stages.

Figure 17:
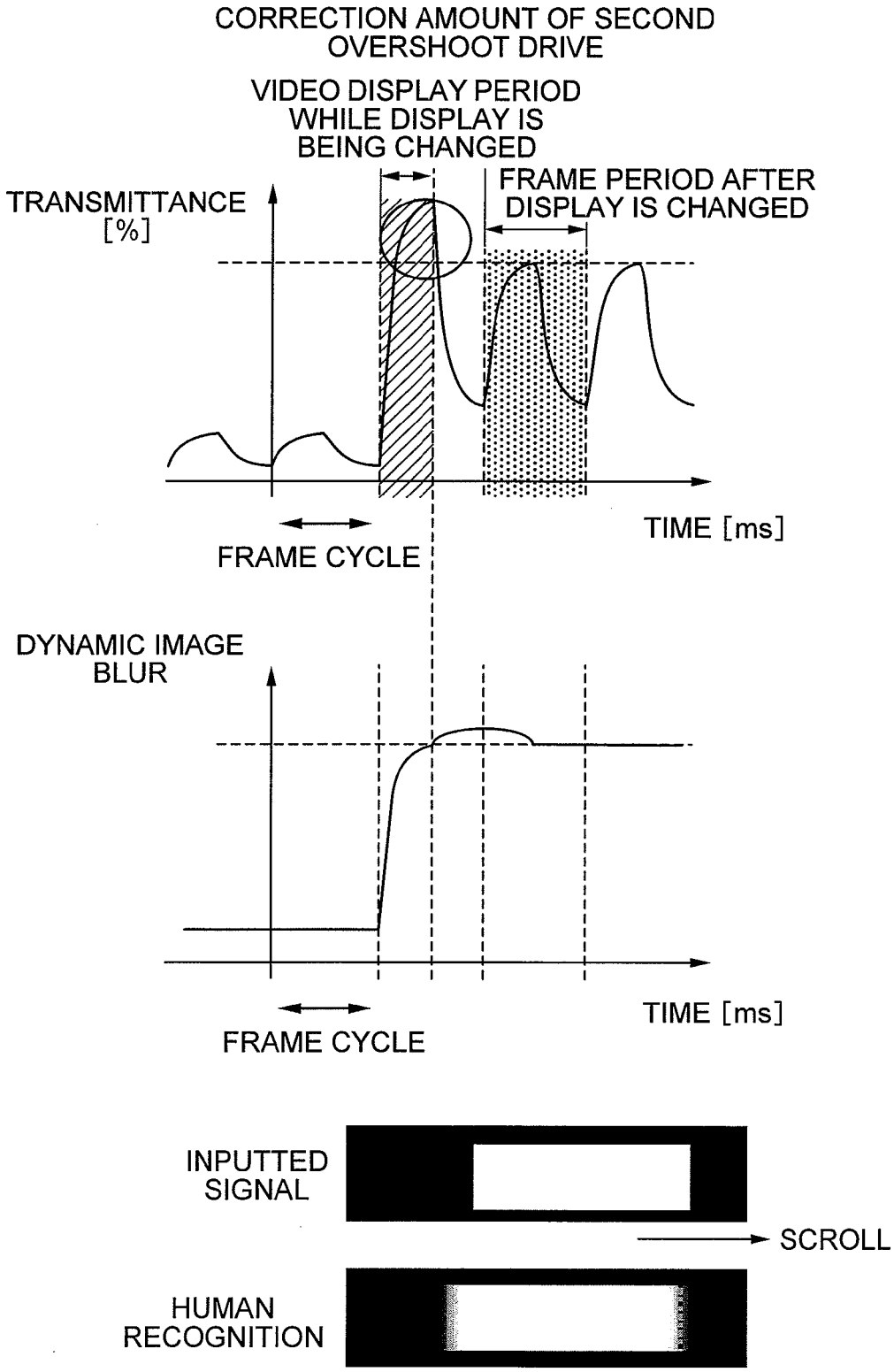
FIG. 17 shows illustrations for describing an example of the correction amount of the second overshoot drive in the black insertion drive of the liquid crystal display device according to the first exemplary embodiment of the invention.

With this exemplary embodiment, however, as shown in FIG. 17, it is possible to lighten the ghost-like tailing by excessively emphasizing the transmittance of the video display indirectly in such a manner that the time integrated value of the transmission amount of the liquid crystal in the frame period during the display change becomes larger than the time integrated value of the after the display change. Further, it is also possible to lighten the ghost-like tailing by setting the luminance mean value of the "video display period" during the display change to be the luminance mean value of one frame period (video+black display period) after the display change.

This makes it possible to improve the shortcomings of the dynamic image display even with the liquid crystal display panel of relatively slow response speed, with the structure that is capable of reducing the frame memory frequency and changing the black insertion rate.

(Regarding Processing Procedure)

(Entire Processing)

Next, a more specific drive control procedure of the liquid crystal display panel by the control signals generated in the black insertion drive control part 24 of the liquid crystal display device having the above-described structure, and various kinds of processing procedures executed in the liquid crystal display device will be described by referring to FIG. 18-FIG. 24.

First, the entire processing regarding the processing procedure of the liquid crystal display device according to the exemplary embodiment will be described. Thereafter, the black insertion drive control processing, the overshoot drive processing, and the detailed processing of the driver side will be described.

A drive control method of the display panel control device according to the present invention is designed for performing a display drive control by supplying, to a display panel, monochrome image inserted video signals in which a unit cycle period including a first gradation voltage video part for providing video display according to a gradation value of a video signal and a second gradation voltage monochrome image part for providing monochrome display according to a gradation value of a monochrome image signal are repeated, and performing monochrome image insertion drive which starts insertion of monochrome image display scanning at an arbitrary timing of video display scanning for the display panel.

As the basic structure, the liquid crystal display device drive control method includes: a first correcting step (for example, step S10 shown in FIG. 18) which performs the first correction on the gradation value of the video signal so as to increase the change amount between the first gradation voltage and the second gradation voltage, by considering the response delay of the display panel when changing from the second gradation voltage to the first gradation voltage; a second correcting step (for example step S11 shown in FIG. 18) which performs the second correction on one of or both of the gradation value of the video signal that is corrected by the first correction and the gradation value of the monochrome image signal so as to increase the change amount between the first gradation voltage and the second gradation voltage, by considering the accumulative luminance reaching delay of the video part caused due to a difference between each monochrome display luminance of each monochrome image part in different unit frame cycle periods, when the gradation value of the video signal changes from a given unit frame cycle period to another unit frame cycle period; and a monochrome image insertion drive controlling step (for example, step S12 shown in FIG. 18) which generates the monochrome image inserted video signal including the video part and the monochrome image part to which the first correction or the second correction is performed, or generates the monochrome image inserted video signal including the video part to which the first correction is performed and the monochrome image part to which the second correction is performed, and controls the display drive of the display panel by the monochrome image insertion drive.

Further, the second correcting step corrects the gradation value of the video signal of aforementioned another unit frame cycle period based on the gradation value of the given unit frame cycle period, and makes it possible to perform display drive of the video part with a fourth gradation voltage that is different from a third gradation voltage which corresponds to the gradation value corrected by the first correction. The second correcting step corrects the gradation value in such a manner that time integrated value of the luminance in the aforementioned another unit frame cycle period where display is being changed becomes larger than the time integrated value of the luminance in still another unit frame cycle period after display is being changed. In this case, the monochrome image insertion drive controlling step can control the monochrome image insertion drive based on the monochrome image inserted video signal that contains the video part of the third gradation voltage or the fourth gradation voltage and the monochrome image part of the second gradation voltage.

Further, the method may further include a monochrome image signal insertion rate setting step that is capable of setting the insertion ratio of the monochrome image signals with respect to the video signals in a unit frame cycle period in accordance with the operating environments. In that case, the second correcting step performs correction of the gradation value in accordance with the insertion rate set by the monochrome image insertion rate setting step. The first correcting step performs correction of the gradation value in accordance with the insertion set by the monochrome image insertion rate setting step. Furthermore, the second correcting step can perform multi-gradation processing by increasing the resolution of the gradations for the inputted video signals, and perform correction with the gradation value to which multi-gradation processing is performed.

(Black Insertion Drive Control Processing)

Here, details of the black insertion drive capable of changing the black insertion rate will be described by referring to FIG. 19-FIG. 24.

As shown in FIG. 1, the black insertion drive capable of changing the insertion rate uses at least two or more gate drivers capable of enabling the gate output collectively, such as the gate drivers 14 (14-1) and 14(14-2).

As shown in FIG. 19, the black inserted video signals that have black signals inserted between the lines of the video signal are inputted to the source driver. Then, the source driver alternately outputs the video signal and the black signal to the panel in order of the inputted signals.

Figure 22:
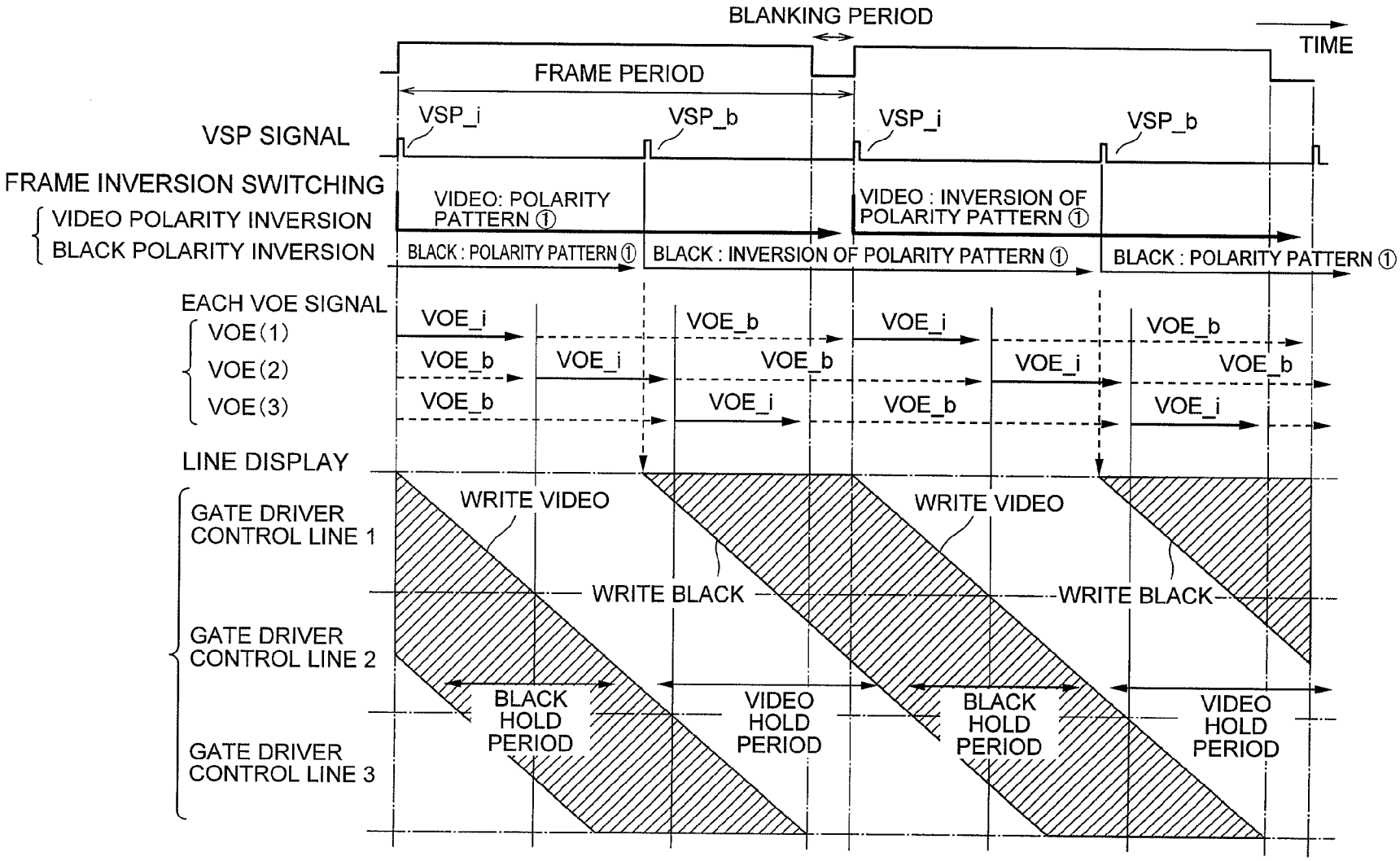
FIG. 22 is an illustration for describing an example of the black insertion drive performed by the liquid crystal display device according to the first exemplary embodiment of the invention.

FIG. 22 is an illustration for describing an example of the black insertion drive performed by the liquid crystal display device according to the first exemplary embodiment.

As shown in FIG. 22, this exemplary embodiment inputs the start pulse (VSP_i) of the first gate driver for writing the video signal at least once, and inputs the start pulse (VSP_b) of the second gate driver for writing the black signal at least once.

The video start pulse (VSP_i) is inputted at the start of a frame, and turns on the TFTs of the liquid crystal panel successively by shifting the lines of the screen with the clock (VCK) of the gate driver.

During this, the enable signal (VOE_i) for writing the video is inputted to each gate driver during the period where a line connected to that gate driver is being selected by the shift of the video start pulse (VSP_i).

In the mean time, the black start pulse (VSP_b) is inputted in the middle of the frame according to the determined black insertion rate, and also turns on the TFTs of the liquid crystal panel successively by shifting the lines of the screen with the clock (VCK) of the gate driver.

During this, the enable signal (VOE_b) for writing black is inputted to each gate driver during the period where a line connected to that gate driver is being selected by the shift of the black start pulse (VSP_b).

Figures 23A, 23B:
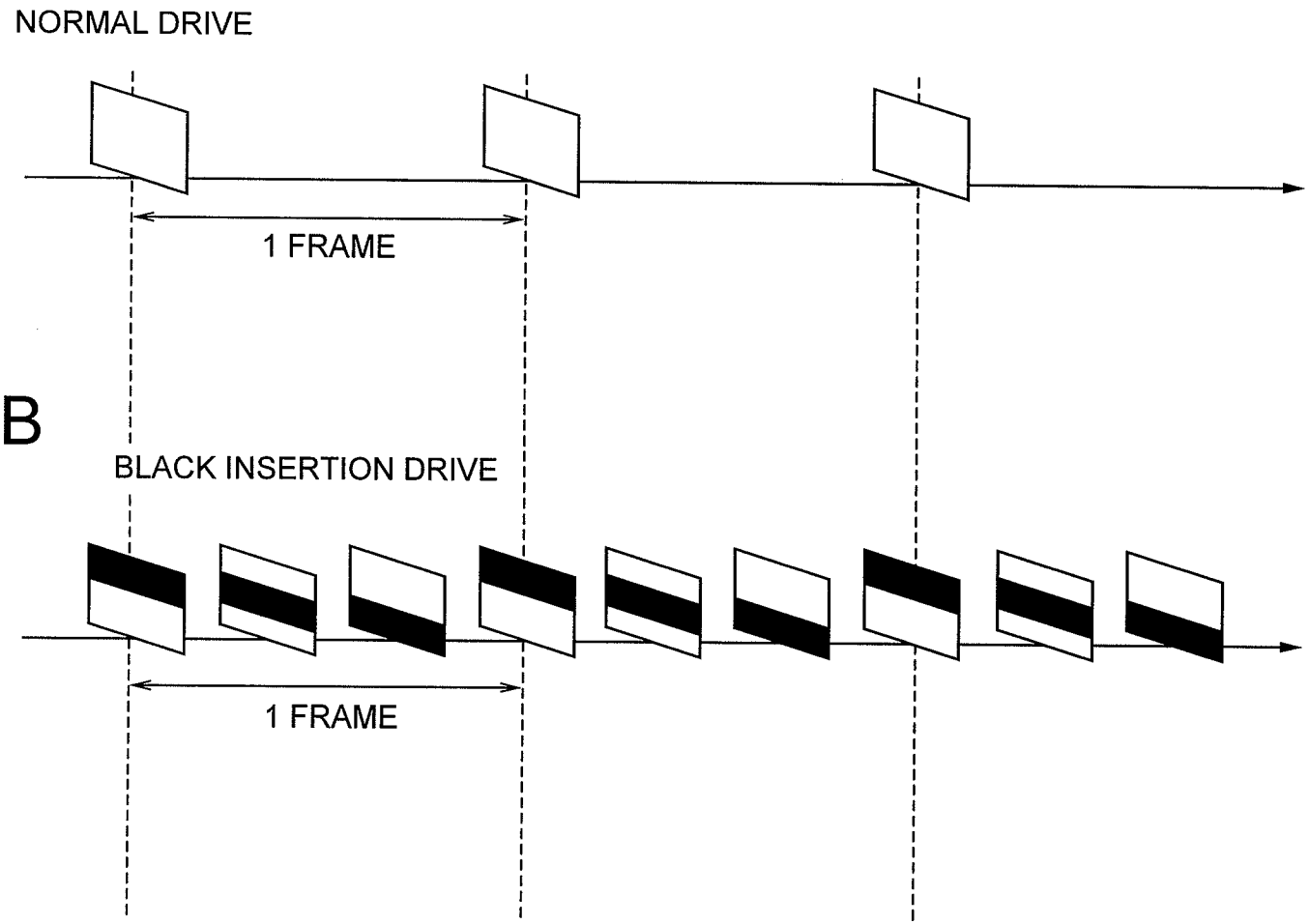
FIG. 23A is a case of normal drive and FIG. 23B is a case of black insertion drive.

With such configuration, it is possible to achieve the black insertion drive that can adjust the black insertion rate by having a black band scrolling on the screen in one frame and changing the width of the black band, as shown in FIG. 23B.

As shown in FIG. 22, the black start pulse (VSP_b) can be inputted at an arbitrary timing, as long as it is the timing at which the video and the black lines are not selected by a single driver simultaneously. Thus, there is no restriction regarding the timing, such as a break of the driver, or the like.

Figure 20:
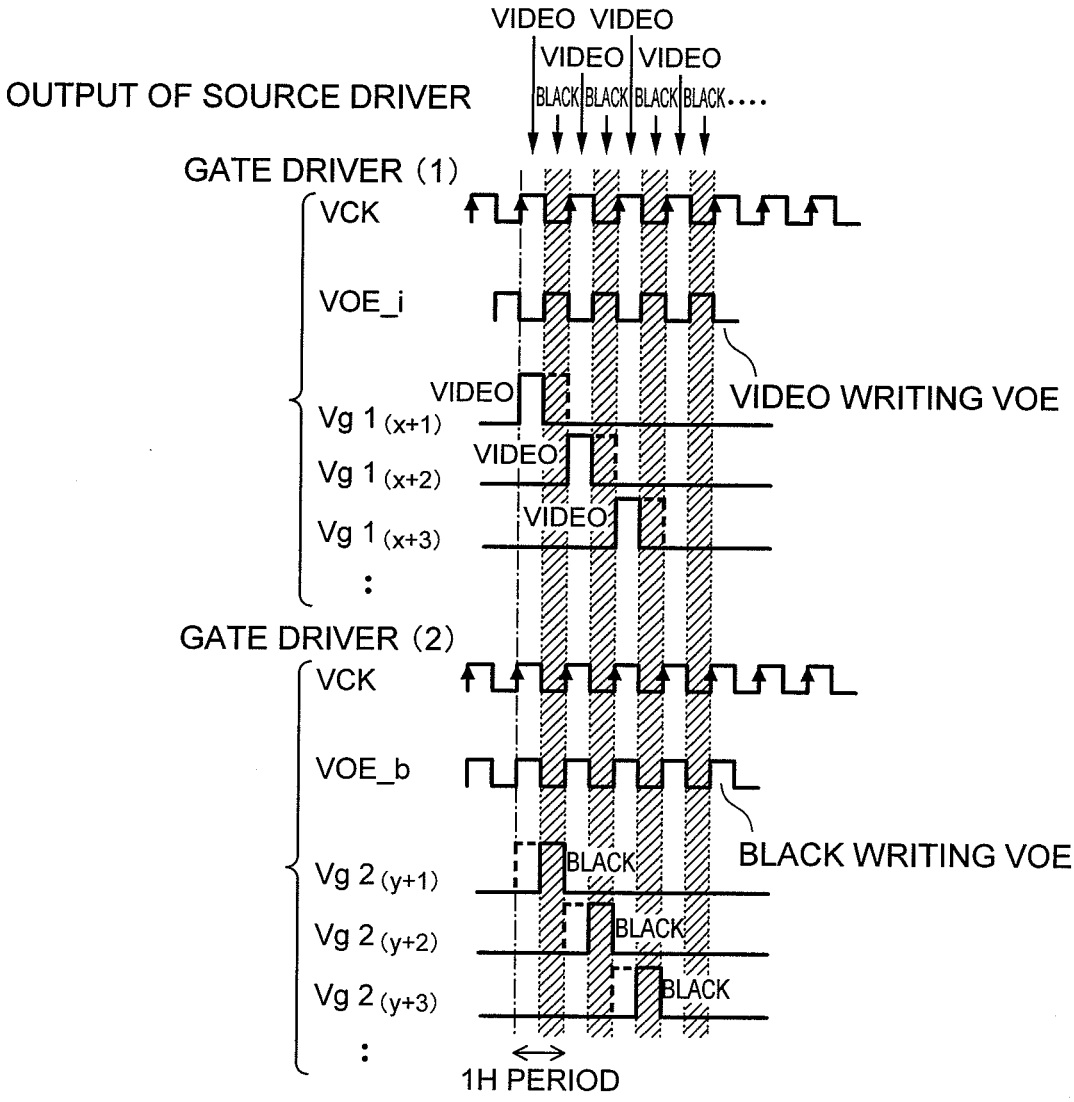
FIG. 20 is an illustration for describing an example of the black insertion drive performed by the liquid crystal display device according to the first exemplary embodiment of the invention, which is a timing chart of a case when writing a video signal to a line of a given gate driver (Y driver) and writing black to a line of another gate driver.
Figure 21:
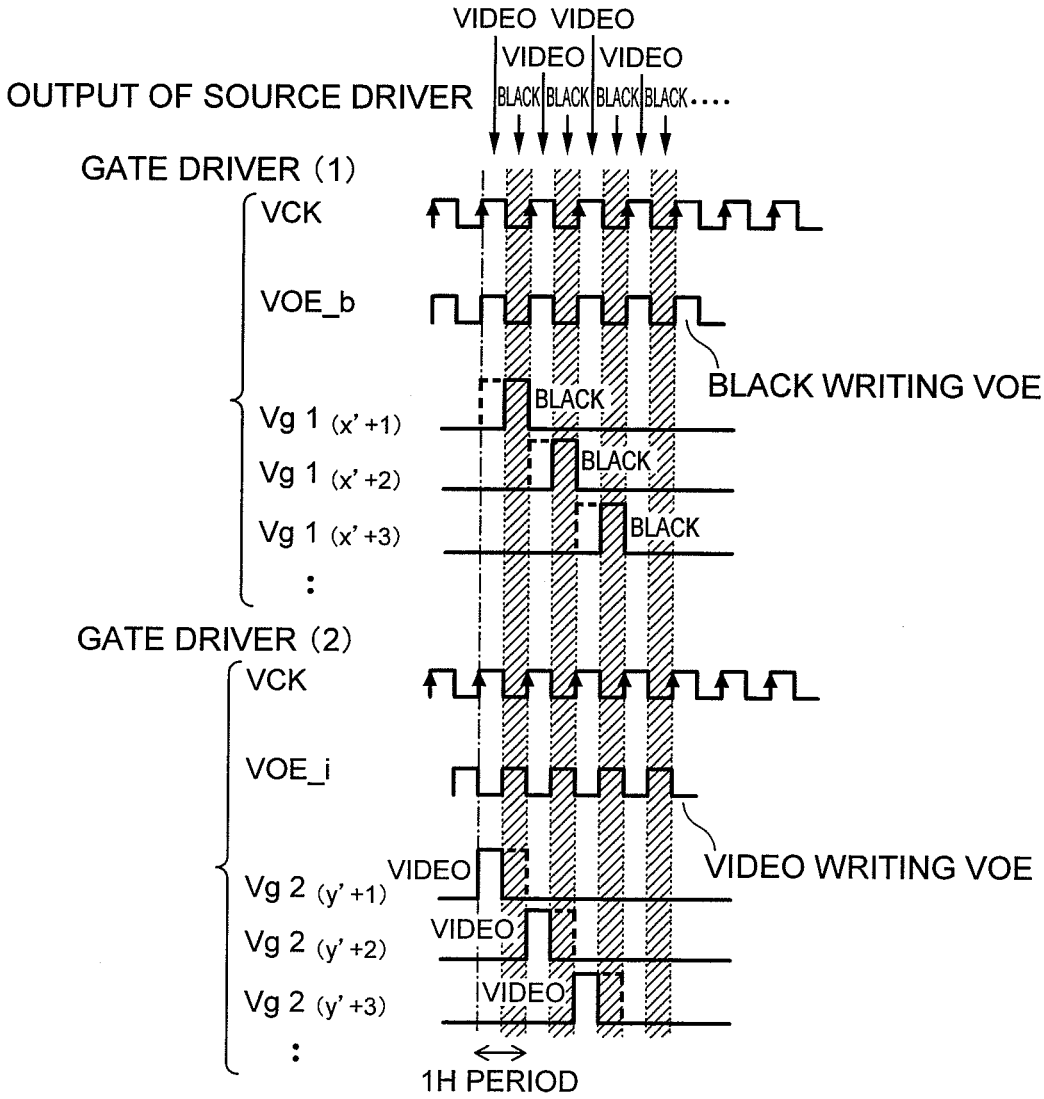
FIG. 21 is an illustration for describing an example of the black insertion drive performed by the liquid crystal display device according to the first exemplary embodiment of the invention, which is a timing chart of a case when writing black to a line of a given gate driver (Y driver) and writing a video signal to a line of another gate driver.

FIG. 20 and FIG. 21 are timing charts of signals propagated in the liquid crystal display device according to this exemplary embodiment.

FIG. 20 is a timing chart of a case where the line image signal is supplied to the pixels on the gate lines V1 to Vi that correspond to the gate driver 14-1, and a black image signal is supplied to the pixels on the gate lines V(i+1) to Vj that correspond to the gate driver 14-2.

Inversely from FIG. 20, FIG. 21 is a timing chart of a case where the black image signal is supplied to the pixels on the gate lines V1 to Vi that correspond to the gate driver 14-1, and a line image signal is supplied to the pixels on the gate lines V(i+1) to Vj that correspond to the gate driver 14-2.

As shown in FIG. 20, VOE_i is inputted to the gate driver 14-1 when the line image signal is supplied to the pixels on the corresponding gate lines V1 to Vi. Thereby, a gate-on signal converted to a video display gate-on signal with the same pulse width as the output period of the line image signal of the source driver 16 is supplied successively from the gate driver 14-1 to the gate lines V1 to Vi.

As shown in FIG. 20, when the video signal is written to one of the lines of the gate driver 1 and black is written to one of the lines of the gate driver 2 in 1H period, the video-writing enable signal (VOE_i) for turning off the gate is inputted to the gate driver in a period where the source driver outputs black. Meanwhile, the black-writing enable signal (VOE_b) for turning off the gate is inputted to the gate driver 2 in a period where the source driver outputs the video.

In the meantime, VOE_b is inputted to the gate driver 14-2 when the black image signal is supplied to the pixels on the corresponding gate lines V(i+1) to Vj. Thereby, a gate-on signal converted to a black display gate-on signal with the same pulse width as the output period of the black image signal of the source driver 16 is supplied successively from the gate driver 14-2 to the gate lines V(i+1) to Vj.

As shown in FIG. 21, when black is written to one of the lines of the gate driver 1 and the video signal is written to one of the lines of the gate driver 2 in 1H period, the black-writing enable signal (VOE_b) for turning off the gate is inputted to the gate driver 1 in a period where the source driver outputs black. Meanwhile, the video-writing enable signal (VOE_i) is inputted to the gate driver 2.

Thereby, it becomes possible with the first exemplary embodiment to write the video signal and the black image signal to different lines in 1H period (one horizontal scanning period).

(Overshoot Drive Processing)

Figure 18:
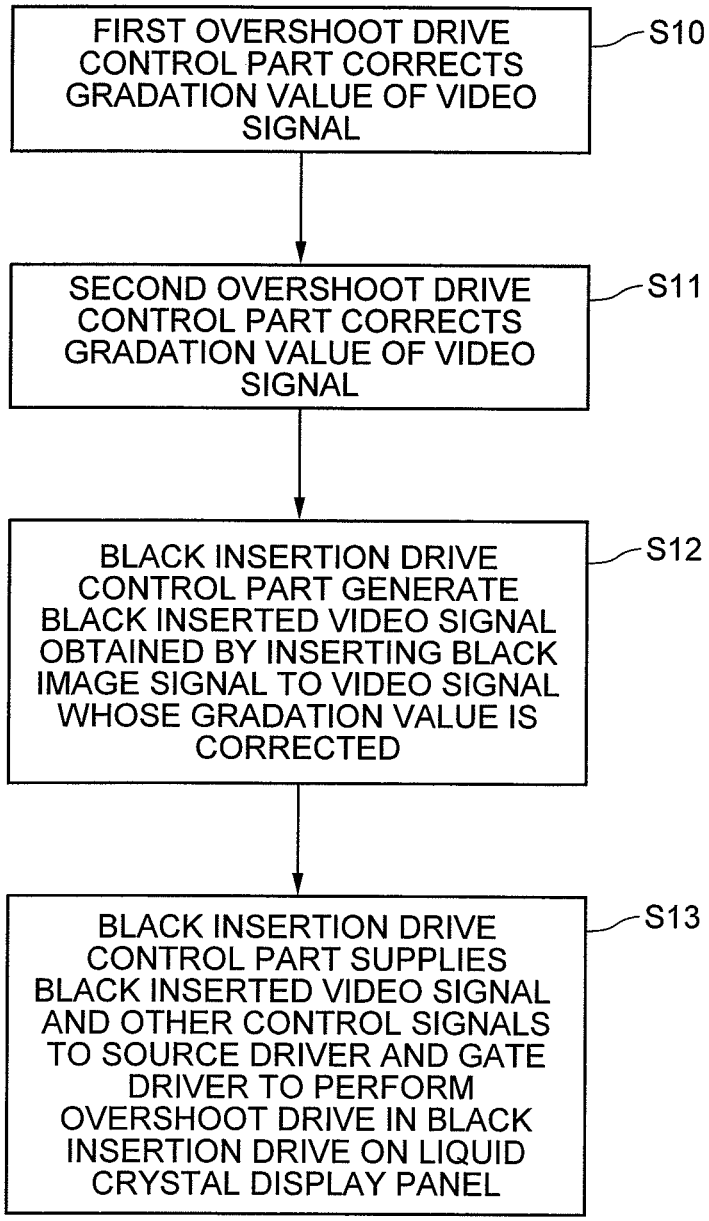
FIG. 18 is a flowchart showing an example of a drive control procedure when performing the overshoot drive in the black insertion drive of the liquid crystal display device according to the first exemplary embodiment of the invention.

Next, the overshoot driver processing executed by the controller will be described. FIG. 18 is a flowchart showing an example of a drive control procedure when performing the overshoot drive in the liquid crystal display device according to this exemplary embodiment. Here, the display device driving method according to the exemplary embodiment will be described at the same time by showing each step.

First, the black insertion rate setting part 22 shown in FIG. 1 judges and sets the black insertion rate for each frame period based on the inputted video signal <monochrome image insertion rate setting step (black insertion rate setting step)>.

Then, as shown in FIG. 18, the controller 20 corrects the gradation value of the video signal by the first overshoot drive control part (step S10) <first gradation correcting step>.

Subsequently, the controller 20 corrects, by the second overshoot drive control part, the gradation value of the video signal that is corrected in the first gradation correcting step (step S11) <second gradation correcting step>.

Then, the controller 20 inserts, by the black insertion drive control part, the black image signal to the video signal whose gradation value is corrected in the second gradation correcting step, and generates the black inserted video signal (step S12) <black inserted video signal generating step>.

Then, the controller 20 supplies the black inserted video signal to the source driver and supplies other control signals to the gate driver by the black insertion drive control part 24 so as to perform the overshoot drive in the black insertion drive when displaying the video on the liquid crystal display panel 10 (step S13)<black inserted video signal supplying step>.

At this time, the third gradation voltage that is higher than the first gradation voltage is applied to the pixels of the liquid crystal display panel 10 by the first overshoot drive, and the fourth gradation voltage that is higher than the third gradation voltage is applied by the second overshoot drive.

That is, the black insertion drive control part 24 generates the black inserted video signal in which the black image signal is inserted between the line image parts of the video signal (inputted video signal) (black inserted signal generating step).

Then, when the black inserted video signal is outputted from the black insertion drive control part 24 to each of the source drivers 16, various kinds of drive control signals are outputted to the gate drivers 14-1 to **14-*i* and each of the source drivers 16** by synchronizing with the output of the black inserted video signal.

(Detailed Processing on Driver Side)

This exemplary embodiment uses a plurality of gate drivers that can enable the outputs of the gates collectively. The gate drivers 14-1 to **14-*i* are controlled by individual output enable signals (VOE_i or VOE_b) from the black insertion drive control part 24**.

At this time, the black inserted video signal is inputted to the source driver 16 from the black insertion drive control part 24. The source driver 16 outputs the video signal and the black image signal alternately to the source lines H1 to Hn based on the inputted black inserted video signal (black inserted video signal supplying step).

As shown in FIG. 22, VSP_i for indicating the start of a frame is inputted to the gate driver 14-1 from the black insertion drive control part 24 along with VOE_i (video start pulse input step), and this VSP_i shifts the gate line V1 to Vi as the gate-on signal by synchronizing with the clock signal (VCK) inputted in the same manner to turn on the TFTs of the pixels 12 on each of the gate lines V1 to Vi. During this, VOE_i is inputted to the gate driver 5A.

Subsequently, when scanning by the gate driver 14-1 ends, VSP_i is shift-inputted to the gate driver 5B, and VOE_i is inputted from the black insertion drive control part 24 to the gate driver 14-2 simultaneously with the input of VSP_i. For the gate driver 14-2, VSP_i as the gate-on signal shifts the corresponding gate lines V(i+1) to Vj. While shifting, VOE_i is also inputted to the to the gate driver 14-2.

Thereafter, similarly, VSP_i is shift-inputted to the gate driver **14-*i*, and VOE_i is inputted from the black insertion drive control part 24 simultaneously. For the gate driver 14-*i*, VSP_i as the gate-on signal also shifts the corresponding gate lines V(l+1) to Vm. While shifting, VOE_i is inputted (video scanning step). Further, VOE_b is inputted to the gate drivers 14-1 to 14-*i*** in other periods.

Furthermore, according to the timing determined by the black insertion rate setting part 22, VSP_b is inputted from the black insertion drive control part 24 to the gate driver 14-1 once in a frame period (black display start pulse input step). VSP_b as the gate-on signal shifts the corresponding gate lines V1 to Vi with the clock signal (VCK) of the gate driver 14-1 to turn on the TFTs of the pixels on each of the gate lines V1 to Vi. During the period of such black image display scanning, VOE_b is inputted to the gate driver 14-1.

When black image display scanning by the gate driver 14-1 ends, VSP_i is shift-inputted to the gate driver 14-2, and VSP_b as the gate-on signal shifts the corresponding gate lines V(i+1) to Vj. While shifting, VOE_b is inputted also to the gate driver 14-2. Thereafter, VSP_b is shift-inputted to the gate driver 14-2, and the black image display scanning is started with the gate driver **14-*i*** <black scanning step>.

As described, the first exemplary embodiment inputs the video display scanning start pulse (VSP_i) of the first gate driver for writing the video signal at least once, and inputs the black display scanning start pulse (VSP_b) of the first gate driver for writing the black signal at least once to the gate driver 14-1 in one frame period.

With such configuration, it is possible to achieve the black insertion drive with which a black band scrolls on the screen in one frame, as shown in FIG. 23B. The width of the black band is determined according to the input timing of the black display scanning start pulse (VSP_b) with respect to the input of the video display scanning start pulse (VSP_i).

Further, as shown in FIG. 19, when the black insertion drive control part continuously writes the black signal (monochrome image signal) also in the blanking period between each of the frames, the hold time of the video signals and the hold time of the black image signals on the entire pixels of the screen can be made uniform. Thus, it is also possible to cancel the luminance difference on the plane caused due to the difference in the hold time of the signals.

Figure 24:
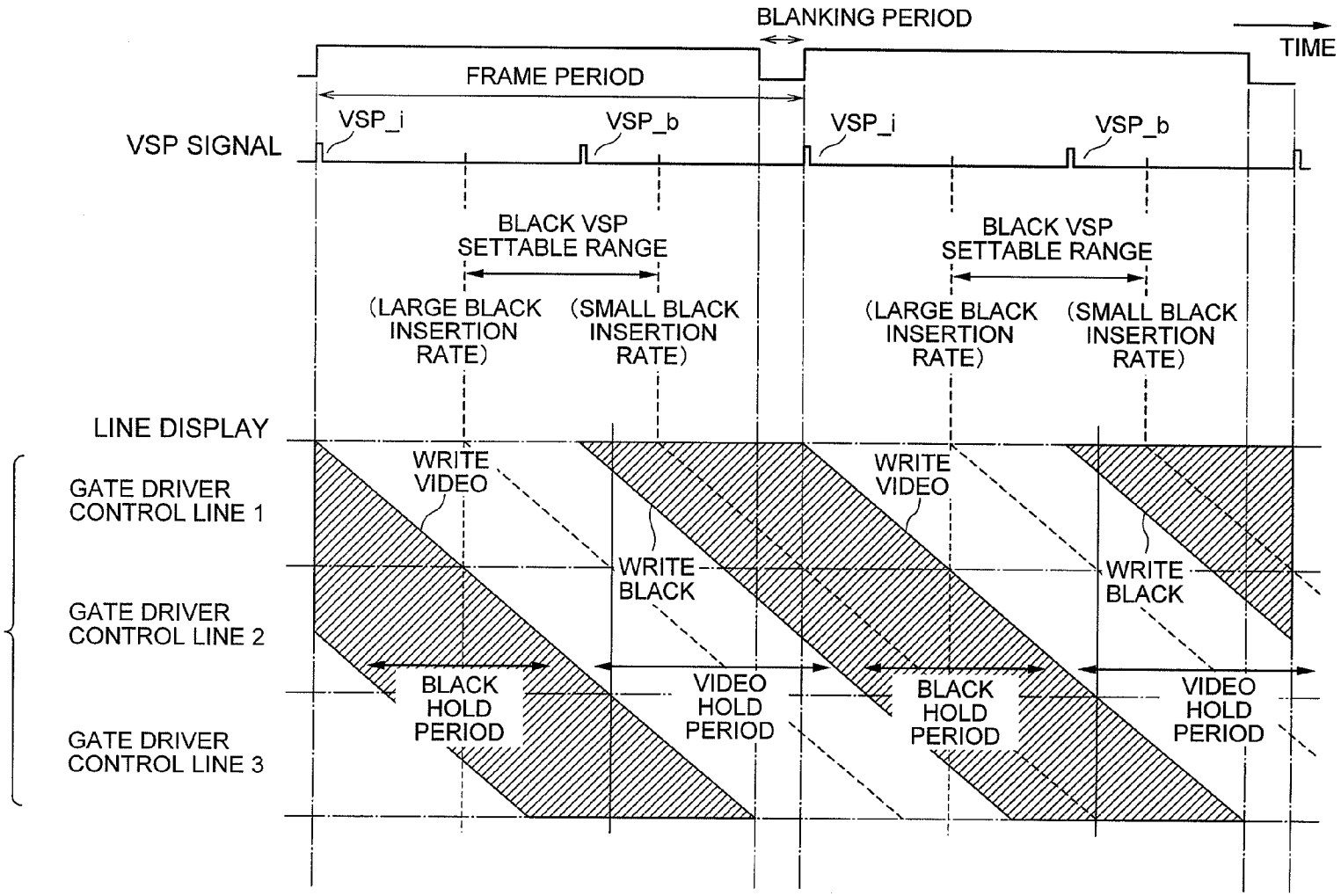
FIG. 24 is an illustration for describing an example of a black VSP settable area in the black insertion drive performed in the liquid crystal display device according to the first exemplary embodiment of the invention.

Note here that VSP_b can be inputted at an arbitrary timing, as long as it is the timing at which the video and the black lines are not selected by a single driver simultaneously, such as a timing within a black VSP settable range shown in FIG. 24. There is no restriction regarding the timing, such as a break of the driver, or the like. Therefore, the black insertion rate can be adjusted delicately, so that it is possible to set the optimum black insertion rate in accordance with the use environments by considering a balance between the effect of improving the dynamic image blur as an advantage of black insertion and deterioration of the luminance as a disadvantage.

Further, it is possible with the first exemplary embodiment to apply the optimum black insertion drive to display panels in any kinds of liquid crystal drive mode, such as a TN panel, an IPS panel, a VA panel, and an OCB panel.

Subsequently, when the black insertion drive control part 24 controls POL, the video signal is frame-inverted starting from the input of VSP_i (video signal polarity inverting step). Independently from that, the black signal is frame-inverted starting from the input of VSP_b (black image signal polarity inverting step).

With this structure, reversal of the inversion order in the vicinity of the center of the screen can be prevented. This makes it possible to cancel burn-in and the display luminance difference at the switching lines of the polarity inversion generated due to variation in field-through within a plane of the display panel and variation in the positive/negative of the applied voltages. Further, this structure can be achieved by simply providing a black signal inversion counter individually to the black insertion drive control part 24. Therefore, it becomes possible to correspond flexibly to switching of the black insertion rate without increasing the cost.

Further, this exemplary embodiment inserts the black image display between each of the video frames to lighten the dynamic image blur of the display device. However, it is not limited to inserting the black display. A medium tone display such as gray may be inserted as well. In that case, deterioration of the luminance can also be suppressed, in addition to improving the dynamic image blur. However, there is deterioration caused in a chromatic area and contrast, so that it is necessary to be in a structure that sets an optimum halftone by taking that into consideration.

In this exemplary embodiment, the black insertion rate setting part 22 judges the black insertion rate for each frame period by referring to the inputted video signal, and sets the timing for inputting VSP_b to the gate driver 14-1 by corresponding to the judged black insertion rate. However, it is not limited only to such case. The black insertion rate setting part 22 may set the timing for inputting VSP_b to the gate driver 14-1 according to timing data that is inputted from outside by an operation or the like of a user.

(Effects)

As described above, before inserting the monochrome image signal in the monochrome image insertion drive, the gradation value of the video signal is corrected by the first correction device. When the gradation value of the video signal changes by each unit frame cycle period, the gradation value of the video signal or the gradation value of the monochrome image display signal is corrected by the second correction device. The monochrome image insertion drive is performed thereafter. Thus, it is possible to prevent generation of step-like tailing in video display and generation of ghost in scroll display of letters.

Further, the first overshoot drive control part has following effects. That is, when the black insertion drive is applied to a panel of relatively slow response speed, as shown in FIG. 6-FIG. 8, the panel writing frequency becomes doubled and the hold time of the liquid crystal is decreased, since the black insertion drive is the drive which provides black display between the video displays. Therefore, as shown in FIG. 7, the video display does not reach the target and the luminance is deteriorated largely in the panel of slow response speed. However, it is possible with the first overshoot drive executed by the first overshoot part to correct the gradation of the video display after the black display to speed up the response of the video display so as to improve the luminance, as shown in FIG. 8.

Further, the second overshoot drive control part compares the previous video information with the current video information, and performs the second overshoot drive based on the set value of the LUT2 that is set in advance according to the black insertion rate set by the black insertion rate setting part.

Such second overshoot drive control part has following effects. That is, as shown in FIG. 12, if blackening of black display is not completed with the panel whose response speed is relatively slow, display becomes accumulatively changed due to a difference between that blackening and blackening of black display after the previous video display by simply executing the first overshoot drive. This causes step-like tailing and ghost in letter scroll. Therefore, this exemplary embodiment performs the second overshoot drive to correct, in the video display of the current frame, the accumulative luminance reaching delay caused due to the difference between the blackening of the black display after the video display of the previous frame and the blackening of the black display after the video display of the current frame, based on the video signal of the previous frame to the video signal of the current frame.

Further, step-like tailing and ghost in letter scroll occur not only by the accumulative luminance changes of the video display but also by the difference in the blackening of black displays. Therefore, as shown in FIG. 14, when the second overshoot drive is performed to the level with which the video signal reaches the target luminance, the step-like tailing and ghost in letter scroll occur still occur due to the differences between the falls of black, even though the step-like tailing and ghost in letter scroll caused due to the accumulative luminance changes in the video display can be lightened.

Thus, as shown in FIG. 15, it is preferable for the second overshoot drive to perform correction in such a manner that the video display shifts the luminance that exceeds the target luminance so as to further lighten the step-like tailing and ghost in letter scroll that still occur due to the differences between the blackening of black displays.

As described above, in this exemplary embodiment, the first overshoot drive converts the gradation of the video signal to the value that corresponds to the voltage to be more deviated from the voltage value of the black display than the case where the black insertion drive is not performed. The second overshoot drive converts the gradation of the video signal of the current frame so as to apply a voltage that emphasizes the change amount between the frames, when there is a change in the video signal of the previous frame and the video signal of the current frame. The signal having the black signal line inserted between the lines of the converted video signal is inputted from the timing controller to each source driver.

With this, as shown in FIG. 3, the voltage of the video signal converted by the first overshoot drive to be more deviated from the voltage value of the black display than the case without the black insertion drive is written to the panel from each gate driver and each source driver according to the above-described signals. As shown in FIG. 5, when there is a change in the video signal of the previous frame and the video signal of the current frame, the voltage of the video signal of the current frame converted by the second overshoot drive to the voltage that emphasizes the change amount between the frames is written to the panel. The voltage of the black signal lines is inputted between the voltages of the lines of the converted video signals.

This makes it possible to improve the issues raised when performing black display on a relatively slow panel, such as deterioration of the luminance, step-like tailing, and ghost generated in letter scroll.

As described, by utilizing the fact that the black signals of the black insertion drive are in prescribed gradation on a whole area of the screen, this exemplary embodiment is structured to apply the overshoot on the video signals before executing high-speed drive by inserting black. Thus, the processing speed of the frame memory required for the overshoot drive is not doubled.

Therefore, this exemplary embodiment makes it possible to employ the overshoot drive for the black insertion drive without increasing the circuit scale, e.g., without increasing the number of memories.

The black insertion drive according to the first exemplary embodiment includes the first overshoot drive which corrects the response delay from the black display to the video display based on the video information of the current frame. With this, necessary gradation voltage can be obtained, so that deterioration of the luminance, which is an issue brought up when performing black insertion to the panel of relatively slow response speed, can be suppressed.

Furthermore, the black insertion drive according to the first exemplary embodiment includes the second overshoot drive which corrects, in the video display of the current frame, the accumulative luminance reaching delay caused due to the difference between the blackening of the black display after the video display of the previous frame and the blackening of the black display after the video display of the current frame, based on the video signal of the previous frame to the video signal of the current frame. This exemplary embodiment is structured to apply the overshoot on the video signals before executing high-speed drive by inserting black. Thus, the processing speed of the frame memory required for the overshoot drive is not doubled.

Furthermore, it is possible to employ the overshoot drive for the black insertion drive without increasing the circuit scale, e.g., without increasing the number of memories. This makes it possible to increase the implementability of the overshoot to the black insertion drive, and to improve the issues raised when performing black display on a relatively slow panel, such as step-like tailing caused due to insufficient blackening of the black displays and ghost generated in letter scroll.

With the black insertion drive capable of changing the black insertion rate, the video signal and the black signal are switched by every 1H period, and the pixels with the black signal on the display screen change depending on the black insertion rate. Therefore, it is difficult to apply the overshoot. However, the exemplary embodiment is structured to apply the overshoot to the video signal before the high-speed drive executed by the black insertion. Therefore, the overshoot drive can be applied with a simple logic, so that the implementability of the black insertion drive can be increased.

Further, this exemplary embodiment is structured to utilize the fact that the black signals of the black insertion drive are in prescribed gradation on a whole area of the screen, and to save the video signal before doubling the speed by the black insertion to the frame memory. Thus, it is possible to be achieved without increasing the circuit scale, unlike the case of the related technique.

Furthermore, this exemplary embodiment is structured to utilize the fact that the black signals of the black insertion drive are in prescribed gradation on a whole area of the screen, and to apply the overshoot on the video signals before executing high-speed drive by inserting black. Thus, the processing speed of the frame memory required for the overshoot drive is not doubled. Therefore, this exemplary embodiment makes it possible to employ the overshoot drive for the black insertion drive without increasing the circuit scale, e.g., without increasing the number of memories.

Further, this exemplary embodiment is structured to include the first overshoot drive which corrects the response delay from the black display to the video display based on the video information of the current frame, and to have necessary gradation voltage. Thus, deterioration of the luminance, which is an issue brought up when performing black insertion to the panel of relatively slow response speed, can be suppressed. Furthermore, this exemplary embodiment is structured to include the second overshoot drive which corrects, in the video display of the current frame, the accumulative luminance reaching delay caused due to the difference between the blackening of the black displays after the video display of the previous frame and the blackening of the black display after the video display of the current frame, based on the video signal of the previous frame to the video signal of the current frame. This makes it possible to improve the issues raised when performing black display on a panel whose response speed is relatively slow, such as accumulative luminance reaching delay caused due to the difference between the blackening of the black displays, by correcting the video display. It is also possible to improve step-like tailing, and ghost generated in letter scroll.

Further, the overshoot drive can be applied not only to the black frame insertion drive with which black and video are alternately repeated by each sub-frame, but also to the black insertion drive capable of changing the black insertion rate by a simple logic. This makes it possible to improve deterioration of the luminance, step-like tailing, and ghost generated in letter scroll even with a panel of relatively slow response speed.

Further, it is possible with the related technique to decrease the frame memory frequency and to change the black insertion rate by not performing overshoot of a prescribed gradation. However, ghost-like tailing still occurs in the dynamic image display due to unreached luminance of black display. Furthermore, the ghost-like tailing cannot be overcome even if the mean values of the luminance of the frame periods during the display change and after the display change are made almost equivalent.

This is because the dynamic image tailing generated in the hold-type display device is caused due to the eye movements of human beings that follow the dynamic image, and the difference between the timing of the change in the transmittance of black display of the previous frame and the timing of the change in the transmittance of the current frame of the pseudo-impulse type drive is perceived by the eyes of the human beings as changes to different position.

With this exemplary embodiment, however, it is possible to lighten the ghost-like tailing by excessively emphasizing the transmittance of the video display indirectly in such a manner that the time integrated value of the transmission amount of the liquid crystal in the frame period during the display change becomes larger than the time integrated value after the display change. Further, it is also possible to lighten the ghost-like tailing by setting the luminance mean value of the "video display period" during the display change to be the luminance mean value of one frame period (video+black display period) after the display change.

This makes it possible to improve the shortcomings of the dynamic image display even with the liquid crystal display panel of relatively slow response speed, with the structure that is capable of reducing the frame memory frequency and changing the black insertion rate.

With the black insertion drive capable of changing the black insertion rate arbitrarily, the gradation value for overshoot is corrected in advance at a stage prior to performing double-speed drive. With this, the black insertion rate can be changed while decreasing the frame memory frequency.

Further, this exemplary embodiment includes an overshoot power supply which can apply the voltage to be applied to the liquid crystal display panel in a value more than a normal voltage for each gradation of the video display. With this, the white luminance can be improved in normally white, and the black luminance can be decreased in normally black.

Without additionally providing the gradation power supply, it is possible to expand the setting of the voltages to exceed the transmittance peak voltage of the liquid crystal display panel, for example, by having all the display gradation voltages set exclusively for the overshoot, since the displays that are not overshoot-driven are only black displays.

Further, the black insertion rate can be changed by changing the timing of inputting VSP-b to the gate driver 14-1. Furthermore, it is possible to perform normal drive without black image insertion, if VSP_b is not inputted. Therefore, the black image insertion rate can be switched easily. As a result, it becomes possible to provide displays in accordance with the use conditions of the user, e.g., to provide a bright screen with less flicker without performing black insertion, and to provide a screen with less dynamic image blur when used for dynamic image displays such as TV screens.

Furthermore, it is possible to consecutively switch the black image insertion rate depending on scenes of the video, e.g., from a static screen such as a scenery to a screen with active movements such as a sports scene.

Moreover, in this exemplary embodiment, writing polarities of the video signal and the black signal are inverted in a frame cycle starting from each of the individual timings. This makes it possible to cancel burn-in and the display luminance difference at the switching lines of the polarity inversion generated due to variation in field-through within a plane of the display panel and variation in the positive/negative of the applied voltages.

In the hold-type display device, it is possible to lighten the dynamic image blur perceived due to overlapped image of the current frame and an afterimage of the previous frame to improve the quality of the dynamic image by inserting the black image in one frame, and to variably set the black insertion rate for one frame depending on the individual use conditions. That is, the black insertion rate can be adjusted delicately, so that in the hold-type display device, it is possible to set the black insertion rate for one frame period delicately by considering a balance between the effect of improving the dynamic image blur and deterioration of the luminance as a disadvantage. Thus, the quality of the dynamic image can be improved.

Further, when the overshoot drive is applied to the driving frequency that is doubled by the black insertion as in the case of the related technique, the access frequency with the frame memory becomes doubled. Thus, for achieving this, the circuit scale is increased (such as increasing the number of memories) in order to increase the data accessed with one clock.

With the liquid crystal display device of this exemplary embodiment, however, it is structured to utilize the fact that the black signals of the black insertion drive are in prescribed gradation on a whole area of the screen, and to save only the video signal before doubling the speed by the black insertion to the frame memory so as to perform overshoot drive in the black insertion drive based on that information. Thus, it is possible to prevent an increase in the access frequency of the frame memory.

Note here that a part of each of the blocks (for example, reference numerals 22, 24, 26, 32, 34, 44, 48) in the block diagram shown in FIG. 1 may be structured as software modules that represents the states functionalized by programs when a computer executes various programs stored in a proper memory. That is, even though the physical structure is a single or a plurality of CPU(s) (or a single or a plurality of CPU(s) and a single or a plurality of memory(s)) or the like, the software structure by each part (circuits, devices) is a form in which a plurality of functions implemented by the CPU with controls of the programs are expressed as feature elements of each of the plurality of parts (devices). When the dynamic state (each procedure configuring the program is being executed) where the CPU is executed by the program is expressed functionally, it can be expressed that each part (device) is built within the CPU. In a static state where the program is not being executed, the entire program (or each program part included in the structure of each device) for achieving the structure of each device is stored in a storage area of the memory or the like. Explanations of each part (device) provided above can be taken as the explanations of the computer that is functionalized by the program together with the functions of the program, or can be taken as a device that is configured with a plurality of electronic circuit blocks functionalized permanently by proper hardware. Therefore, those functional blocks can be achieved in various forms, e.g., only with hardware, only with software, or a combination of both, and it is not to be limited to any one of those forms.

For each part of the above-described controller 20, the functional contents thereof may be put into a program to be executed by the computer.

As an exemplary advantage according to the invention, before inserting the monochrome image signal in the monochrome image insertion drive, the gradation value of the video signal is corrected by the first correction device. When the gradation value of the video signal changes by each unit frame cycle period, the gradation value of the video signal or the gradation value of the monochrome image display signal is corrected by the second correction device. The monochrome image insertion drive is performed thereafter. Thus, it is possible to prevent generation of step-like tailing in video display and generation of ghost in scroll display of letters.

Second Exemplary Embodiment

Figure 25:
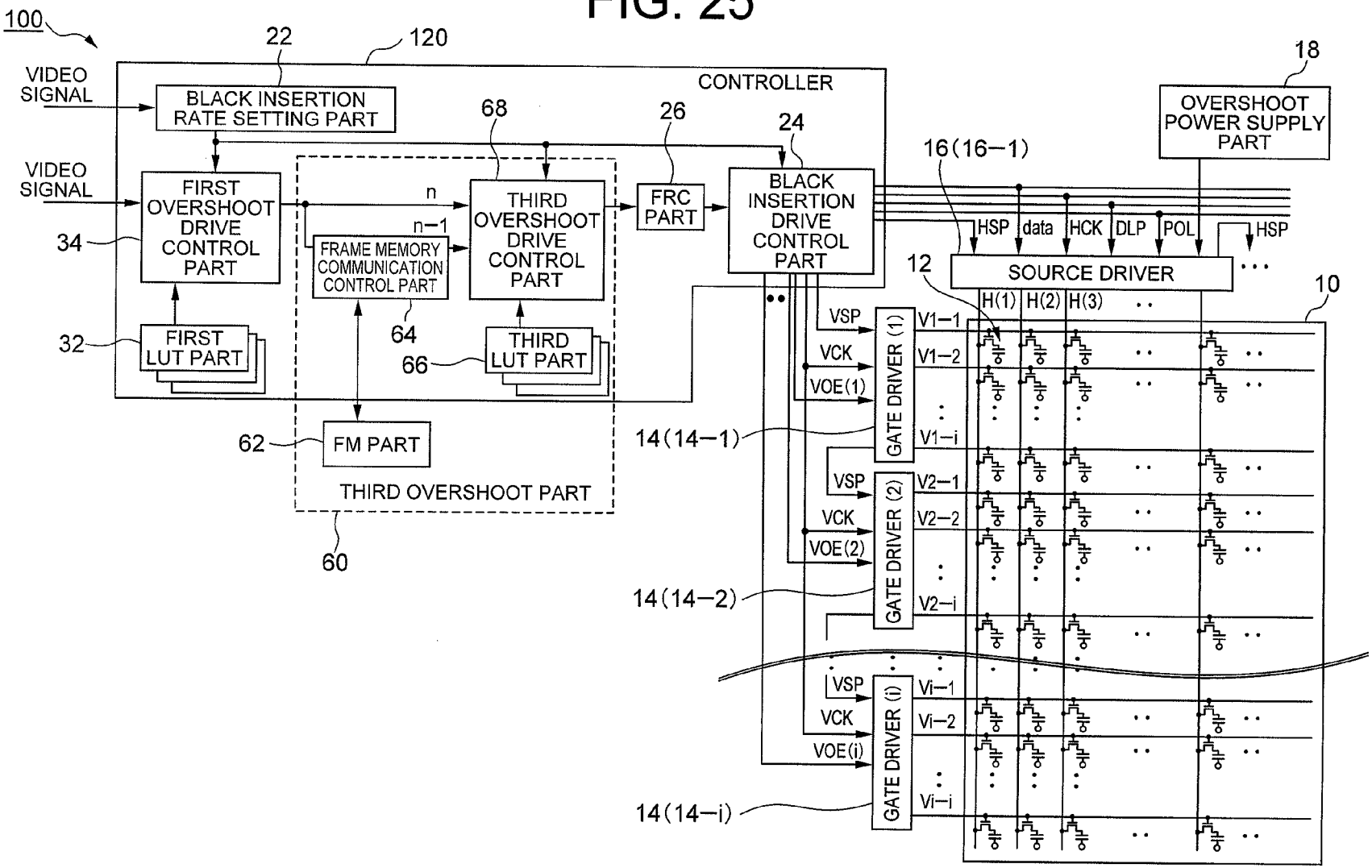
FIG. 25 is a block diagram showing an example of a schematic structure of a liquid crystal display device according to a second exemplary embodiment of the invention.

Next, a second exemplary embodiment of the invention will be described by referring to FIG. 25-FIG. 32. Hereinafter, explanations regarding structures and the processing orders which are substantially the same as those of the first exemplary embodiment are omitted, and only the different points are described. FIG. 25 is a block diagram showing an example of the second exemplary embodiment in which the display panel control device according to the present invention is applied to a liquid crystal display device. In FIG. 25, same reference numerals are applied to the structures that are same as those of the first exemplary embodiment shown in FIG. 1.

With the first exemplary embodiment above, the accumulative luminance reaching delay is corrected by correcting the gradation value of the video display by executing the second overshoot drive. However, the second exemplary embodiment is structured to correct the accumulative luminance reaching delay by correcting the gradation value of the monochrome display by executing a third overshoot drive.

Specifically, a liquid crystal display device 100 according to this exemplary embodiment is capable of performing the first and the third overshoot drives in the black insertion drive. As shown in FIG. 25, the liquid crystal display device 100 is structured to include a liquid crystal display panel 10, gate drivers 14 (14-1 to **14-*i*) for driving pixels 12 of the liquid crystal display panel 10, source drivers 16 (16-1, - - - ), an overshoot power supply part 18 used for overshoot drive, a controller 120 for controlling the gate drivers 14 and the source drivers 16, and an FM (frame memory) part 62** for temporarily storing video information of video signals.

An example of cases to which the driving method of this exemplary embodiment can be suitably applied may be a case where the liquid crystal display panel 10 is structured as a normally-black panel such as an ISP, and halftone insertion drive is performed instead of black insertion drive. As another example, there is a case where the liquid crystal display panel 10 is structured as a normally-white panel such as TN or VA, and overshoot drive is performed on the black display.

The controller 120 has a function as a timing controller. As shown in FIG. 25, it is structured to include: a black insertion rate setting part 22; a first overshoot drive control part 34; a first LUT (lookup table) part 32 utilized for controlling the first overshoot drive; a frame memory communication control part 64; a third LUT part 66 utilized for controlling the third overshoot drive; a third overshoot drive control part 68; an FRC (frame rate control) part 26 for performing frame modulation control; and a black insertion drive control part 24 for performing black insertion drive control by inserting a black signal to the video signal.

An FM (frame memory) part 62, the frame memory communication control part 64, the third LUT part 66, and the third overshoot drive control part 68 together may also be referred to as a third overshoot part 60.

The black insertion rate setting part 22 has functions of: temporarily storing information for one frame of the video signals inputted successively for each frame; comparing the video signal of one frame out of the video signals and the video signal with the video signal of the frame one before that is stored temporarily; and setting the black image insertion rate based on the changed data number. The black insertion drive control part 24 has a function of generating various signals based on the setting set by the black insertion rate setting part 22.

More specifically, the black insertion rate setting part 22 compares current frame data "data (n)" with the previous frame data "data (n−1)", and counts the changed data for one frame. It is also possible to have a function of judging whether it is a static image or a dynamic image through leveling the counted information by obtaining running average of several frames, for example, and judging the threshold value.

The video signals are inputted to the first overshoot drive control part 34. The first overshoot drive control part 34 corrects the gradation value of the inputted video signal based on the set value of the first LUT part 32 set in advance according to the black insertion rate that is determined by the black insertion rate setting part 22, and supplies the video signal (first corrected video signal) to the third overshoot drive part 68.

The first overshoot drive control part 34 corrects the response delay from the black display (or prescribed gradation display) to the video display based on the current frame video information. The first overshoot drive control part 34 makes it possible to input, to the liquid crystal display panel 10, the voltage value of the video signal that is corrected to be more deviated from the voltage of the black display, compared to the case where the black insertion display is not performed. The first overshoot drive control part 34 can be considered as the first gradation correcting device.

In the third overshoot part 60, the first corrected video signal is stored temporarily in the FM (frame memory) part 62 via the frame memory communication control part 44, and the video signal (first corrected video signal) of the previous frame (n−1) stored temporarily to the FM part 62 and the video signal (first corrected video signal) of the current frame (n) from the first overshoot drive control part 34 are supplied to the third overshoot drive control part 68.

Figure 28:
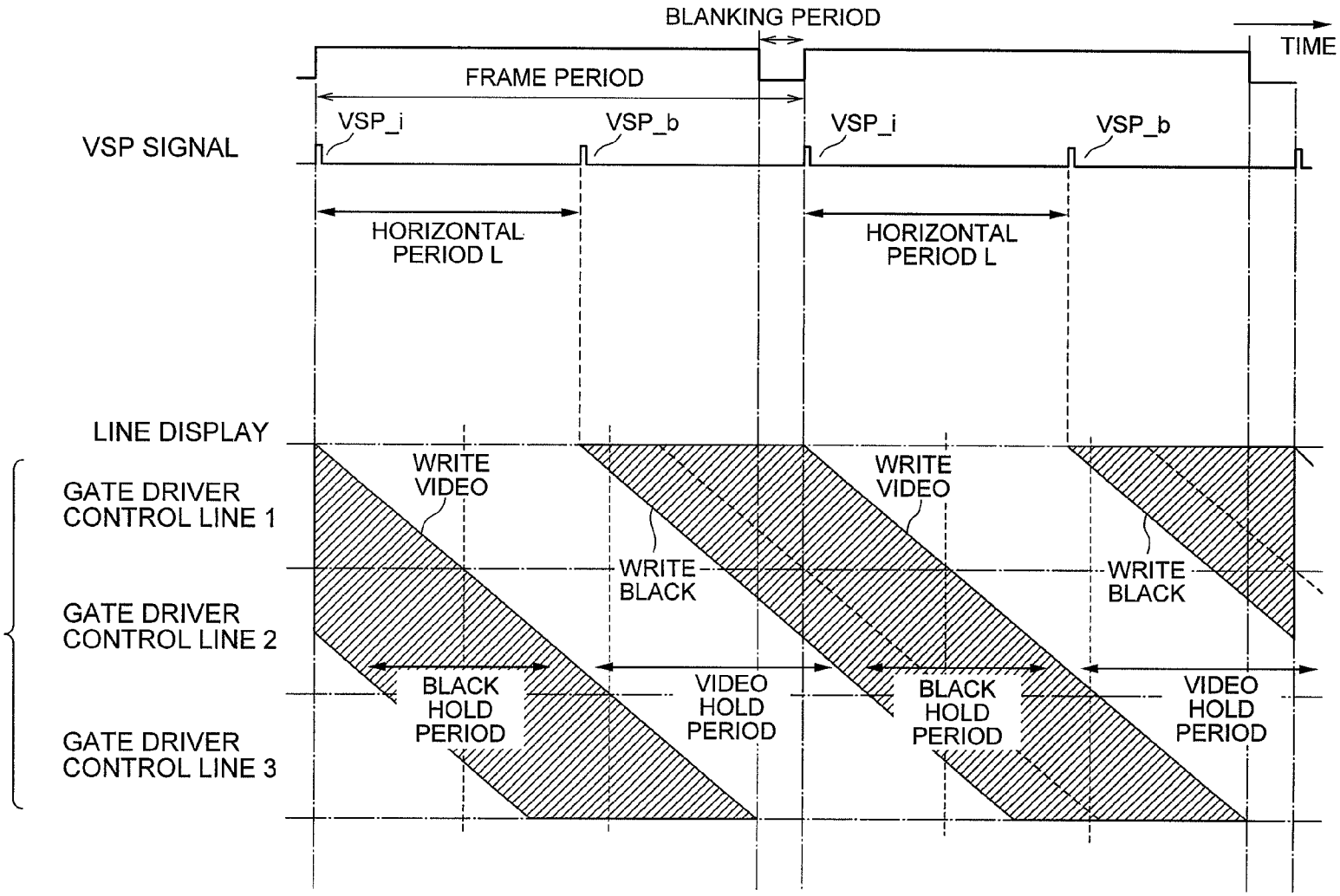
FIG. 28 shows illustrations for describing an example of third overshoot drive in the black insertion drive of the liquid crystal display device according to the second exemplary embodiment of the invention.
Figure 29:
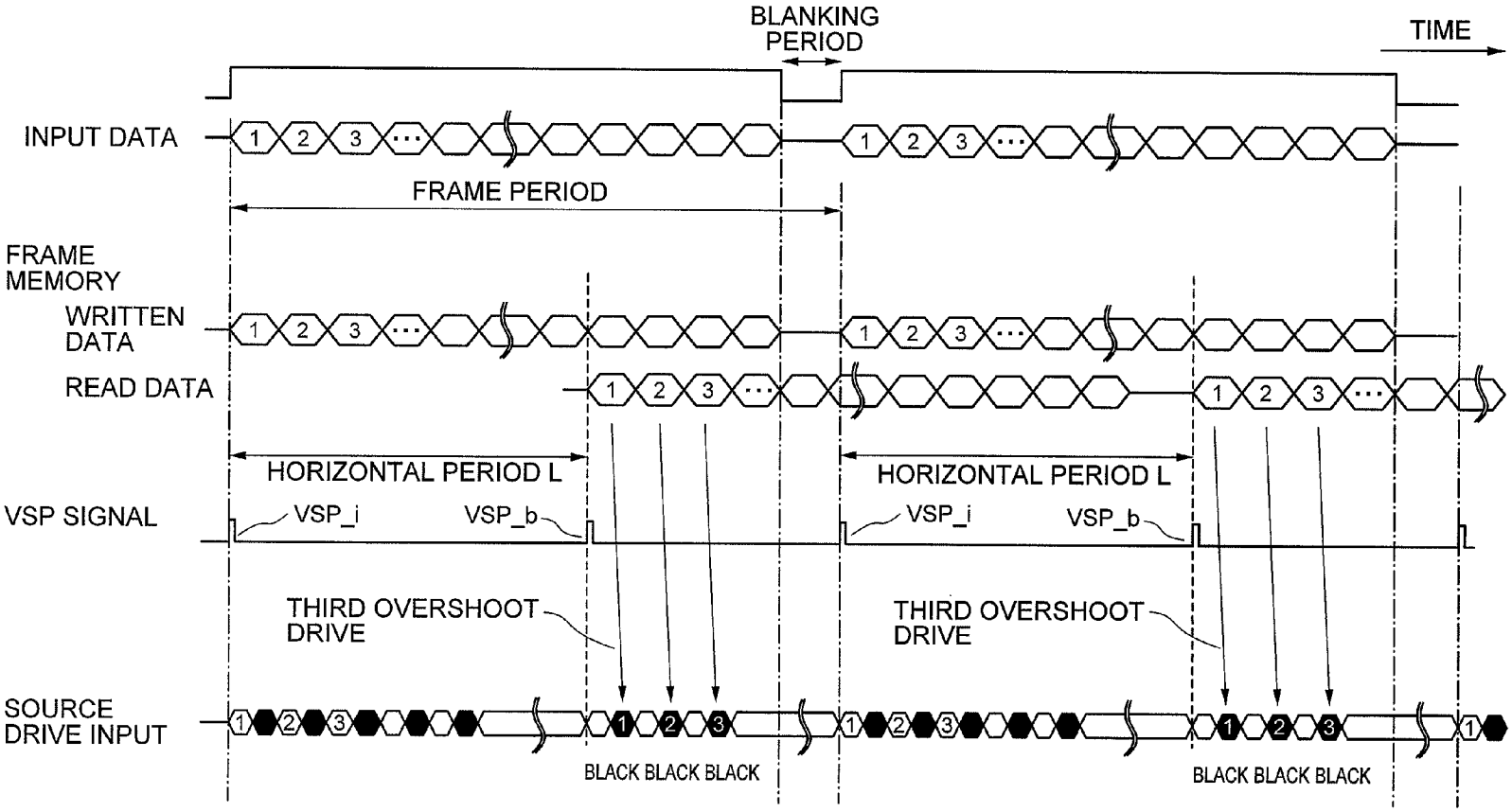
FIG. 29 is a timing chart for describing an example of the third overshoot drive in the black insertion drive of the liquid crystal display device according to the second exemplary embodiment of the invention.

As shown in FIG. 28 and FIG. 29, the third overshoot part 60 transmits, to the third overshoot drive control part 68, the video signal (video signal of the previous frame (n−1)) that is the signal of before the time (L horizontal period) for outputting the black start pulse (VSP_b) after outputting the video start pulse (VSP_i) that is determined by the black insertion rate.

The third overshoot drive control part 68 refers to the set value of the third LUT part 66 that corresponds to the black insertion rate set by the black insertion rate setting part 22 based on the video information previous L horizontal period, i.e., the video information (video information (gradation value) of the video signal of the previous frame (n−1)) that is written to the corresponding pixel in previous writing, corrects the black signal to the gradation voltage for the third overshoot drive, and supplies it to the FRC part 26 as a third corrected video signal.

The third overshoot drive control part 68 corrects the darkening from the video signal of the previous frame (n−1) to a prescribed gradation display by correcting the gradation value of the monochrome display signal after the video signal of the previous frame (n−1) based on the video signal of the previous frame (n−1). It is possible with the third overshoot drive control part 68 to input, to the liquid crystal display panel 10, the black signal with a voltage value that is corrected to be more deviated from the voltage of white display compared to the case where no black insertion drive is performed.

In this manner, each of the first and the third overshoot drive control parts 34 and 68 determines the correction amount at the time of the black insertion drive based on the inputted video signal.

The third LUT part 66 determines the correction value of the gradation value that is corrected by the third overshoot drive control part 68, and it includes a plurality of LUTs. In the LUT of the third LUT part 66, the overshoot correction values corresponding to inputted video signals of the previous (n−1) frame and the video information of the current frame are determined by measurements conducted in advance. FIG. 26 and FIG. 27 show examples of the LUT of the third LUT part 66. The LUT shown in FIG. 26 is a case where the halftone of 16-gradation is inserted as the black signal, for example. When the inputted video signal is of the previous frame (n−1) is 249-gradation, the black signal when inserting black is converted to the signal of 1-gradation.

Further, the third LUT part 66 is structured to include a plurality of kinds of LUTs for corresponding to the black insertion rates. The third LUT part 66 may be structured to be capable of switching as necessary to the LUT that corresponds to the changed black insertion rate, when the black insertion rate is changed by the black insertion rate setting part 22. With this, when the black insertion rate is changed by the black insertion rate setting part 22, the third overshoot drive control part 68 can appropriately select the LUT that corresponds to the black insertion rate.

Further, when the resolution of the gradation becomes insufficient because of the overshoot, it is preferable to perform multi-gradation processing by a multi-gradation display method executed by the FRC part 26 or the like. The LUT of FIG. 27 as an example of the LUT of the third LUT part 66 is an example of the LUT that is utilized when the resolution is increased to 10 bits by the FRC part 26.

The FRC part 26 is a multi-gradation device which generates a specific gradation (intermediate gradation) in a pseudo manner by time average through providing displays of different gradations for each frame by performing frame modulation control. By changing on/off of each dot, the dots that are visually overlapped with each other are integrated to express a halftone. This FRC part 26 can also be considered as the multi-gradation processing device.

Note here that it is possible to employ a structure having no FRC part 26, even though the exemplary embodiment has the FRC part 26. In that case, the third corrected video signal from the third overshoot drive control part 68 is directly inputted to the black insertion drive control part 24.

The black insertion drive control part 24 inserts the black signal between lines of the video signal (second corrected video signal), and inputs it to each source driver.

Further, the black insertion drive control part 24 generates the control signals of the drivers and inputs those to each of the gate drivers 14 and each of the source drivers 16 along with the video signals to which the black signals are inserted at a timing according to the black insertion rate set by the black insertion rate setting part 22. Each of the gate drivers 14 and each of the source drivers 16 write the voltages set by the gradation power supply 18 to the liquid crystal display panel 10 according to the inputted control signals.

The black insertion drive control part 24 performs high-speed drive by inserting a specific gradation display (for example, black) to the video signal (third corrected video signal) from the third overshoot drive control part 68 in a specific proportion.

Further, it is possible with the liquid crystal display device 1 of this exemplary embodiment to reduce the gradation change that cannot be overshoot-driven, by using the gradation power supply part 18 used for overshoot drive that can apply more voltage than the voltage applied normally to the pixels 12 of the liquid crystal display panel 10.

Figure 30:
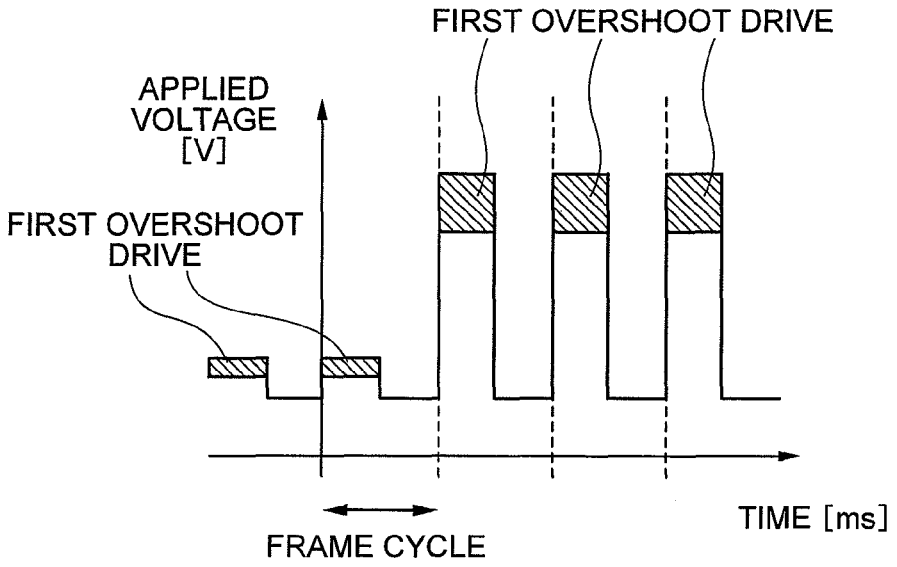
FIG. 30 shows illustrations for describing an example of first overshoot drive in the black insertion drive of the liquid crystal display device according to the second exemplary embodiment of the invention.
Figure 30:
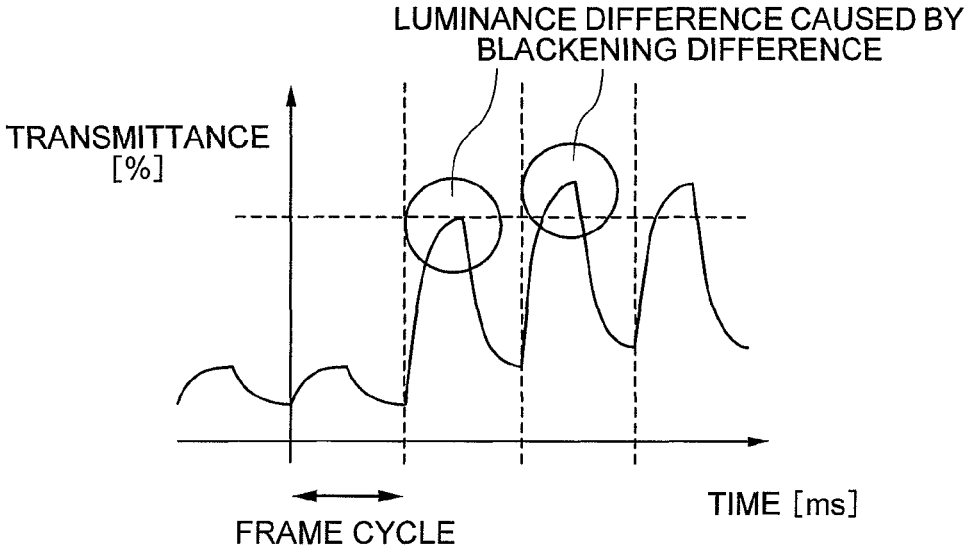
Figure 30:
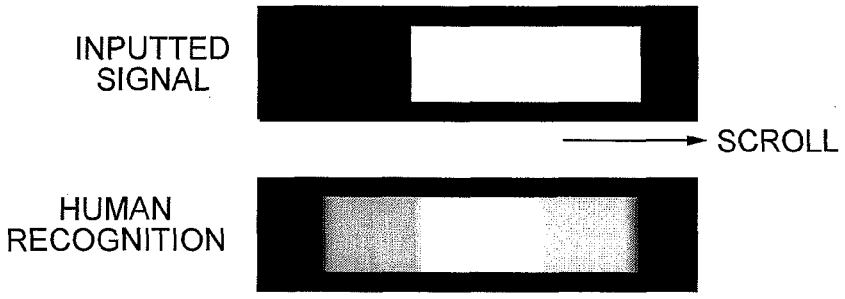
Figure 31:
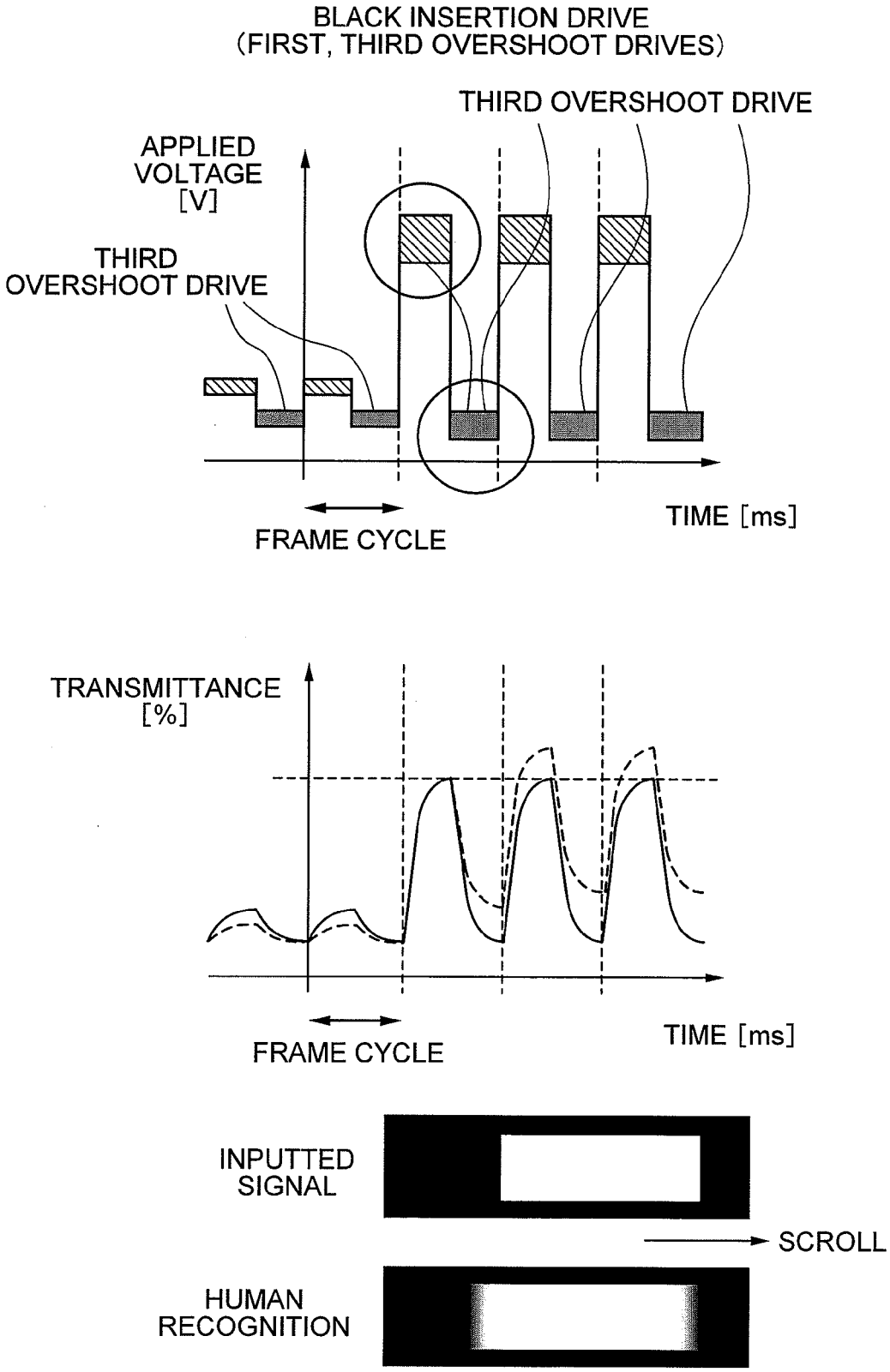
FIG. 31 shows illustrations for describing an example of the third overshoot drive in the black insertion drive of the liquid crystal display device according to the second exemplary embodiment of the invention.

FIG. 30 and FIG. 31 show a case to which the third overshoot drive is applied. As shown in FIG. 30, if blackening of the black display is not completed with the panel whose response speed is relatively slow, display becomes accumulatively changed due to a difference between that blackening and the blackening of black display after the video display of the previous frame (n−1) by simply executing the first overshoot drive. This causes step-like tailing and ghost in letter scroll.

The third overshoot drive control part 68 is structured to correct the black display (gradation value of the monochrome image signal) after the video display (video signal) of the previous frame (n−1) from the video display (gradation value of the video signal) of the previous frame (n−1). This makes it possible to cancel the difference in the blackening of the black displays, and to improve the step-like tailing and the ghost in letter scroll.

The third overshoot part 60 can also be considered as the second correction device. When the second correction device functions as the third overshoot part 60, the second correction device corrects the gradation value of the monochrome image signal after the video signal of the one unit frame cycle period based on the gradation value of the video signal of the one unit frame cycle period so as to perform the display drive of the monochrome image part with a fifth gradation voltage that is different from the second gradation voltage. In this case, the monochrome image insertion drive control device can control the monochrome image insertion drive based on the monochrome image inserted video signal that contains the video part of the third gradation voltage and the monochrome image part of the fifth gradation voltage.

Further, in a case of a liquid crystal display panel of a normally-black mode, the second correction device corrects the gradation value of the monochrome image signal in such a manner that the fifth gradation voltage becomes smaller than the second gradation voltage.

(Regarding Processing Procedure)

Figure 32:
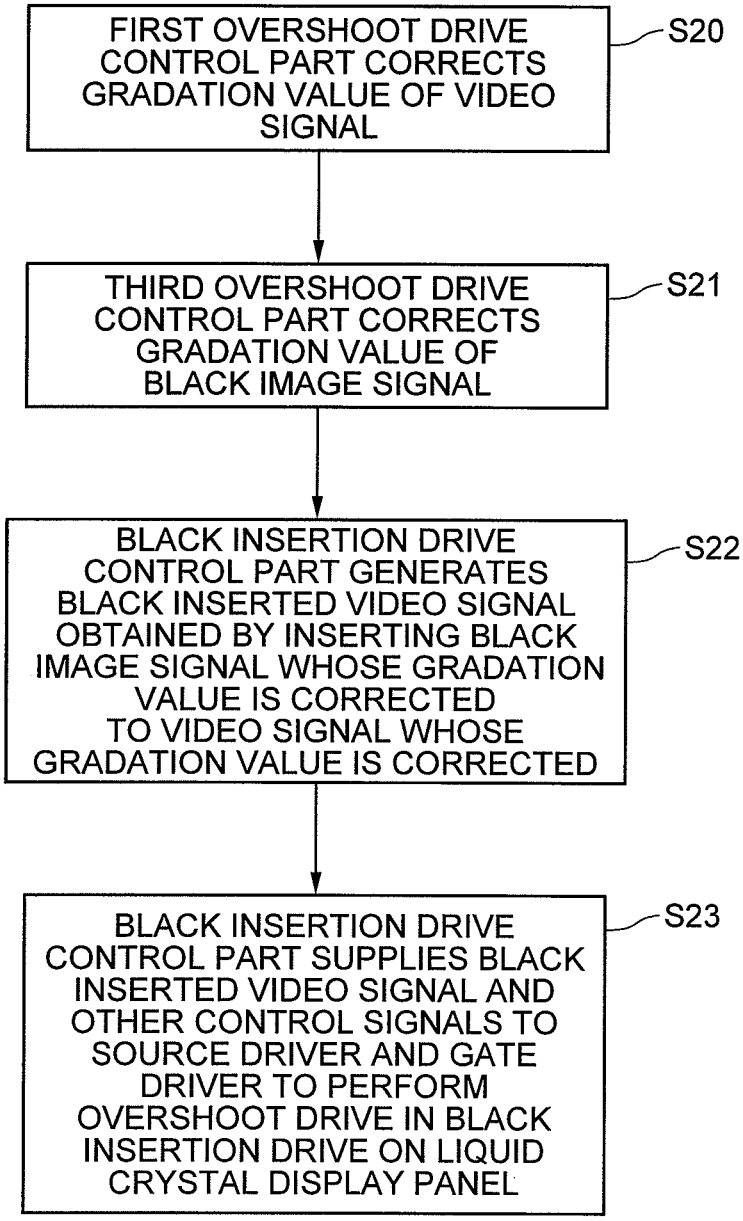
FIG. 32 is a flowchart showing an example of a drive control procedure when performing the overshoot drive in the black insertion drive of the liquid crystal display device according to the second exemplary embodiment of the invention.

Next, a drive control procedure when performing the overshoot drive in the black insertion drive executed in the liquid crystal display device having the above-described structure will be described by referring to FIG. 32. FIG. 32 is a flowchart showing an example of the drive control procedure when performing the overshoot drive in the liquid crystal display device according to this exemplary embodiment.

As shown in FIG. 32, the controller 120 corrects the gradation value of the video signal by the first overshoot drive control part (step S20)<first gradation correcting step>.

Subsequently, the controller 120 corrects, by the third overshoot drive control part, the gradation value of the black image signal (step S21)<third gradation correcting step>.

Then, the controller 120 inserts, by the black insertion drive control part, the black image signal with the corrected gradation value to the video signal whose gradation value is corrected, and generates the black inserted video signal (step S22)<black inserted video signal generating step>.

Then, the controller 120 supplies the black inserted video signal to the source driver and supplies other control signals to the gate driver by the black insertion drive control part so as to perform the overshoot drive in the black insertion drive when displaying the video on the liquid crystal display panel 10 (step S23)<black inserted video signal supplying step>.

At this time, the third gradation voltage that is higher than the first gradation voltage is applied to the pixels of the liquid crystal display panel 10 by the first overshoot drive, and the fifth gradation voltage that is lower than the second gradation voltage is applied by the third overshoot drive.

Note here that the first gradation correcting step of the step S20 can configure the "first correcting step" of the present invention. Further, the third gradation correcting step of the step S21 can configure the "second correcting step" of the present invention. Furthermore, the steps S22 and S23 can configure the "monochrome image insertion drive controlling step". The second correcting step corrects the gradation value of the monochrome image signal after the video signal of the one unit frame cycle period based on the gradation value of the video signal of the one unit frame cycle period so as to perform the display drive of the monochrome image part with the fifth gradation voltage that is different from the second gradation voltage. In this case, the monochrome image insertion drive control device can control the monochrome image insertion drive based on the monochrome image inserted video signal that contains the video part of the third gradation voltage and the monochrome image part of the fifth gradation voltage.

As described above, in the second exemplary embodiment, the first overshoot drive converts the gradation of the video signal to the value that corresponds to the voltage to be more deviated from the voltage value of the black display than the case where the black insertion drive is not performed. The third overshoot drive converts the gradation of the black signal to a gradation value corresponding to a voltage to be more deviated from the voltage value of white display compared to the case where the black insertion drive is not performed. The signal having the black signal line inserted between the lines of the converted video signals is inputted from the timing controller to each source driver.

With this, as shown in FIG. 6-FIG. 8, the voltage of the video signal converted by the first overshoot drive to be more deviated from the voltage value of the black display than the case without the black insertion drive is written to the panel from each gate driver and each source driver according to the above-described signals. As shown in FIG. 30 and FIG. 31, the voltage of the black signal converted by the third overshoot drive to be more deviated from the voltage value of white display than the case without the black insertion drive is written to the panel. The voltage data of the black signal lines is inputted between the voltages of the lines of the converted video signals.

This makes it possible to improve the issues raised when performing black display on a relatively slow panel, such as deterioration of the luminance, step-like tailing, and ghost generated in letter scroll.

Further, this exemplary embodiment is structured to utilize the fact that the black signals of the black insertion drive are in prescribed gradation on a whole area of the screen, and to save the video signal to the frame memory before doubling the speed by the black insertion. Thus, it is possible to be achieved without increasing the circuit scale, unlike the case of the related technique.

Further, the black insertion drive of the second exemplary embodiment is structured to include the first overshoot drive which corrects the response delay from the black display to the video display based on the video information of the current frame, and to have necessary gradation voltage. Thus, deterioration of the luminance, which is an issue brought up when performing black insertion to the panel of relatively slow response speed, can be suppressed.

Furthermore, the black insertion drive of the second exemplary embodiment is structured to include the third overshoot drive which corrects the response delay from the video signal to the black display based only on the previous video signal. This makes it possible to improve the issues raised when performing black display on a relatively slow panel, such as accumulative luminance reaching delay caused due to the difference between the blackening of the black displays, by correcting the response speed of the black display. As a result, step-like tailing and ghost generated in letter scroll can be improved.

Further, the third overshoot drive corrects darkening from the previous video signal to a prescribed gradation display. Thus, the unreached response of the black display as a cause for the ghost-like tailing can be corrected directly. This makes it possible to improve the shortcomings of the dynamic image display even with the liquid crystal display panel of relatively slow response speed, with the structure that is capable of changing the black insertion rate while decreasing the frame memory frequency.

Furthermore, the overshoot can be applied to the video signal before executing the high-speed drive by black insertion, so that the access frequency of the frame memory required for the overshoot drive is not doubled. Therefore, this exemplary embodiment makes it possible to employ the overshoot drive for the black insertion drive without increasing the circuit scale, e.g., without increasing the number of memories. Further, it is possible to increase the implementability of the overshoot to the black insertion drive, and to improve the issues raised when performing black display on a relatively slow panel, such as step-like tailing caused due to insufficient blackening of the black displays, and ghost generated in letter scroll.

Other structures, steps, and operational effects are the same as those of the first exemplary embodiment described above.

Further, the contents of each step and each part described above may be put into programs to be executed by a computer.

Third Exemplary Embodiment

Figure 33:
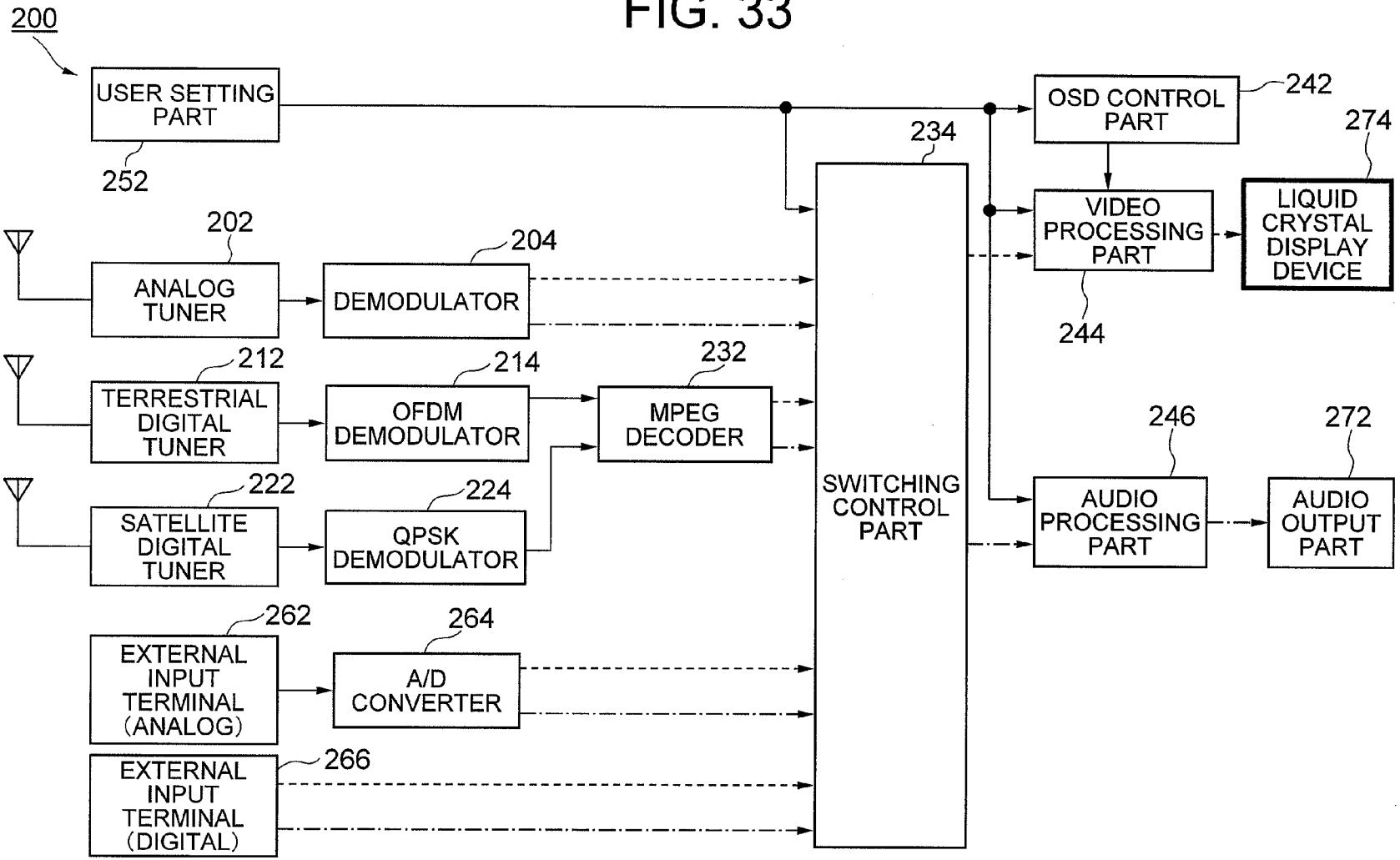
FIG. 33 is a block diagram showing an example of a schematic structure of a broadcast receiver according to a third exemplary embodiment of the invention.

Next, a third exemplary embodiment of the present invention will be described by referring to FIG. 33. Hereinafter, explanations regarding structures and the processing orders which are substantially the same as those of the first exemplary embodiment are omitted, and only the different points are described. FIG. 33 is a block diagram showing an example of the third exemplary embodiment in which a liquid crystal display device having the display panel control device of the present invention is applied to a broadcast receiver.

As shown in FIG. 33, a broadcast receiver 200 is configured to include a liquid crystal display device 274 having the same structure as those described in any of the above-described exemplary embodiments.

Further, the broadcast receiver 200 is configured to include: an analog tuner 202 for terrestrial analog broadcasting; a demodulator 204 for demodulating signals from the analog tuner 202; a terrestrial digital tuner 212 for terrestrial digital broadcasting; an OFDM demodulator 214 for demodulating signals from the terrestrial digital tuner 212; a satellite digital tuner 222 for satellite digital broadcasting; a QPSK demodulator 224 for demodulating signals from the satellite digital tuner 222; an MPEG decoder 232 for decoding videos of the terrestrial digital broadcasting and videos of the satellite digital broadcasting, such as compression coded data of a moving picture compression coding system such as MPEG-2 system, for example; an external input terminal 262 as a first external input terminal for inputting analog signals; an external input terminal 266 as a second external input terminal for inputting digital signals; a user setting part 252; a switching control part 234; an OSD control part 242; a video processing part 244; an audio processing part 246; and an audio output part 272.

When receiving the terrestrial analog broadcasting by the broadcast receiver 200, signals from the analog tuner 202 connected to an antenna for the terrestrial analog broadcasting is separated to video signals and audio signals by the demodulator 204, and the video signals are inputted to the switching control part 234.

When receiving the terrestrial digital broadcasting by the broadcast receiver 200, signals from the terrestrial digital tuner 212 connected to an antenna for the terrestrial digital broadcasting is converted into digital video signals and digital audio signals by the OFDM (Orthogonal Frequency Division Multiplexing) demodulator 214, and the videos are decoded by the MPEG (Moving Picture Export Group) decoder 232 to generate the video signals. The video signals are inputted to the switching control part 234.

When receiving the satellite digital broadcasting by the broadcast receiver 200, signals from the satellite digital tuner 222 connected to an antenna for the satellite digital broadcasting is converted into digital video signals and digital audio signals by the QPSK (Quadrature Phase Shift Keying) demodulator 224, and the videos are decoded by the MPEG (Moving Picture Export Group) decoder 232 to generate the video signals. The video signals are inputted to the switching control part 234.

Further, analog input signals from the outside are digitized to generate the video signals, and inputted to the switching control part 234. For digital input signals, the video signals thereof are inputted to the switching control part 234. These input signals are switched by the user setting part 252 according to the channel setting set by the user, and transmitted to the video processing part 244. The video processing part 244 performs format conversion such as IP conversion, scaler, etc., performs video adjustment such as brightness, contrast, and colors, and inputs the signals to the liquid crystal display device 274.

As described above, this exemplary embodiment applies the liquid crystal display device capable of achieving the same operational effects as those of the first exemplary embodiment to such broadcast receiver, which makes it possible to implement the low-price broadcast receiver that can provide images with less dynamic image blur.

The broadcast receiver described above has been referred to the cases of displaying videos by receiving various broadcast signals, such as the analog broadcasting, the terrestrial digital broadcasting, and the satellite digital broadcasting. However, it is not limited to specific kinds of broadcast signals.

The block diagram of the broadcast receiver shown in FIG. 33 and disclosed in the above-described exemplary embodiment is merely an example. The structure is not intended to be limited to that, as long as the liquid crystal display device described in each of the exemplary embodiments is used therein. As the structure of the broadcast receiver, other various kinds of structures (for example, a broadcast receiver that receives only the analog broadcasting, a broadcast receiver that receives only the terrestrial digital broadcasting, a broadcast receiver that receives only the satellite digital broadcasting, and a broadcast receiver obtained by adding other functions to the structure of this exemplary embodiment) can be assumed, and the structure to be used as a display unit is not limited depending on those structures.

While the case of FIG. 33 is the broadcast receiver, it is also possible to achieve images with less dynamic image blur at a low cost even when the liquid crystal display device of the above-described exemplary embodiment is used as a monitor.

Other structures, steps, and operational effects are the same as those of the first exemplary embodiment described above.

Further, the contents of each step and each part described above may be put into programs to be executed by a computer.

Fourth Exemplary Embodiment

Figure 34:
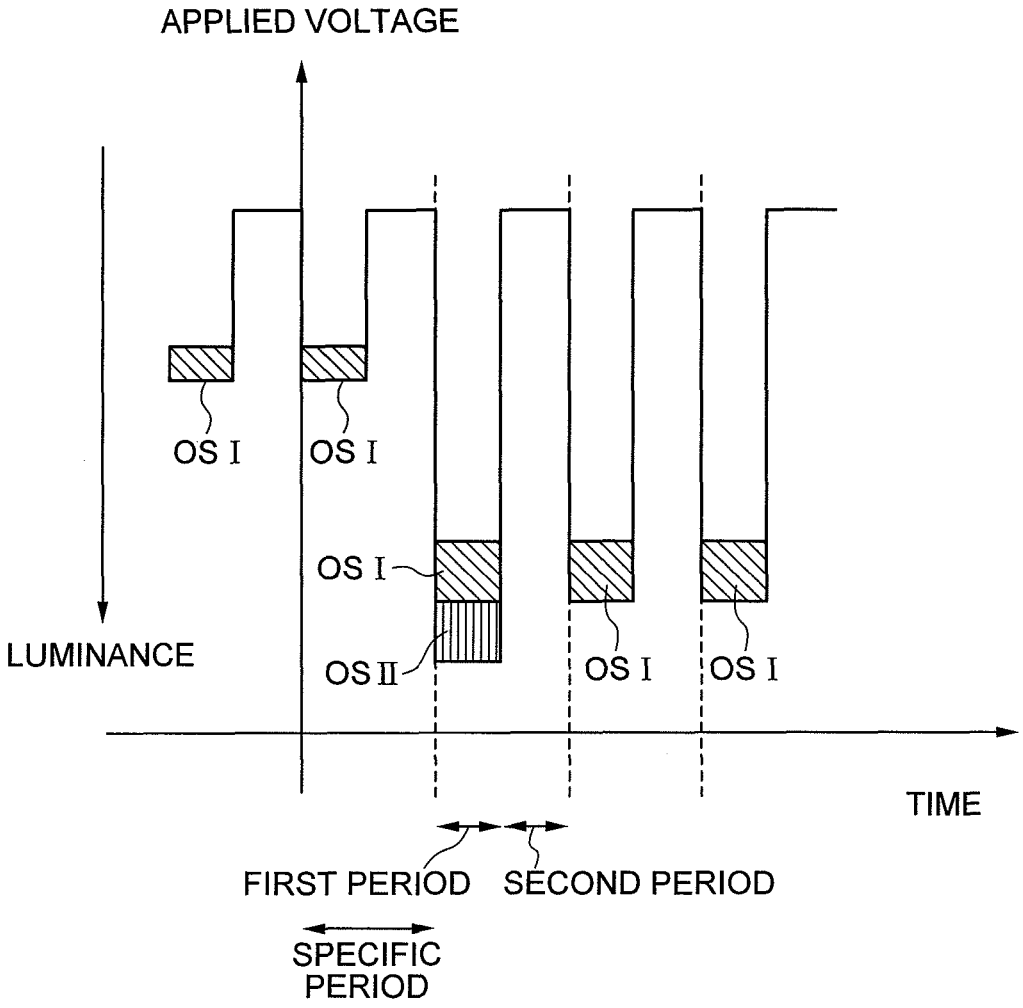
FIG. 34 is an illustration for describing an example of a case where the second overshoot drive is performed on a normally-white mode liquid crystal panel of a liquid crystal display device according to a fourth exemplary embodiment of the invention.

Next, a fourth exemplary embodiment of the invention will be described by referring to FIG. 34. Hereinafter, explanations regarding structures and the processing orders which are substantially the same as those of the first exemplary embodiment are omitted, and only the different points are described. FIG. 34 is an illustration for describing an example of the exemplary embodiment in which the display panel control device according to the present invention is applied to a liquid crystal display device of a normally-white mode.

The first exemplary embodiment refers to the case of the liquid crystal display panel of the normally-black mode, whereas the fourth exemplary embodiment refers to the case of the liquid crystal display panel of the normally-white mode.

Specifically, as shown in FIG. 34, in the case of the liquid crystal display panel of the normally-white mode, a first overshoot drive control part as the first correction device corrects the gradation value of the video signal in such a manner that the third gradation voltage becomes smaller than the first gradation voltage (the OS I part of FIG. 34), as in the case of the first exemplary embodiment. However, it is necessary for the data structure within the first LUT part to be in a structure for the normally-white mode, in order to perform such correction.

Further, a second overshoot part as the second correction device corrects the gradation value of the video signal in such a manner that the fourth gradation voltage becomes smaller than the third gradation voltage (the OS II part of FIG. 34). However, it is necessary for the data structure within the second LUT part to be in a structure for the normally-white mode, in order to perform such correction.

As in the case of the first exemplary embodiment, the second overshoot part makes it possible to correct the gradation value of the video signal of the current unit frame cycle period based on the gradation value of the previous unit frame cycle period, and makes it possible to perform display drive of the video part with the fourth gradation voltage that is different from the third gradation voltage which corresponds to the gradation value corrected by the first correction. The second correction device can correct the gradation value in such a manner that time integrated value of the luminance in the current unit frame cycle period where display is being changed becomes larger than the time integrated value of the luminance in a next unit frame cycle period after display is being changed.

A black insertion drive control part as a monochrome image insertion drive control device controls the monochrome image insertion drive based on the monochrome image inserted video signal that contains the video part of the third gradation voltage or the fourth gradation voltage and the monochrome image part of the second gradation voltage.

With the drive by the monochrome image inserted video signals, the unit cycle period (specific period) including a first gradation voltage video part (first period) for providing video display according to the gradation value of the video signal and a second gradation voltage (second period) for providing monochrome display according to the gradation value of the monochrome image signal is repeated.

As described, the first and the second overshoot drives can be performed also in the liquid crystal display panel of the normally-white mode, and the same operational effects as those of the above-described embodiments can be achieved.

Other structures, steps, and operational effects are the same as those of the exemplary embodiments described above.

Further, the contents of each step and each part described above may be put into programs to be executed by a computer.

Fifth Exemplary Embodiment

Figure 35:
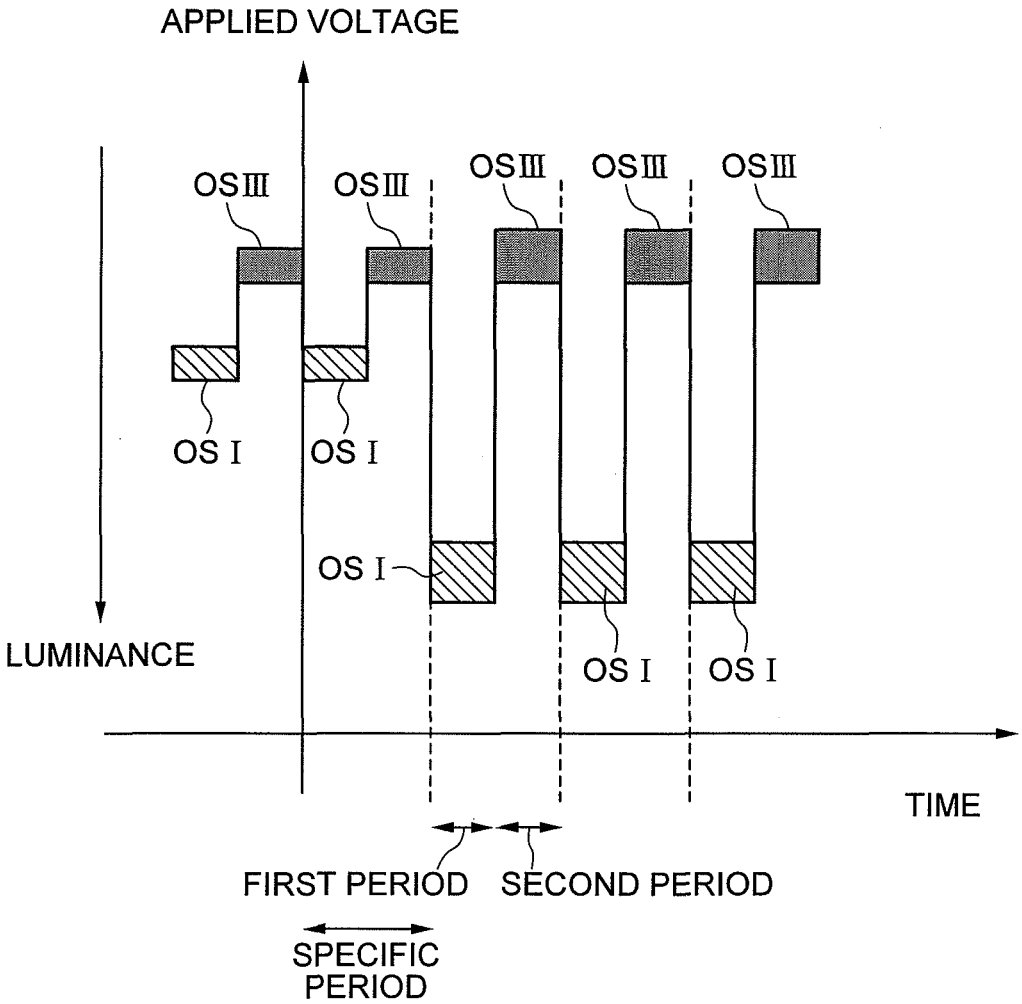
FIG. 35 is an illustration for describing an example of a case where the third overshoot drive is performed on a normally-white mode liquid crystal panel of a liquid crystal display device according to a fifth exemplary embodiment of the invention.

Next, a fifth exemplary embodiment of the invention will be described by referring to FIG. 35. Hereinafter, explanations regarding structures and the processing orders which are substantially the same as those of the second exemplary embodiment are omitted, and only the different points are described. FIG. 35 is an illustration for describing an example of the exemplary embodiment in which the display panel control device according to the present invention is applied to a liquid crystal display device of a normally-white mode.

The second exemplary embodiment refers to the case of the liquid crystal display panel of the normally-black mode, whereas the fifth exemplary embodiment refers to the case of the liquid crystal display panel of the normally-white mode.

Specifically, as shown in FIG. 35, in the case of the liquid crystal display panel of the normally-white mode, a first overshoot drive control part as the first correction device corrects the gradation value of the video signal in such a manner that the third gradation voltage becomes smaller than the first gradation voltage (the OS I part of FIG. 35), as in the case of the first exemplary embodiment. However, it is necessary for the data structure within the first LUT part to be in a structure for the normally-white mode, in order to perform such correction.

Further, a third overshoot part as the second correction device corrects the gradation value of the monochrome image signal in such a manner that the fifth gradation voltage becomes larger than the second gradation voltage (the OS III part of FIG. 35). However, it is necessary for the data structure within the third LUT part to be in a structure for the normally-white mode, in order to perform such correction.

As in the case of the second exemplary embodiment, the third overshoot part makes it possible to correct the gradation value of the monochrome image signal after the video signal of the previous unit frame cycle period based on the gradation value of the video signal of the previous unit frame cycle period, and makes it possible to perform display drive of the monochrome image part with the fifth gradation voltage that is different from the second gradation voltage.

A black insertion drive control part as a monochrome image insertion drive control device controls the monochrome image insertion drive based on the monochrome image inserted video signal that contains the video part of the third gradation voltage and the monochrome image part of the fifth gradation voltage.

With the drive by the monochrome image inserted video signals, the unit cycle period (specific period) including a first gradation voltage video part (first period) for providing video display according to the gradation value of the video signal and a second gradation voltage monochrome image part (second period) for providing monochrome display according to the gradation value of the monochrome image signal is repeated.

As described, the first and the second overshoot drives can be performed also in the liquid crystal display panel of the normally-white mode, and the same operational effects as those of the above-described embodiments can be achieved.

Other structures, steps, and operational effects are the same as those of the exemplary embodiments described above.

Further, the contents of each step and each part described above may be put into programs to be executed by a computer.

Other Various Modifications

While the device and the method according to the present invention have been described along with some of specific exemplary embodiments thereof, it is to be understood that various changes and modifications can be applied to the exemplary embodiments of the present invention provided herein without departing from the spirit and scope of the present invention.

For example, in the above-described exemplary embodiments, the overshoot drive is applied to the black insertion drive that is capable of changing the black insertion rate.

However, the same structure can also be applied to the black frame insertion drive in which black and video are alternately repeated by each sub-frame.

Furthermore, the above-described exemplary embodiments are not limited only to the case of inserting 0-gradation black. The exemplary embodiments can also be achieved in a case where a prescribed gradation signal, e.g., a halftone gradation such as 16-gradation, is inserted.

There are several liquid crystal drive modes in the liquid crystal display panels, e.g., TN panel, IPS panel, VA panel, and OCB panel. The response property varies depending on the liquid crystal drive modes, so that the optimum black insertion rate differs as well. The black insertion rate setting part sets different black insertion rates in accordance with the drive modes of the liquid crystal display panels. With the first, second, and third overshoot drives, each of the LUTs of the first LUT part, the second LUT part, and the third LUT part are selected in accordance with the different black insertion rates, so that it is possible to perform the overshoot drives in accordance with the display panel.

Further, in the above-described exemplary embodiments, the overshot drive is applied to the black insertion drive that is capable of changing the black insertion rate. However, the same structure can also be applied to the black frame insertion drive in which black and video are alternately repeated by each sub-frame.

Figure 36:
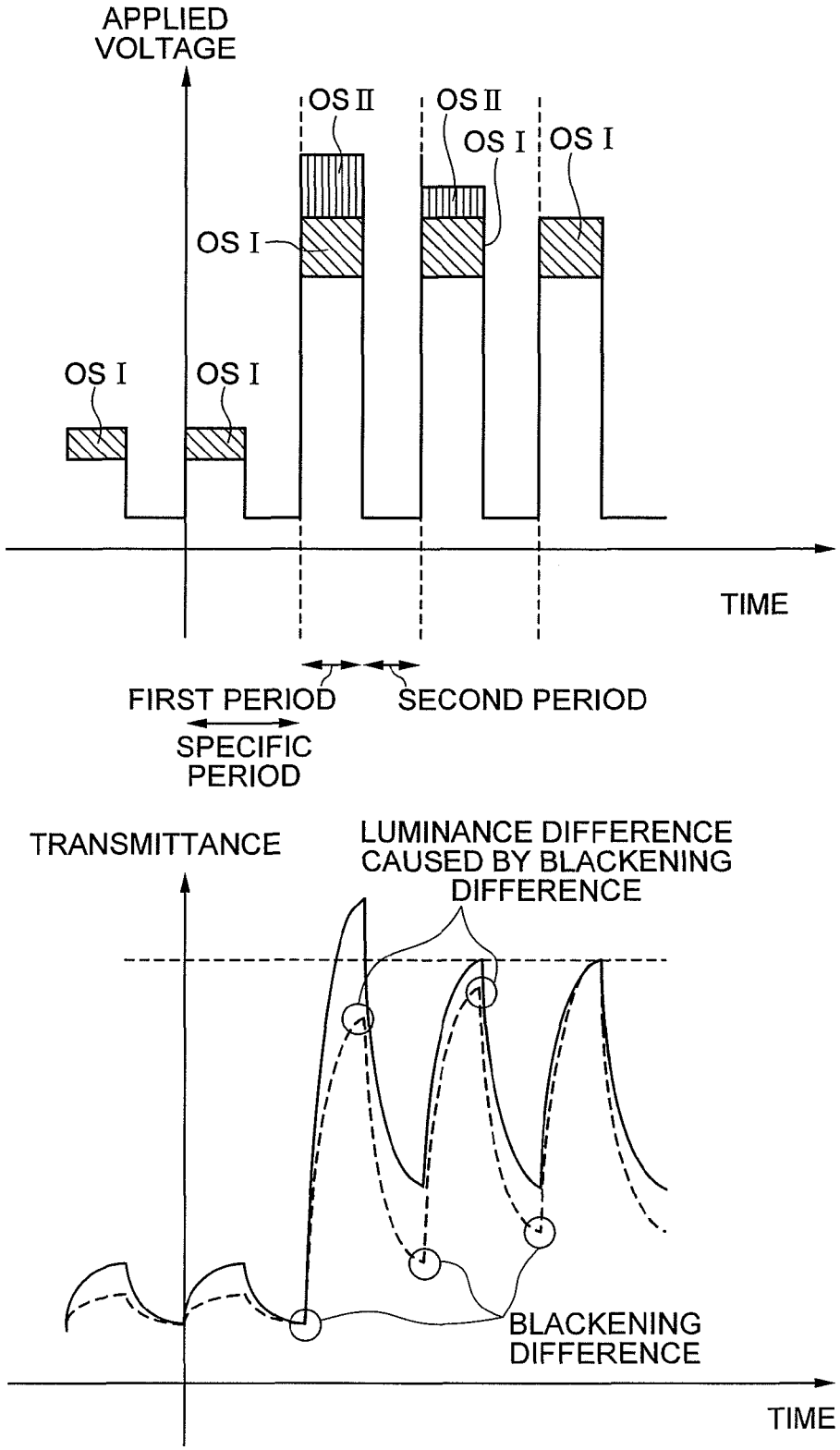
FIG. 36 is an illustration for describing an example of a case where the first and the second overshoot drives are performed on a normally-white mode liquid crystal panel of a liquid crystal display device according to another exemplary embodiment of the invention.

Furthermore, in the above-described exemplary embodiments, correction performed by the second overshoot part when the gradation value of the video signal changes from a given unit frame cycle period to another unit frame cycle period is conducted mainly on the gradation value of the video signal of another unit frame cycle period. As shown in FIG. 36, however, the second overshoot part may be structured to perform correction on the gradation value of the video signal of a latter-stage unit frame cycle period which follows another unit frame cycle period.

FIG. 36 is an illustration for describing an example of a case where the first and the second overshoot drives are performed on a liquid crystal display device according to another exemplary embodiment of the invention. In this case, the second overshoot part may be structured to perform correction with different correction amount, such as a correction amount (OS II) <fourth gradation voltage> for the gradation value of the video signal of another unit frame cycle period and a correction amount (OS II) <sixth gradation voltage> for the gradation value of the video signal of the latter-stage unit frame cycle period.

As shown in the lower part of FIG. 36, when there are differences in blackening of black displays generated by stages, the first and second overshoot drives are performed at the initial stage of the changes, as well as in the latter frames. This makes it possible to increase the luminance in the frame of the initial stage of the changes and the latter frames to be higher than the mean luminance of each frame, which results in reducing the step-like tailing and the ghost.

Figure 37:
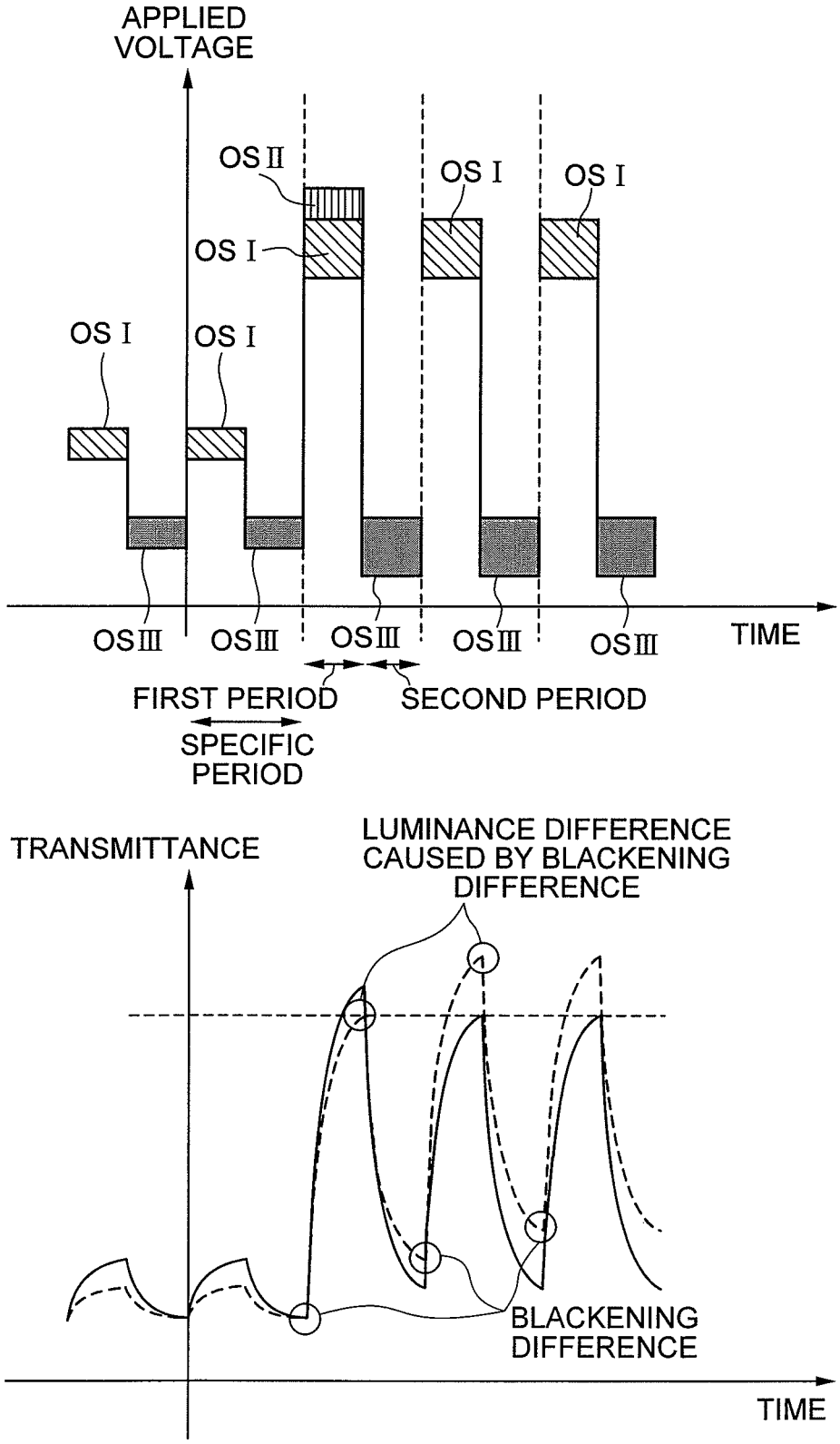
FIG. 37 is an illustration for describing an example of a case where the first, second, and third overshoot drives are performed on a normally-white mode liquid crystal panel of a liquid crystal display device according to another exemplary embodiment of the invention.

Further, the first, second overshoot drives of the first exemplary embodiment and the third overshoot drive of the second exemplary embodiment may be combined. In that case, it is assumed to have the applied voltages as shown in FIG. 37, for example. FIG. 37 is an illustration for describing an example of a case where the first, second, and third overshoot drives are performed in a liquid crystal display device according to another exemplary embodiment of the invention. That is, as shown in FIG. 37, when the gradation value of the video signal changes from a given unit frame cycle period to another unit frame cycle period, the first and second overshoot drives are performed (OS I, OS II) for the video signal of another unit frame cycle period. Further, the first overshoot drive is performed (OS I) for the video signals of each unit frame cycle period, and the third overshoot drive is performed (OS III) for the black signals (monochrome image signal) of each unit frame cycle period. By combining the first, second, and third overshoot drives in this manner, the step-like tailing and ghost can be decreased.

Figure 38:
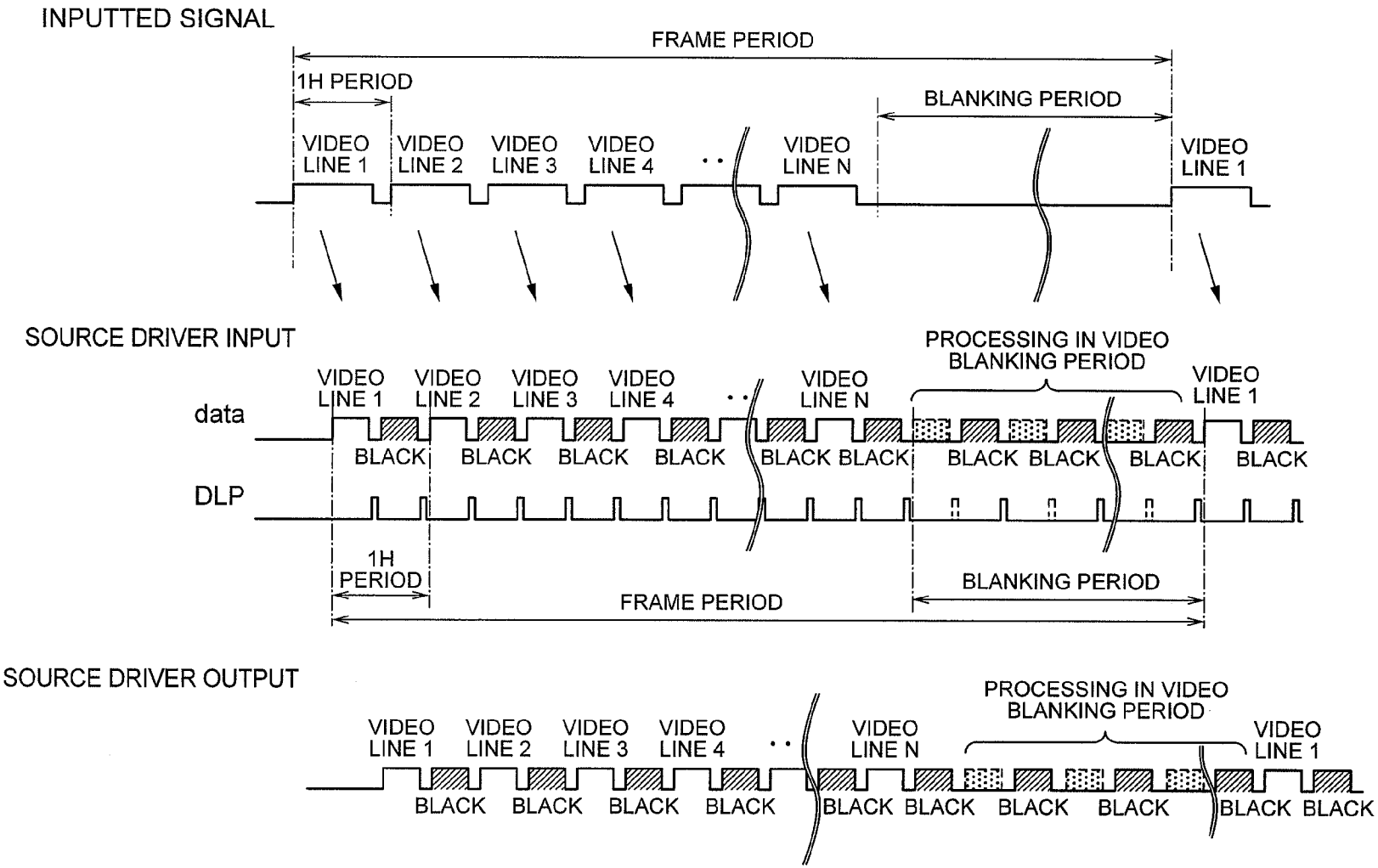
FIG. 38 is an illustration for describing an example of a process of creating a black inserted video signal in the liquid crystal display device according to another exemplary embodiment of the invention.

Furthermore, the black inserted video signal may be created as in FIG. 38.

FIG. 38 is an illustration for describing an example of a process of creating the black inserted video signal in the liquid crystal display device according to another exemplary embodiment of the invention. That is, as shown in FIG. 38, the black insertion drive control part may generate the black inserted video signal by inserting the black image signal to the inputted video signal having an output of a dummy signal in a blanking period. Generally, the video signal may have an output of a dummy signal, or may not have an output, in a blanking period. As such, there are many types.

Figure 39:
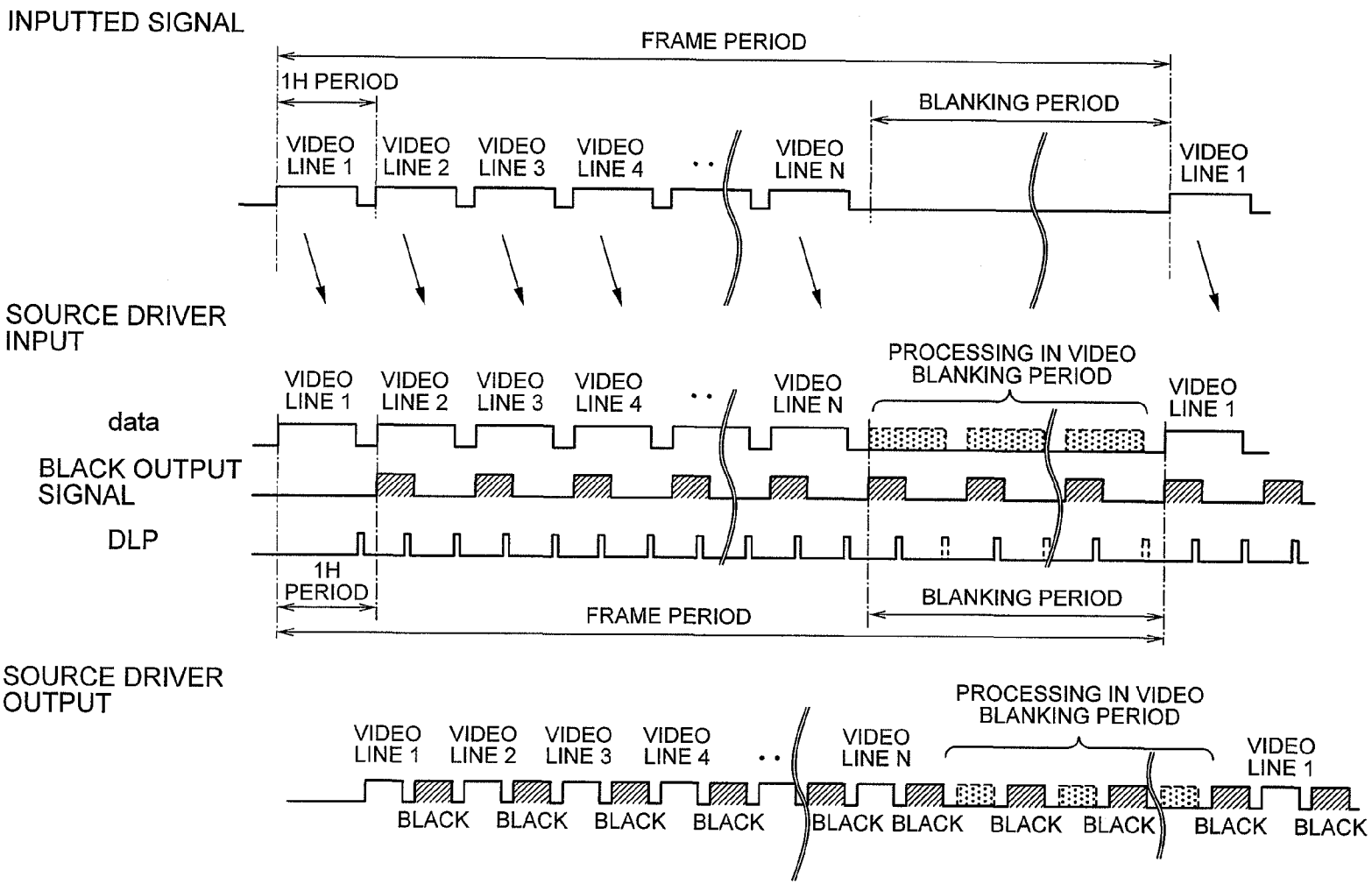
FIG. 39 is an illustration for describing another example of a process of creating a black inserted video signal in the liquid crystal display device according to another exemplary embodiment of the invention.

Further, in the above-described exemplary embodiments, the black inserted video signal generated by the black insertion drive control part is inputted to the source driver 16 and outputted to the source lines H1-Hn with double-speed drive. However, it is not intended to be limited to such case. The structure shown in FIG. 39 is also possible. FIG. 39 is an illustration for describing another example of the process of creating the black inserted video signal in the liquid crystal display device according to another exemplary embodiment of the invention. That is, the source driver 16 has a function of converting the output charge to the source lines H1-Hn into a gradation charge that corresponds to the black display. As shown in FIG. 39, the inputted video signals may be outputted to the source lines H1-Hn while switching the output charge to the gradation charge according to the black display at a prescribed interval. With this, the line memories required for inserting the black images can be reduced, so that it is unnecessary to double the driving frequency of the source driver 16 due to the black image insertion.

Figure 40:
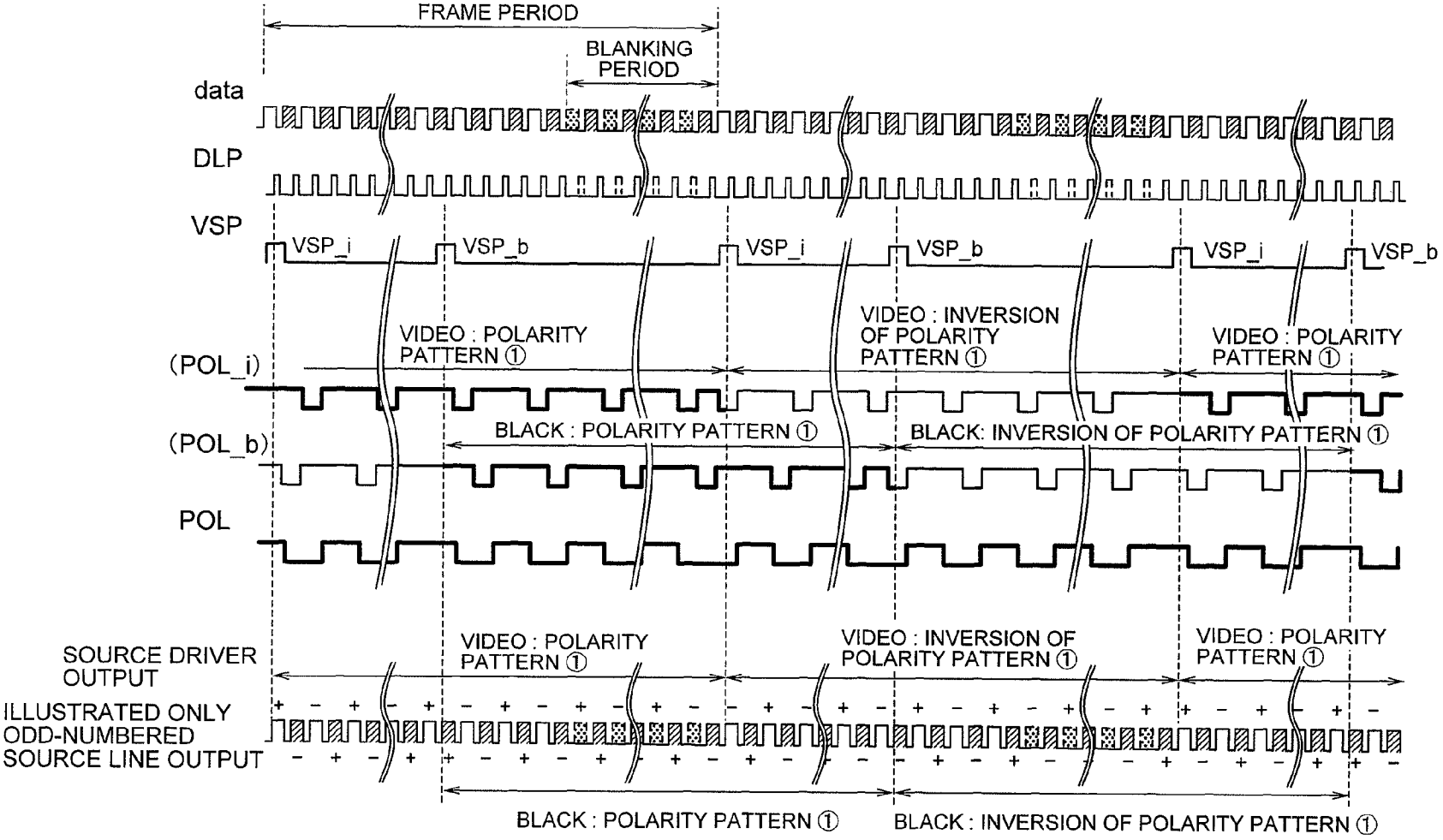
FIG. 40 is a timing chart showing an example of frame polarity inversion drive performed in the liquid crystal display device according to another exemplary embodiment of the invention.

Further, the POL signal of the above-described exemplary embodiments can be driven with dot inversion drive. FIG. 40 is a timing chart for describing an example of the dot inversion drive by referring to the case of the POL signal performed in the controller. For example, it is assumed that the source drive 16 has a function which outputs positive-side voltages to the odd-numbered source lines H1, H3, H5, H7, - - - while outputting negative-side voltages to the even-numbered source lines H2, H4, H6, H8, - - - when POL is high, and outputs negative-side voltages to the source lines H1, H3, H5, H7, - - - while outputting positive-side voltages to the source lines H2, H4, H6, H8, - - - when POL is low.

The black insertion drive control part 24 counts 0-1 frames starting from VSP_i by a 1-bit frame counter of a VSP_i cycle, and counts 0-3 by a 2-bit line counter of a DLP cycle from VSP_i at the same time. In 0th frame, the internal signal (POL_i) is generated to be low when the line counter is 2. In 1st frame, the internal signal (POL_i) is generated to be low when the line counter is 0. The internal signal (POL_i) is generated to be high in other cases.

In the meantime, the black insertion drive control part 24 counts 0-1 frames starting from VSP_b by a built-in 1-bit frame counter of a VSP_b cycle, and counts 0-3 by the 2-bit line counter of a DLP cycle from VSP_b at the same time. In 0th frame, the internal signal (POL_b) is generated to be low when the line counter is 2. In 1st frame, the internal signal (POL_b) is generated to be low when the line counter is 0. The internal signal (POL_b) is generated to be high in other cases.

The black insertion drive control part 24 finally outputs POL that is to be AND of the internal signal (POL_i) and internal signal (POL_i) to the source driver 14. By the input of POL as in FIG. 40, the source driver 14 inverts the writing polarity of the line image part by a frame cycle starting from VSP_i. For the writing polarity of the black image part, the source driver 14 executes the dot inversion drive which inverts the polarity by a frame cycle starting from VSP_b.

With such structure, polarities of the video signals and the black signals can be inverted by a frame cycle starting from the respective individual timings, by simply having the black inversion frame counter and the line counter built inside the black insertion drive control part 24 separately.

As described above, the black insertion drive control part 24 functions as a frame polarity inverting device which controls POL to invert the polarity of the voltages applied to the pixels according to the video signal by a frame cycle starting from the start point of the video display scanning, and to invert the polarity of the applied voltages applied to the pixels according to the black image signal by a frame cycle starting from the start point of the black image display scanning. This makes it possible to prevent the direct current voltages from being applied to the liquid crystal.

Figure 41:
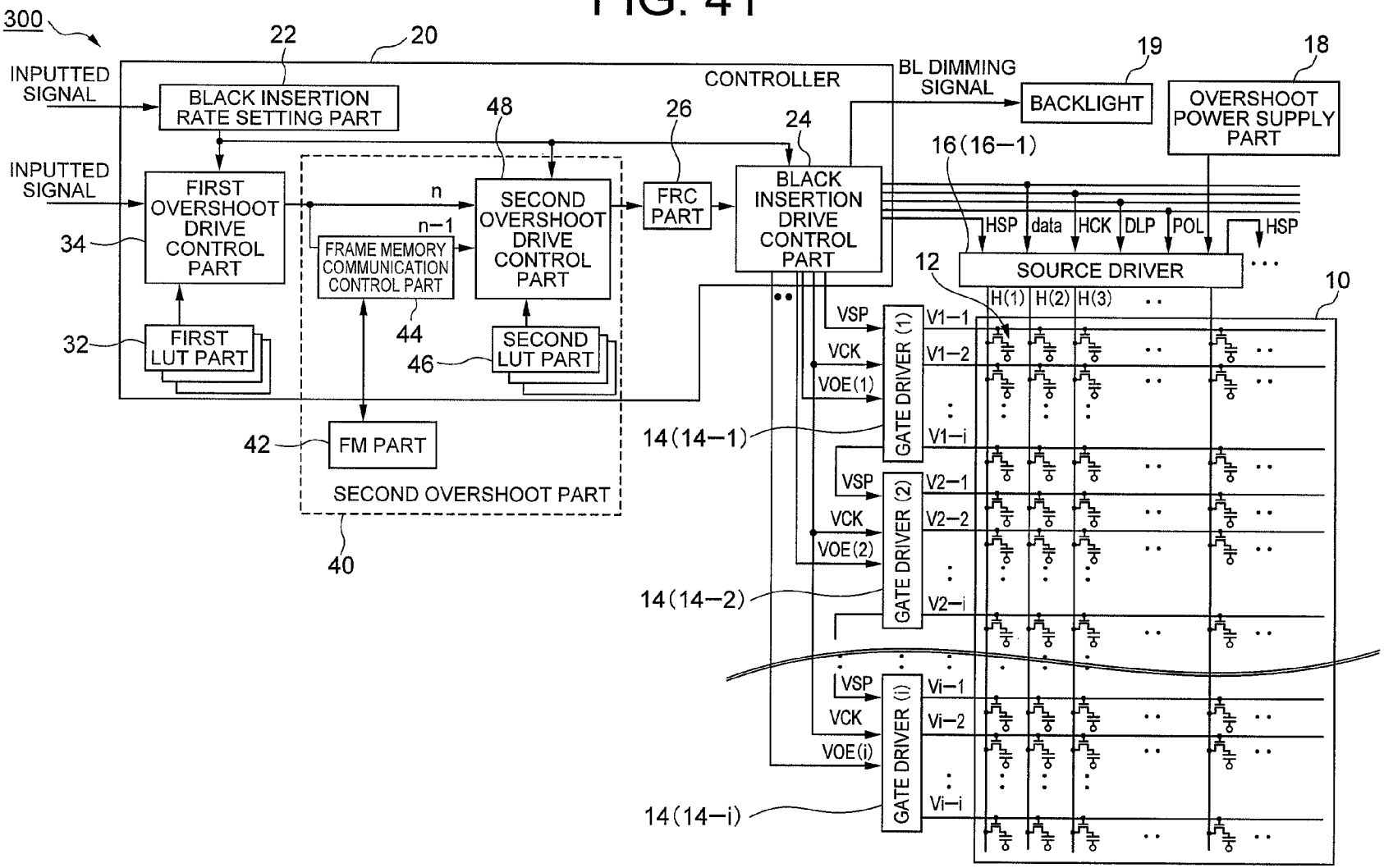
FIG. 41 is a block diagram showing an example of a schematic structure of a liquid crystal display device according to another exemplary embodiment of the invention.

Further, as shown in FIG. 41, the liquid crystal display device may have a backlight 19 provided on the backside of the liquid crystal display panel 10 when viewed from the user, in addition to the structure described in the first exemplary embodiment. Furthermore, the black insertion rate setting part 22 may have a function which temporarily stores the information for one frame of the inputted video signal that is successively inputted by one frame, compares the video signal of a given frame among the inputted video signals and the video signal of a previous frame stored temporarily, and judges the black insertion rate and the dimming luminance of the backlight based on the changes in the number of data. The black insertion drive control part 24 may have a function of adjusting the dimming luminance of the backlight 19 based on the judgment made by the black insertion rate setting part 22.

Further, as in the case of the first exemplary embodiment, VSP_b from the black insertion drive control part 24 is inputted to the gate driver 14 (14-1) according to the timing that is determined by the black insertion rate setting part 22. With the control of POL executed by the black insertion drive control part 24, the video signal is frame-inverted starting from the input of VSP_i and, separately from that, the black signal is frame-inverted starting from the input of VSP_b.

Figure 42:
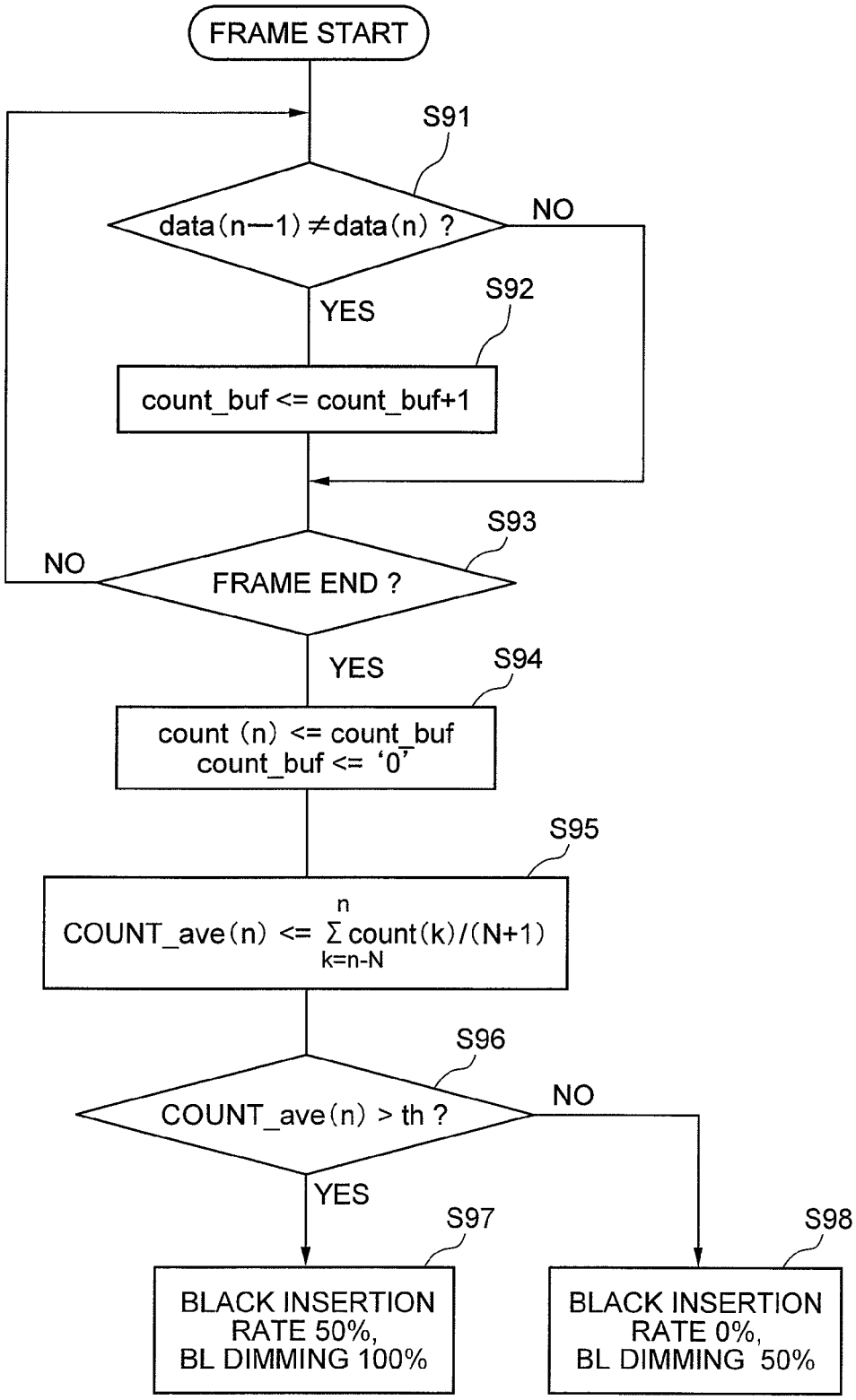
FIG. 42 is a flowchart showing an example of operations of a black insertion rate setting part of the liquid crystal display device of FIG. 41.

FIG. 42 is a flowchart showing an example of operations of the black insertion rate setting part 22 of the liquid crystal display device. The black insertion rate setting part 22 compares current frame data "data(n)" and the previous frame data "data (n−1)", and counts the changed data for one frame (FIG. 42; steps S91-S93). Whether it is a static image or a dynamic image is judged through leveling the counted information by obtaining running average of several frames (FIG. 42; step S95), for example, and judging the threshold value (FIG. 42; step S96).

When judged that it is a static image, black insertion is not performed, for example, and the dimming luminance of the backlight 19 is set to 50% (FIG. 42; step S98). When judged that it is a dynamic image, the black insertion rate is set to 50%, for example, to improve the dynamic image blur, and the dimming luminance of the backlight 19 is switched to 100% (FIG. 42; step S97 (black insertion rate setting step)).

Figure 43:
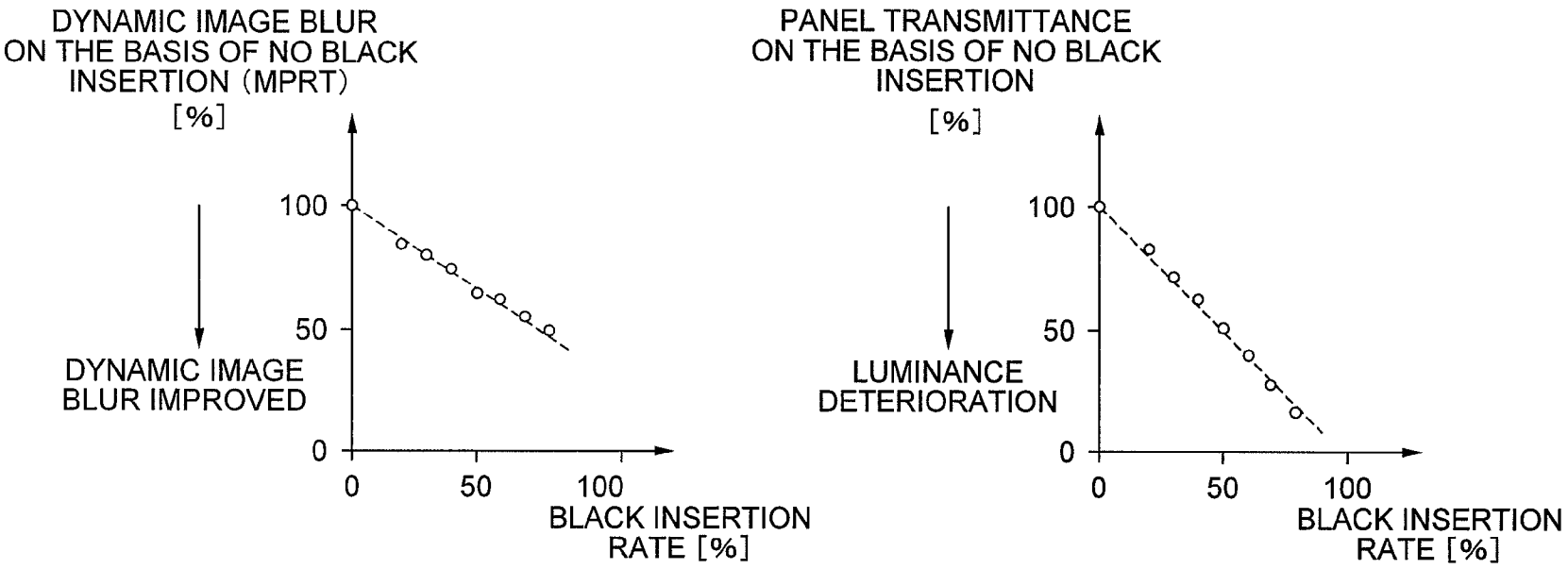
FIG. 43 is an illustration showing an example for describing a relational characteristic regarding the black insertion rate and dynamic image blur as well as the transmittance efficiency of the liquid crystal display device shown in FIG. 41.

With such structure, it becomes possible to switch the black insertion rate in accordance with scenes of the videos so as to improve the dynamic image blur as necessary. The reason for adjusting the backlight 19 in accordance with the black image insertion is that the light transmittance of the panel becomes decreased in exchange for improving the dynamic image blur by the black image insertion, as shown in FIG. 43. With such operations, changes in the luminance caused due to switching of the black insertion can be prevented. At the same time, it is possible to decrease the power consumption by dimming the backlight 19, in a case of a static image that requires no insertion of the black image.

Figure 44:
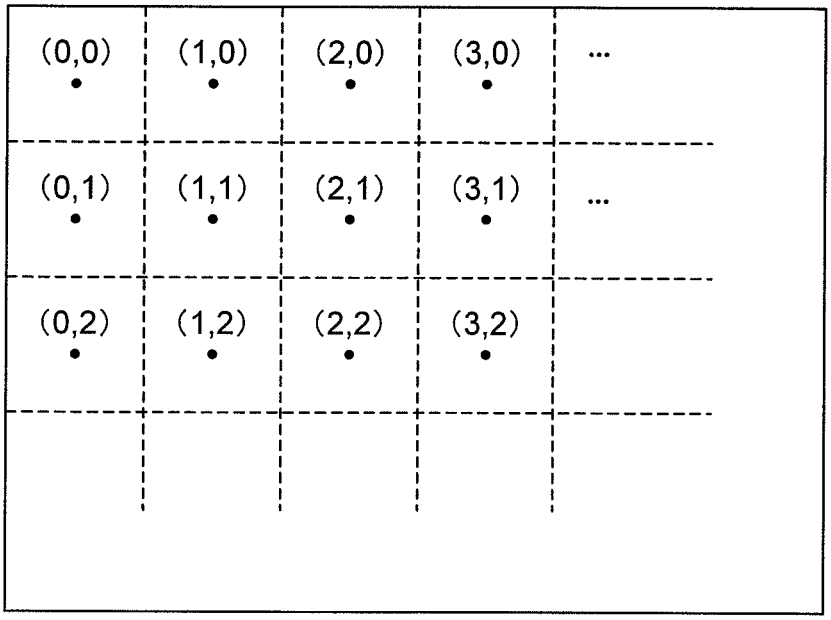
FIG. 44 is a flowchart showing an example of operations of the black insertion rate setting part of the liquid crystal display device of FIG. 41.
Figure 45:
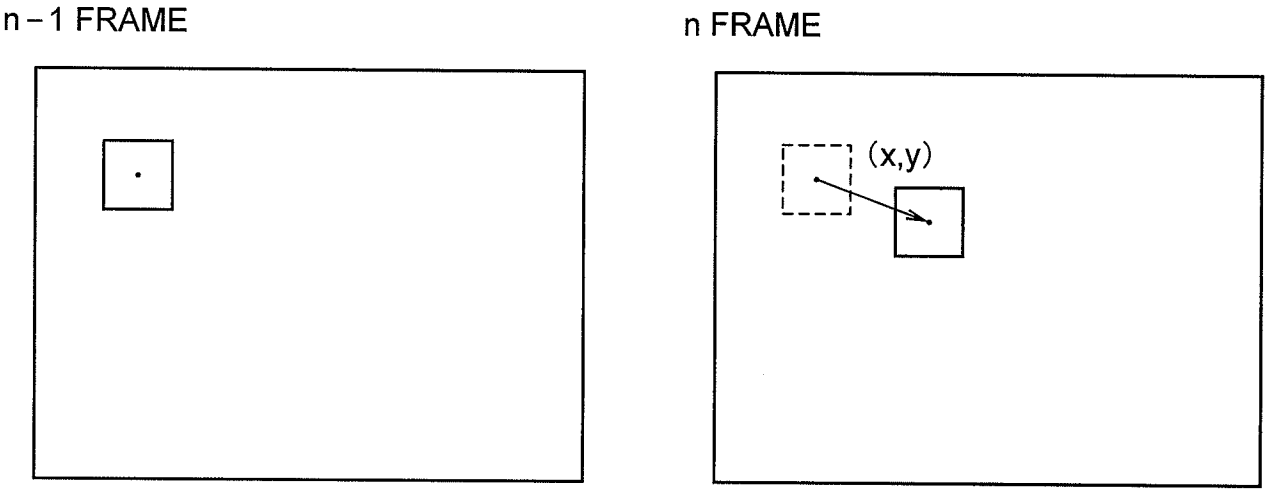
FIG. 45 is a flowchart showing an example of operations of the black insertion rate setting part of the liquid crystal display device of FIG. 41.
Figure 46:
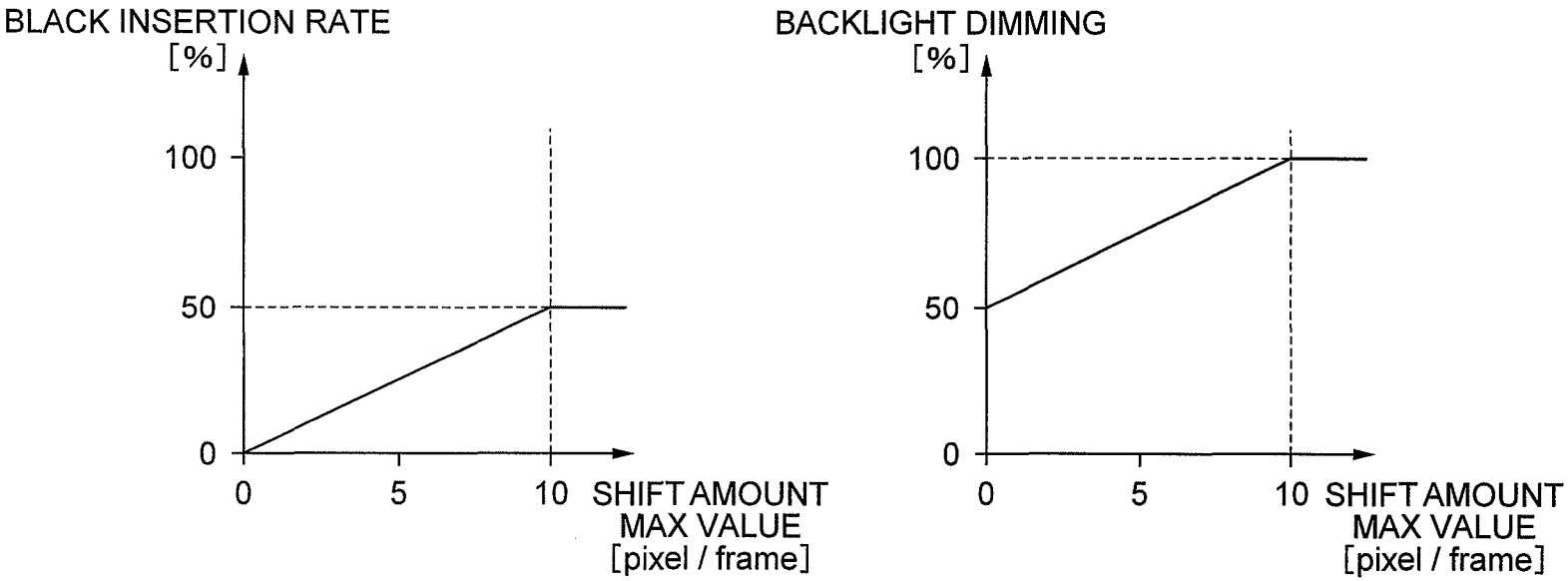
FIG. 46 is an illustration showing an example for describing a relational characteristic regarding shift distance maximum value of each block calculated by the black insertion rate setting part and the black insertion rate as well as dimming luminance of a backlight of the liquid crystal display device shown in FIG. 41.
Figure 47:
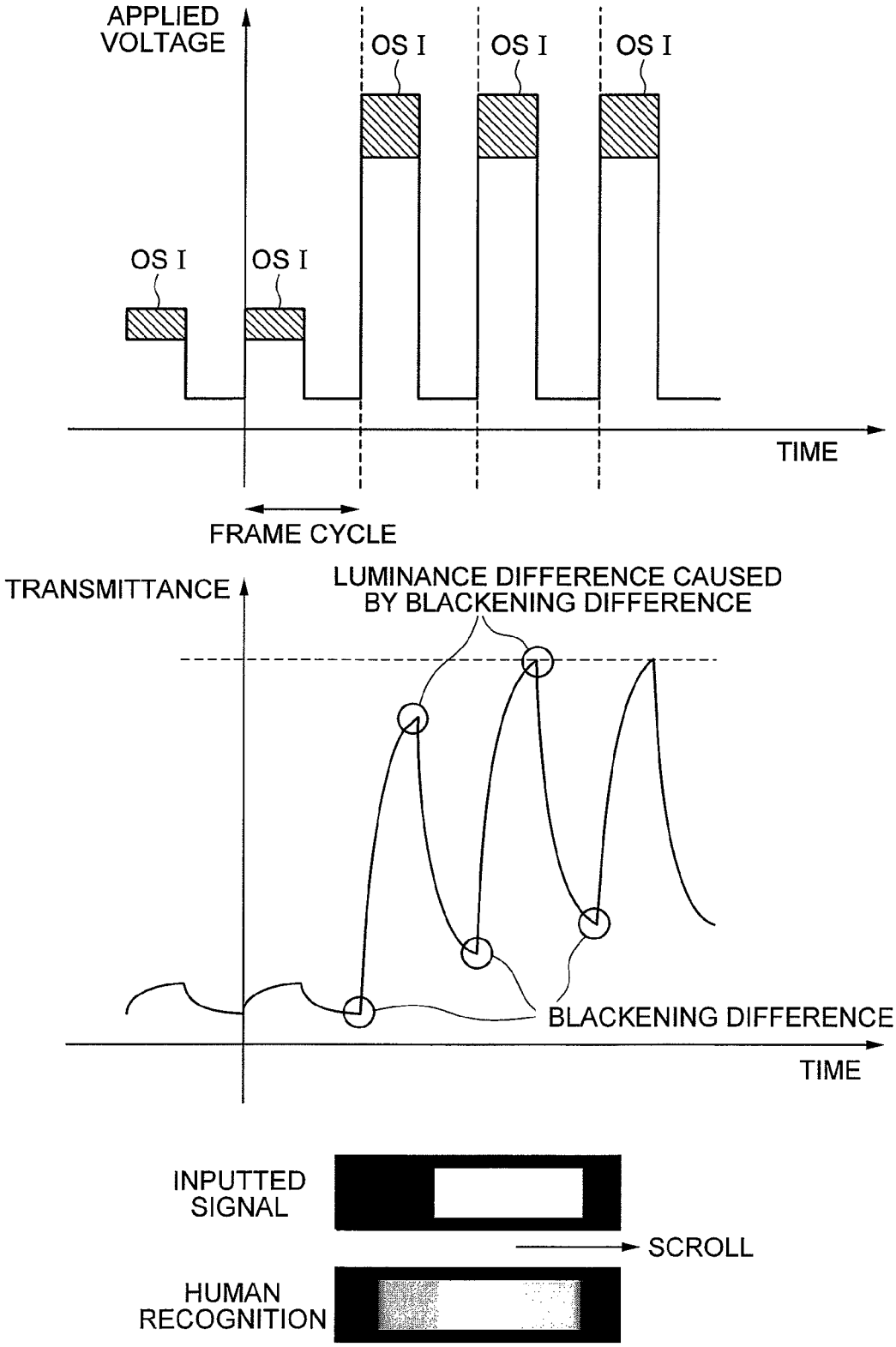
FIG. 47 shows illustrations for describing the points that need to be improved in a related technique.

Furthermore, in another example of the operations of the black insertion rate setting part 22, the black insertion rate setting part 22 operates as follows as a way to judge the black image insertion rate and the dimming luminance of the backlight. That is, as shown in FIG. 44, one frame is divided into the predetermined number of blocks, and as shown in FIG. 45, shift distance of an image of an arbitrary block from the previous frame to the current frame is calculated. For calculating the distance, the position of the block that has the minimum mean absolute value error with respect to the block of the previous frame may be detected from the current frame by using a tree search method, for example, to find the shift distance of the block. FIG. 46 shows the maximum value of the calculated shift distance of each block, the black insertion rate of that time, and the dimming luminance of the backlight 19. With this structure, the black insertion rate can be switched consecutively in accordance with the shift in the scenes of the videos, and minimum necessary black image insertion is performed in accordance with the extent of active movements. This makes it possible to decrease the power consumption of the backlight as well.

Further, it is also possible to prepare LUTs corresponding to each of the colors RGB for correcting the gradations when performing the first and second overshoot drives.

In a case of the resolution used in TVs or the like, it is common to use two gate drivers for VA (Video Graphics Array) for example, and three gate drivers for XGA (Extended Graphics Array) and WXGA (Wide XGA) when the drivers popular on the market are used. The structure of the liquid crystal display device according to the above-described embodiments expands the versatility in terms of the selection in the number of gate drivers, when applied to the products.

Further, the liquid crystal display device is preferable to be formed as a liquid crystal display panel module structure having external circuits necessary for displaying images, e.g., peripheral circuits such as an image frame memory system configured with a DRAM and a front-end circuit with an image encoding function, an image decoder, a driver, a frame memory, a supply voltage converting circuit, an interface circuit, DAC, and the controller of the display panel of the above-described embodiments, formed and integrated on a same glass substrate as that of the liquid crystal display panel. In that case, such structure may be formed to be directly connected to an MPU bus line of the system. It can be achieved by low-temperature polysilicon TFTs and the like.

In the first exemplary embodiment, the display panel control device can generate the monochrome image inserted video signal obtained by inserting the monochrome image signal to the video signal, and control the display drive of the display panel based on the monochrome image inserted video signal. At that time, the first overshoot drive control device can perform the first correction on the gradation value of the video signal, and supply, to the display panel, the driving voltage (to which the first overshoot drive is performed) which is higher than the gradation voltage for the video signal determined in advance. Further, the second overshoot drive control device can perform the second correction on the gradation value of the video signal to which the first correction is applied, and supply, to the display panel, the driving voltage (to which the second overshoot drive is performed) which is higher than the gradation voltage for the video signal (to which the first overshoot is performed). Furthermore, the monochrome image insertion drive control device can generate the monochrome image inserted video signal obtained by inserting the monochrome image signal to the video signal of the gradation value to which the first correction, or the first and second corrections are applied, and control the display drive of the display panel by the monochrome image insertion drive.

The second overshoot drive control device may be the device for performing the second correction on the gradation value, or may be the device for performing the second correction on the gradation value to which the first correction is applied.

In the former case, the monochrome image insertion drive control device can generate the monochrome image inserted video signal obtained by inserting the monochrome image signal to the video signal of the gradation value to which the first correction or the second correction is applied, and control the display drive of the display panel by the monochrome image insertion drive.

In the second exemplary embodiment, the display panel control device can generate the monochrome image inserted video signal by inserting the monochrome image signal to the video signal, and control the display drive of the display panel based on the monochrome image inserted video signal. At that time, the first overshoot drive control device can perform the first correction on the gradation value of the video signal, and supply, to the display panel, the driving voltage (to which the first overshoot drive is performed) which is higher than the gradation voltage for the video signal determined in advance. Further, the third overshoot drive control device can perform the third correction on the gradation value of the monochrome image signal, and supply, to the display panel, the driving voltage (to which the third overshoot drive is performed) which is lower than the gradation voltage for the monochrome image signal set in advance.

Furthermore, the monochrome image insertion drive control device can generate the monochrome image inserted video signal obtained by inserting the monochrome image signal (to which the third correction is applied) to the video signal of the gradation value (to which the first correction is applied), and control the display drive of the display panel by the monochrome image insertion drive.

Further, the first exemplary embodiment and the second exemplary embodiment can be summarized as follows. That is, the display panel driving device inserts the monochrome image signal to the video signal to generate the monochrome image inserted video signal that is capable of alternately applying the first gradation voltage that corresponds to the gradation value of the video signal and the second gradation voltage that corresponds to the gradation value of the monochrome image signal, and supplies the monochrome image inserted video signal to the display panel so as to perform display drive control of the display panel. The display panel control device may be structured to include the first overshoot drive control device, the second overshoot drive control device, and the monochrome image insertion drive control device.

In that case, the first overshoot drive control device performs the first correction on the gradation value of the video signal in such a manner that the change amount between each of the gradation values becomes increased, and makes it possible to drive the display of the display panel with the third gradation voltage (to which the first overshoot is applied) which is different from the first gradation voltage that is set in advance.

When the gradation value of the video display of the current frame changes from the gradation value of the video display of the previous frame, the second overshoot drive control device performs the second correction on either the gradation value of the video display or the gradation value of the monochrome display in such a manner that the change amount between the gradation value of the video display of the current frame and the gradation value of the monochrome display becomes increased so as to correct the accumulative luminance reaching delay of the video display that is caused due to a difference between the first monochrome display luminance with the gradation value of the monochrome display after the video display of the previous frame and the second monochrome display luminance with the gradation value of the monochrome display after the video display of the current frame, and makes it possible to drive the display of the display panel with the fourth gradation voltage(to which the second overshoot is applied) which is different from the third gradation voltage, or the fifth gradation voltage (to which the third overshoot is applied) which is different from second gradation voltage.

The monochrome image insertion drive control device can generate the monochrome image inserted video signal obtained by inserting the monochrome image signal to the video signal of the gradation value to which the first correction, or the first and the second corrections are applied, and control the display drive of the display panel by the monochrome image insertion drive.

The display device of one form can have a display panel, a source line driving device, a video scanning device, and a black scanning device. The display panel may be structured to have a plurality of gate lines and a plurality of source lines arranged to cross with each other in a grid-like form, and pixels formed at each intersection point of the gate lines and the source lines. The source line driving device can supply, to each source line, the black inserted video signal which contains the line video part and the black image part alternately. The video scanning device can execute the video display scanning by successively supplying, to each gate line, the video display gate-on signal for writing only the video part of the black inserted video signal to the pixel. The black scanning device can execute the black display scanning by successively supplying, to each gate line, the black display gate-on signal for writing only the black image part of the black inserted video signal to the pixel. Further, the black scanning device can start the black display scanning at an arbitrary timing within one video frame period.

With such display device, it is possible to execute the black insertion drive to write the black signals over consecutive video frames, so that the ratio (black insertion rate) of the video display time to the black image display time can be set arbitrarily by the timing for starting the black display scanning.

Further, in the display device of another form, the video scanning device can execute the video display scanning for displaying the videos on the display panel according to the inputted video signals. The black scanning device can start and execute the black display scanning for displaying the black screen on the display panel at an arbitrary timing within one video frame period of the video display scanning. Furthermore, the display device can have a frame polarity inverting device. The frame polarity inverting device can invert the polarity of the voltages applied by the video scanning device to the pixels by a frame cycle starting from the start point of the video display scanning, and can invert the polarity of the applied voltages applied by the black scanning device to the pixels by a frame cycle starting from the start point of the black display scanning.

With such structure, writing polarities of the video signal and the black signal are inverted in a frame cycle starting from each of the individual timings in the liquid crystal display device which performs the black insertion drive by inserting the black image within one frame. This makes it possible to cancel burn-in and the display luminance difference at the switching lines of the polarity inversion generated due to variation in field-through within a plane of the display panel and variation in the positive/negative of the applied voltages.

Further, the black scanning device of the above-described display device may have a function of variably controlling the timing for starting the black scanning with respect to the video display scanning performed by the video scanning device. With this, the black insertion rate can be changed arbitrarily for each frame.

Furthermore, the display device may have a black insertion rate setting part which sets the timing for starting the black scanning by the black scanning device arbitrarily in accordance with the operating environments. This makes it possible to set the black insertion rate for each frame from a larger range in accordance with the individual use conditions.

The display device of another form can have a display panel, source drivers, gate drivers, and a drive control part. The source driver can supply, to each source line, the black inserted video signal which contains the line video part and the black image part alternately. A plurality of gate drivers are provided, respectively, to each gate-line group obtained by putting a plurality of gate lines into a number of groups, and each can successively supply the gate-on signals to each of the corresponding gate lines. The black insertion drive control part has a function of individually supplying an output enable signal to each gate driver to control each gate output of the gate drivers individually. Furthermore, the black insertion drive control part has a function of outputting a video start pulse for writing the line image part to the first gate driver. In addition, the black insertion drive control part has a function of outputting a black display start pulse for writing the black image part to the first gate driver at an arbitrary timing within one video frame period.

In such display device, the gate driver is provided to each gate-line group obtained by putting a plurality of gate lines into a number of groups, and enable signals for each gate driver are controlled individually. In addition, the black display start pulse is inputted to the gate driver at a timing different from that of the video start pulse, so that the ratio (black insertion rate) of the black image display time to the video display time in the black insertion drive can be adjusted continuously but not by each driver. The number of gate drivers may be an odd-number, as long as there are two or more gate drivers. Thus, the versatility of selecting the gate drivers when applied to the products can be expanded. At the same time, the black insertion rate can be set freely with the necessary minimum number of gate drivers.

In the display device of another form, the black insertion derive control part can include a function which inverts the writing polarity of the line image part by a frame cycle starting from the output of the video start pulse, and inverts the writing polarity of the black image part by a frame cycle starting from the output of the black display start pulse. In such display device, the gate driver is provided to each gate-line group obtained by putting a plurality of gate lines into a number of groups, and enable signals for each gate driver are controlled individually. In addition, the black display start pulse is inputted to the gate driver at a timing different from that of the video start pulse, so that the ratio (black insertion rate) of the black image display time to the video display time in the black insertion drive can be adjusted continuously but not by each driver. Further, writing polarities of the video signal and the black signal are inverted in a frame cycle starting from each of the individual timings in the liquid crystal display device which performs the black insertion drive by inserting the black image within one frame. This makes it possible to cancel burn-in and the display luminance difference at the switching lines of the polarity inversion generated due to variation in field-through within a plane of the display panel and variation in the positive/negative of the applied voltages.

In the display device which performs the black insertion drive by inserting the black image within one frame, the inverting orders of black and video are switched in the middle of the screen because of the frame polarity inversion drive. This makes it possible to cancel burn-in and the display luminance difference at the switching lines of the polarity inversion generated due to variation in field-through within a plane of the display panel and variation in the positive/negative of the applied voltages.

That is, in the hold-type display device, the black insertion rate can be adjusted delicately for one frame period by considering a balance between the effect of improving the dynamic image blur and deterioration of the luminance as a disadvantage. Therefore, it possible to cancel burn-in and the display luminance difference at the switching lines of the polarity inversion generated due to variation in field-through within a plane of the display panel and variation in the positive/negative of the applied voltages.

Further, in the display device described above, the black insertion drive control part may have a function of variably controlling the timing for outputting the black display start pulse with respect to the output of the video start pulse. With this, the black insertion rate can be changed arbitrarily for each frame by changing the timing for outputting the black display start pulse.

In the above-described display device, the black insertion drive control part may have a function of individually supplying a video-display enable signal for enabling the output of the gate-on signal only in a period where the line image part of the black inserted video signal is supplied to the source lines, or individually supplying a black-display enable signal for enabling the output of the gate-on signal only in a period where the black image part of the black inserted video signal is supplied to the source lines. With this, execution of the video display scanning or the black display scanning can be controlled individually for each gate driver.

Further, in the above-described display device, each of the above-described gate drivers may have a function which supplies, to the corresponding gate line, the video display gate-on signal for writing only the line image part of the black inserted video signal to the pixel according to the video display enabling signal, and supplies, to the corresponding gate line, the black display gate-on signal for writing only the black image part of the black inserted video signal to the pixel according to the black display enabling signal.

With this, each gate driver can switch and execute the video display scanning and the black display scanning.

Furthermore, the above-described display device may have a black insertion rate setting part which sets the timing for outputting the black display start pulse by the black insertion drive control part arbitrarily in accordance with the operating environments. This makes it possible to set the black insertion rate for each frame from a larger range in accordance with the individual use conditions.

Moreover, in the above-described display device, the black insertion rate setting part may have a function of judging the black image insertion rate based on the inputted video signal, and set the output timing of the black display start pulse based on the judged black image insertion rate. This makes it possible to set the black insertion rate in accordance with the contents of the video to be displayed.

Further, in the above-described display device, the black insertion rate setting part may have a function which temporarily stores the information for one frame of the inputted video signal that is successively inputted by one frame, compares the video signal of a given frame among the inputted video signals with the video signal of a previous-frame stored temporarily, and judges the black insertion rate based on the changes in the data. With this, it is possible to judge the optimum black insertion rate in accordance with the contents of the video to be displayed.

Further, the above-described display device may have a backlight provided on the backside of the display panel. At the same time, the black insertion rate setting part may have a function which temporarily stores the information for one frame of the inputted video signal that is successively inputted by one frame, compares the video signal of a given frame among the inputted video signals and the video signal of a previous frame stored temporarily, and judges the black insertion rate and the dimming luminance of the backlight based on the changes in the data. As described, dimming of the backlight is performed in accordance with the black insertion rate, so that the black insertion drive can be executed while preventing changes in the luminance caused due to the switching of the black insertion rate.

Further, in the above-described display device, the black insertion drive control part may continue supply of the video display enable signal to the gate driver that outputs the gate-on signal to the corresponding gate line in accordance with the video start pulse until the shift-output ends, and may supply the black display enable signal for other gate drivers. This makes it possible to input the black display start pulse for the gate drivers at highly flexible timings, and the black insertion rate can be adjusted continuously.

Furthermore, in the above-described display device, it is preferable for the above-described black inserted video signal to contain the black image signal also in the blanking period of the inputted video signal. With this, the black signal can be continuously written even during the blanking period of the frames for allowing the black signals to be written over a plurality of frames. Thus, it is possible to cancel the luminance difference within the plane caused due to a difference in the black image hold period within the display panel.

Further, in the above-described display device, the above-described black inserted video signal may contain a halftone signal instead of the black image signal. This makes it possible to lighten the deterioration of the luminance caused due to the black insertion drive.

The display device driving method described above is directed to a display device which includes: a display panel having a plurality of gate lines and a plurality of source lines arranged to cross with each other in a grid-like form, and pixels formed at each intersection point of the gate lines and the source lines; source drivers for supplying video signals to each source line; a plurality of gate drivers provided, respectively, to each gate-line group obtained by putting a plurality of gate lines into a number of groups, each of which can successively supply the gate-on signals to each of the corresponding gate lines; and a black insertion drive control part which individually supplies an output enable signal to each gate driver individually.

The display device driving method of one form may include a black inserted video signal supplying step, a video start pulse inputting step, a video scanning step, a black display start pulse inputting step, and a black scanning step.

The black inserted video signal supplying step can start to supply, to each source line, the black inserted video signal which contains the line video part and the black image part alternately. The video start pulse inputting step can input the video start pulse for writing only the line image part from the drive control part to the first gate driver by synchronizing with the black inserted video signal supplying step. The video scanning step can execute, in order from the first driver to each gate line, the video display scanning for successively supplying the video display gate-on signal for writing only the line image part of the black inserted video signal.

The black display start pulse inputting step can input the black display start pulse for writing only the black image part from the black insertion drive control part to the first gate driver at an arbitrary timing within one video frame period. The black scanning step can execute, in order from the first driver to each gate line, the black display scanning for successively supplying the black display gate-on signal for writing only the black image part of the black inserted video signal.

In the above-described video scanning step, each gate driver may output the video gate-on signal in accordance with the video display enable signal that enables the output of the gate driver only in a period where the line image part of the black inserted video signal is supplied to the source lines.

In the black scanning step, each gate driver may output the black display gate-on signal in accordance with the black display enable signal that enables the output of the gate driver only in a period where the black image part of the black inserted video signal is supplied to the source lines.

It is also possible to provide a black insertion rate setting step which sets the timing for outputting the black display start pulse by the black insertion drive control part arbitrarily in accordance with the operating environments. The black insertion rate setting step may temporarily store the information for one frame of the inputted video signal that is successively inputted by one frame, compare the video signal of a given frame among the inputted video signals and the video signal of a previous frame stored temporarily, and judges the black insertion rate based on the changes in the data. Further, the black insertion rate setting step may judge the black insertion rate and the dimming luminance of the backlight provided in the backside of the display panel in advance, and set the timing for outputting the black display start pulse and the dimming luminance of the backlight based on the judgment.

With the display device driving method described above, it is possible to set the black insertion rate delicately by considering a balance between the effect of improving the dynamic image blur and deterioration of the luminance as a disadvantage, as in the case of the above-described display device.

The display device driving method of another form may include, after a black inserted video signal supplying step, a video start pulse inputting step, a video scanning step, a black display start pulse inputting step, a black scanning step, a video signal polarity inverting step, and a black signal polarity inverting step.

The black display start pulse inputting step can input the black display start pulse for writing only the black image part from the black insertion drive control part to the first gate driver at an arbitrary timing within one video frame period. Further, in the video signal polarity inverting step, the writing polarity of the line image part can be inverted by a frame cycle starting from the output of the video start pulse. Furthermore, in the black signal polarity inverting step, the writing polarity of the black image part can be inverted by a frame cycle starting from the output of the black display start pulse.

In the above-described video scanning step, each gate driver may output the video gate-on signal in accordance with the video display enable signal that enables the output of the gate driver only in a period where the line image part of the black inserted video signal is supplied to the source lines. In the black scanning step, each gate driver may output the black display gate-on signal in accordance with the black display enable signal that enables the output of the gate driver only in a period where the black image part of the black inserted video signal is supplied to the source lines.

It is also possible to provide a black insertion rate setting step which sets the timing for outputting the black display start pulse by the black insertion drive control part arbitrarily in accordance with the operating environments. Furthermore, before the black inserted video signal supplying step described above, it is possible to generate the black inserted video signal that is outputted to the source driver, by inserting the black image signal between the line image parts of the video signal.

With such display device driving method described above, it is possible to set the black insertion rate delicately by considering a balance between the effect of improving the dynamic image blur and deterioration of the luminance as a disadvantage, as in the case of the above-described display device. This makes it possible to cancel burn-in and the display luminance difference at the switching lines of the polarity inversion generated due to variation in field-through within a plane of the display panel and variation in the positive/negative of the applied voltages.

(Program)

A software program (control program) used for controlling the display panel control device (display device, liquid crystal display device) of the present invention for achieving the functions of the above-described exemplary embodiments includes a part of or a whole part of a program corresponding to each part, each circuit (processing part, processing device) functions, and the like within the controller shown in various block diagrams of each of the above-described exemplary embodiments, a program corresponding to the processing procedures, processing devices, functions, and the like shown in flowcharts of the drawings, a program using data structures such as LUTs shown in the drawings, each processing program processed in each of the above-described exemplary embodiments, the method (steps) depicted generally through the current Specification, processing described herein, and the data of the data structures (for example, the first LUT part, the second LUT part, the third LUT part, and the like).

That is, while the exemplary embodiments of the invention have been described as the liquid crystal display device built as hardware, it is not intended to be limited to that. The exemplary embodiments of the invention may also be built as a program for enabling a computer to execute the functions of the controller that is the control device among the liquid crystal display device described above.

In that case, the control program is designed for being executed by a computer provided to the control device of the display panel which performs display drive control through supplying, to a display panel, monochrome image inserted video signals in which a unit cycle period including a first gradation voltage video part for providing video display according to a gradation value of a video signal and a second gradation voltage monochrome image part for providing monochrome display according to a gradation value of a monochrome image signal are repeated, and performs monochrome image insertion drive which starts insertion of monochrome image display scanning at an arbitrary timing of video display scanning for the display panel.

The control program is capable of enabling the computer to execute functions, including: a first correcting function (for example, structure configured with reference numerals 32 and 34 shown in FIG. 1) which performs the first correction on the gradation value of the video signal so as to increase the change amount between the first gradation voltage and the second gradation voltage, by considering the response delay of the display panel when changing from the second gradation voltage to the first gradation voltage; a second correcting function (for example, reference numeral 40 shown in FIG. 1, reference numeral 60 in FIG. 25, and the like) which performs the second correction on one of or both of the gradation value of the video signal that is corrected by the first correction and the gradation voltage of the monochrome image signal so as to increase the change amount between the first gradation voltage and the second gradation voltage, by considering the accumulative luminance reaching delay of the video part caused due to a difference between each monochrome display luminance of each monochrome image part in different unit frame cycle periods, when the gradation voltage of the video signal changes from a unit frame cycle period to another unit frame cycle period; and a monochrome image insertion drive controlling function (for example, reference numeral 24 and the like shown in FIG. 1) which generates the monochrome image inserted video signal including the video part and the monochrome image part to which the first correction or the second correction is performed, or generates the monochrome image inserted video signal including the video part to which the first correction is performed and the monochrome image part to which the second correction is performed, and controls the display drive of the display panel by the monochrome image insertion drive.

There is no restriction in the forms of the program, such as a source program, an intermediate code program, and an executable code program. The present invention also includes a form in which the above-described program is loaded on application software that can be operated by a general personal computer, a portable information terminal, and the like.

As a way to supply the control program, it is possible to provide it from an external device via a telecommunication line (wired or radio) that is connected to be capable of communicating with a computer via the telecommunication line.

With the control program of the present invention, the display panel control device according to the present invention described above can be executed relatively easily by loading the control program to the computer (CPU) from a recording medium such as a ROM to which the control program is stored and having it executed, or by downloading the control program to the computer via a communication device and having it executed. When the present invention is embodied as the software of the display panel control device, there naturally is a recording medium on which the software is recorded to be used.

Further, there is no difference at all regarding the products whether it is a primary duplicate or a secondary duplicate. When the program is supplied by using the communication line, the present invention is utilized by having the communication line as a transmission medium.

Further, the data structure of the tables such as various LUTs used in the above-described controller is the data structure of gradation correction information used in the monochrome image insertion drive that is executed by the computer provided to the control device which performs the display panel drive control through executing the monochrome image display scanning for performing the monochrome display on the display panel at an arbitrary timing in the video display scanning that is performed for providing the video display on the display panel according to the video signal.

The data structure can include: a first structure in which the gradation values of the video signals are related to first gradation correction information for correcting the gradation values of the video signals so as to increase the change amount between each of the gradation values, when the gradation value changes from the gradation value of the monochrome image signal to the gradation value of the video signal; and a second structure in which the gradation value of the video signal of the current frame is related to the gradation value of the video signal of the previous frame.

The first structure is used when the computer executes the first gradation correcting function which corrects the gradation value of the video signal to the first gradation correction information. Further, the second structure is used when the computer executes the second gradation correcting function which further corrects the gradation value of the video signal of the current frame that is corrected by the first gradation correcting function so as to increase the change amount between each of the gradations when the gradation value of the video display of the current frame changes from the gradation value of the video display of the previous frame. Further, the second gradation correcting function is capable of correcting the gradation value in such a manner that the time integrated value of the luminance in the frame period during the display change becomes larger than the time integrated value of the luminance in a next frame period after the display change.

Further, the data structure can have a third structure in which the gradation value of the previous video signal is related to the gradation value of the monochrome image signal. The third structure is utilized when the computer executes the third gradation correcting function which corrects the gradation value of the monochrome image signal based on the gradation value of the previous video signal.

The present invention may be structured as an information recording medium in which the control program is stored. An application program including the control program is stored in the information recording medium. It is possible with a computer to read out the application program from the information recording medium, and install it to a hard disk. Thereby, the above-described program can be provided by being recorded to the information recording medium, such as a magnetic recording medium, an optical recording medium, or a ROM. It is possible to provide a preferable information processor by using an information recording medium with such program in the computer.

As the information recording medium for supplying the program, semiconductor memories and integrated circuits such as ROMs, RAMs, flash memories, SRAMs, or USB memories and memory cards including those, optical disks, magneto-optical disks, magnetic recording mediums, and the like may be used. Furthermore, the program may be recorded on portable media such as flexible disks, CD-ROMs, CD-Rs, CD-RWs, FDs, DVDROMs, HDDVDs (HDDVD-R-SLs (single layer), HDDVD-R-DLs (double layer), HDDVD-RW-SLs, HDDVD-RW-DLs, HDDVD-RAM-SLs), DVD±R-SLs, DVD±R-DLs, DVD±RW-SLs, DVD±RW-DLs, DVD-RAMs, Blu-Ray Disks (registered trademark) (BD-R-SLs, BD-R-DLs, BD-RE-SLs, BD-RE-DLs), MOs, ZIPs, magnetic cards, magnetic tapes, SD cards, memory sticks, nonvolatile memory cards, IC cards, or a storage device such as hard disks that are built-in to computer systems.

Further, the "information recording medium" also includes a form which kinetically holds the program for a short period of time (transmission medium or carrier wave), e.g., a communication line when transmitting the program via a communication circuit lines such as networks of the Internet, a telephone line, etc., and also includes a form which holds the program for a specific period of time, e.g., a nonvolatile memory provided inside the computer system to be a server or a client in the above case.

Furthermore, the program may be used to achieve a part of the above-described functions, or may be used to achieve the above-described functions by being combined with a program that is already being recorded to the computer system.

Further, the steps shown in the flowcharts of the current Specification include not only the processing executed in a time series manner according to the described procedures, but also the processing that may be executed in parallel or individually. Further, in the actual implementation, the order of executing the program procedures (steps) can be changed. Furthermore, at the time of implementation, it is possible to mount, eliminate, add, or reallocate the specific procedures (steps) described in the current Specification as combined procedures (steps) as necessary.

Moreover, the functions of the program, e.g., each device (each part, each circuit), each function of the display panel control device (controller), and functions and the like of the procedures of each step, may be achieved by exclusive hardware (for example, exclusive semiconductor circuit). Apart of the whole functions of the program may be processed by the hardware, and the other functions of the whole functions may be processed by the use of software. In the case of using the exclusive hardware, each part may be formed with an integrated circuit such as LSI. These may be formed on a single chip individually, or may be formed on a single chip including a part or a whole part of the integrated circuits. The way of integration is not limited only to LSI. An exclusive circuit or a general-purpose processor may be employed. Further, when there is a technique related to integration of circuits developed in replacement for LSI due to advancement in the semiconductor technology or another technique derived therefrom, such technique may naturally be used for integrating the functional blocks.

The display device according to each of the above-described exemplary embodiments may be used as a display unit of various kinds of electronic appliances. Examples of the electronic appliances may include television sets such as the broadcast receiver of the above-described exemplary embodiment, various information processors such as computers, projectors, digital still cameras, remote controllers of various devices, home appliances to which various information communicating functions are loaded, game devices, portable music players, various recording devices, car navigation systems, pagers, electronic notebooks, electronic calculators, word processors, POS terminals, various mobile terminals, PDAs, portable telephones, wearable information terminals, PNDs, PMPs.

As other applications, the display unit can also be used for the electronic appliances of roughly two types, i.e., a direct-view type with which the images on the display panel are directly viewed, and a projection type which optically enlarge-projects the image on the display panel. The liquid crystal display device according to the exemplary embodiment can be applied to both types.

Furthermore, it is to be easily understood that the way of executing the first and second overshoot drives and the way of executing the first and third overshoot drives in the black insertion drive are not necessarily limited to substantial device, and that those can function as the method. Inversely, the method according to the present invention is not necessarily limited to the substantial device, but may be effective as the method thereof. In that case, the display panel control devices, the display devices, the hold-type display devices, the liquid crystal display devices, the broadcast receivers, and the like can be included as examples for achieving the method.

Such display panel control device and the liquid crystal display device may be used alone or used by being mounted to a certain apparatus. The spirit of the present invention is not intended to be limited to such case, but to include other various kinds of modes. Therefore, it is possible to be achieved as software or hardware as appropriate. When the display panel control device is built as software as an example of embodying the spirit of the present invention, there naturally is a recording medium on which the software is stored to be used.

Further, the spirit of the present invention is completely the same even in the case where a part thereof is achieved by the software and another part is achieved by the hardware. It may also be in a form where a part is stored on a recording medium, and the program is loaded properly as necessary. When the present invention is achieved with the software, it is possible to be structured to use hardware and an operating system, or may be achieved separately from those.

Further, dependent claims regarding the device may be applied as dependent claims regarding the method and the program to correspond to the dependent claims of the device.

Furthermore, each of the exemplary embodiments includes various stages, and various kinds of inventions can be derived therefrom by properly combining a plurality of feature elements disclosed therein. That is, it is needless to say that the present invention includes combinations of each of the above-described exemplary embodiments or combinations of any of the exemplary embodiments and any of the modifications examples. Furthermore, the present invention can include structures of other exemplary embodiments in which some of the feature elements are omitted from the entire feature elements of the above-described exemplary embodiments, as well as the technical scope of the structures based thereupon.

The descriptions regarding each of the exemplary embodiments including the modification examples thereof are presented merely as examples of various embodiments of the present invention, i.e., examples of concretive cases for embodying the present invention, for implementing easy understanding of the present invention. It is to be understood that those exemplary embodiments and the modification examples thereof are illustrative examples, and not intended to set any limitations therewith. The present invention can be modified and/or changed as appropriate. Further, the present invention can be embodied in various forms based upon the technical spirit or the main features thereof, and the technical scope of the present invention is not to be limited by the exemplary embodiments and the modification examples.

Therefore, each element disclosed above is to include all the possible design changes and the equivalents that fall within the technical scope of the present invention.

While the present invention has been described above by referring to each of the exemplary embodiments, the present invention is not limited to those exemplary embodiments. Various changes and modifications that occur to those skilled in the art may be applied to the structures and details of the present invention. Further, it is to be understood that the present invention includes combinations of a part of or the whole part of the structures described in each of the exemplary embodiments.

What is claimed is:

1. A display panel control device which supplies, to a display panel, a monochrome image inserted video signal in which a unit cycle period including a first gradation voltage value video part for providing video display according to a gradation value of a video signal and a second gradation voltage monochrome image part for providing monochrome display according to a gradation value of a monochrome image signal are repeated, and performs a display drive control for the display panel by monochrome image insertion drive which starts insertion of monochrome image display scanning at an arbitrary timing of video display scanning, the display panel control device, comprising:

a first correction device for performing a first correction for correcting response delay from the monochrome display to the video display by correcting the gradation value of the video signal or the gradation value of a monochrome image signal of a current frame based on the gradation value of the video signal of the current frame;

a second correction device for performing a second correction on one of the gradation value of the video signal of the current frame that is corrected by the first correction device and the gradation value of the monochrome image signal of the current frame based on the video signal of a previous frame and the video signal of the current frame in such a manner that time integrated value of luminance in the another unit frame cycle period where display is being changed becomes larger than time integrated value of the luminance in still another unit frame cycle period after display is being changed when the gradation value of the video signal changes from a given unit frame cycle period to another unit frame cycle period; and a monochrome image insertion drive control device for generating the monochrome image inserted video signal including the video part and the monochrome image part to which the first correction and the second correction are performed, and performing the display drive control by the monochrome image insertion drive performed on the display panel.

2. The display panel control device as claimed in claim 1, further comprising:

a monochrome image insertion rate setting device which is capable of setting an insertion rate of the monochrome image signal with respect to the video signal in a unit frame cycle period in accordance with operating environments, wherein the second correction device performs correction of the gradation value in accordance with the insertion rate set by the monochrome image insertion rate setting device.

3. The display panel control device as claimed in claim 2, wherein the first correction device performs correction of the gradation value in accordance with the insertion rate set by the monochrome image insertion rate setting device.

4. The display panel control device as claimed in claim 3, further comprising:

a multi-gradation device for implementing multi-gradation by increasing resolution of the gradations for the inputted video signals, wherein the second correction device performs correction with the gradation value to which multi-gradation processing is performed by the multi-gradation device.

5. The display panel control device as claimed in claim 4, wherein the first correction device performs correction with the gradation value to which multi-gradation processing is performed by the multi-gradation device.

6. The display panel control device as claimed in claim 3, wherein the display panel includes a liquid crystal display panel of a normally-black mode; and the second correction device corrects the gradation value of the monochrome image signal, makes it possible to perform the display drive of the monochrome image part with a fifth gradation voltage that is different from the second gradation voltage, and corrects the gradation value of the monochrome image signal in such a manner that the fifth gradation voltage becomes smaller than the second gradation voltage.

7. The display panel control device as claimed in claim 3, wherein the display panel includes a liquid crystal display panel of a normally-white mode; and the second correction device corrects the gradation value of the monochrome image signal, makes it possible to perform the display drive of the monochrome image part with a fifth gradation voltage that is different from the second gradation voltage, and corrects the gradation value of the monochrome image signal in such a manner that the fifth gradation voltage becomes larger than the second gradation voltage.

8. The display panel control device as claimed in claim 1, wherein the display panel includes a liquid crystal display panel of a normally-black mode;

the second correction device corrects the gradation value of the video signal corrected by the first correction device, and makes it possible to perform display drive of the video part with a fourth gradation voltage that is different from a third gradation voltage which corresponds to the gradation value corrected by the first correction;

the first correction device corrects the gradation value of the video signal in such a manner that the third gradation voltage becomes larger than the first gradation voltage; and the second correction device corrects the gradation value of the video signal in such a manner that the fourth gradation voltage becomes larger than the third gradation voltage.

9. The display panel control device as claimed in claim 1, wherein the display panel includes a liquid crystal display panel of a normally-white mode;

the second correction device corrects the gradation value of the video signal corrected by the first correction device, and makes it possible to perform display drive of the video part with a fourth gradation voltage that is different from a third gradation voltage which corresponds to the gradation value corrected by the first correction;

the first correction device corrects the gradation value of the video signal in such a manner that the third gradation voltage becomes smaller than the first gradation voltage; and the second correction device corrects the gradation value of the video signal in such a manner that the fourth gradation voltage becomes smaller than the third gradation voltage.

10. The display panel control device as claimed in claim 1, further comprising:

an overshoot power supply part that is capable of applying, to the display panel in each gradation of the video display, a voltage that exceeds the voltage to reach a transmission peak.

11. A liquid crystal display device, comprising, formed integrally on a same substrate:

the display panel control device as claimed in claim 1;

a display panel having a plurality of gate lines and a plurality of source lines arranged to cross with each other in a grid-like form, and pixels formed at each intersection point of the gate lines and the source lines;

a source line driving device for supplying, to each source line, the monochrome image inserted video signal which contains the video part and the monochrome image part alternately; and a gate line driving device which has a video display scanning executing function which executes video display scanning by successively supplying, to each of the gate lines, a video display gate-on signal for writing only the video part of the monochrome image inserted video signal to the pixels, and has a monochrome image display scanning executing function which executes monochrome image display scanning by successively supplying, to each of the gate lines, a monochrome display gate-on signal for writing only the monochrome image part of the monochrome image inserted video signal to the pixels.

12. A display panel driving method for supplying, to a display panel, a monochrome image inserted video signal in which a unit cycle period including a first gradation voltage video part for providing video display according to a gradation value of a video signal and a second gradation voltage monochrome image part for providing monochrome display according to a gradation value of a monochrome image signal are repeated, and performing a display drive control for the display panel by monochrome image insertion drive which starts insertion of monochrome image display scanning at an arbitrary timing of video display scanning, the method comprising:

performing a first correction for correcting response delay from the monochrome display to the video display by correcting the gradation value of the video signal or the gradation value of a monochrome image signal of a current frame based on the gradation value of the video signal of the current frame;

performing a second correction for correcting one of the gradation value of the video signal of the current frame that is corrected at the first correction and the gradation value of the monochrome image signal of the current frame based on the video signal of a previous frame and the video signal of the current frame in such a manner that time integrated value of luminance in the another unit frame cycle period where display is being changed becomes larger than time integrated value of the luminance in still another unit frame cycle period after display is being changed when the gradation value of the video signal changes from a given unit frame cycle period to another unit frame cycle period; and generating the monochrome image inserted video signal including the video part and the monochrome image part to which the first correction and the second correction are performed, and performing the display drive control on the display panel by the monochrome image insertion drive.

13. The display panel driving method as claimed in claim 12, further comprising:

setting an insertion rate of the monochrome image signal with respect to the video signal in a unit frame cycle period in accordance with operating environments, wherein at performing the second correction, the gradation value is corrected in accordance with the insertion rate set at setting the insertion rate in accordance with operating environments.

14. The display panel driving method as claimed in claim 13, wherein at performing the first correction, the gradation value is corrected in accordance with the insertion rate set at setting the insertion rate in accordance with operating environments.

15. The display panel driving method as claimed in claim 14, wherein multi-gradation is performed by increasing resolution of the gradations for the inputted video signals, and at performing the second correction, correction is performed with the gradation value to which multi-gradation processing is applied.

16. The display panel driving method as claimed in claim 15, wherein at performing the first correction, correction is performed with the gradation value to which multi-gradation processing is applied.

17. The display panel driving method as claimed in claim 14, wherein the display panel includes a liquid crystal display panel of a normally-black mode; and at performing the second correction, the gradation value of the monochrome image signal is corrected to make it possible to perform the display drive of the monochrome image part with a fifth gradation voltage that is different from the second gradation voltage, and corrects the gradation value of the monochrome image signal in such a manner that the fifth gradation voltage becomes smaller than the second gradation voltage.

18. The display panel driving method as claimed in claim 14, wherein the display panel includes a liquid crystal display panel of a normally-white mode; and at performing the second correction, the gradation value of the monochrome image signal is corrected to make it possible to perform the display drive of the monochrome image part with a fifth gradation voltage that is different from the second gradation voltage, and corrects the gradation value of the monochrome image signal in such a manner that the fifth gradation voltage becomes larger than the second gradation voltage.

19. The display panel driving method as claimed in claim 12, wherein:

the display panel includes a liquid crystal display panel of a normally-black mode;

at performing the second correction, the gradation value of the video signal corrected at the first correction is corrected to make it possible to perform display drive of the video part with a fourth gradation voltage that is different from a third gradation voltage which corresponds to the gradation value corrected at the first correction;

at performing the first correction, the gradation value of the video signal is corrected in such a manner that the third gradation voltage becomes larger than the first gradation voltage; and at performing the second correction, the gradation value of the video signal is corrected in such a manner that the fourth gradation voltage becomes larger than the third gradation voltage.

20. The display panel driving method as claimed in claim 12, wherein the display panel includes a liquid crystal display panel of a normally-white mode;

at performing the second correction, the gradation value of the video signal corrected at the first correction is corrected to make it possible to perform display drive of the video part with a fourth gradation voltage that is different from a third gradation voltage which corresponds to the gradation value corrected at the first correction;

at performing the first correction, the gradation value of the video signal is corrected in such a manner that the third gradation voltage becomes smaller than the first gradation voltage; and at performing the second correction, the gradation value of the video signal is corrected in such a manner that the fourth gradation voltage becomes smaller than the third gradation voltage.

21. The display panel driving method as claimed in claim 12, further comprising:

applying, to the display panel in each gradation of the video display, a voltage that exceeds the voltage to reach a transmission peak.

22. A display panel control device which supplies, to a display panel, a monochrome image inserted video signal in which a unit cycle period including a first gradation voltage value video part for providing video display according to a gradation value of a video signal and a second gradation voltage monochrome image part for providing monochrome display according to a gradation value of a monochrome image signal are repeated, and performs a display drive control for the display panel by monochrome image insertion drive which starts insertion of monochrome image display scanning at an arbitrary timing of video display scanning, the display panel control device, comprising:

first correction means for performing a first correction for correcting response delay from the monochrome display to the video display by correcting the gradation value of the video signal or the gradation value of a monochrome image signal of a current frame based on the gradation value of the video signal of the current frame;

second correction means for performing a second correction on one of the gradation value of the video signal of the current frame that is corrected by the first correction means and the gradation value of the monochrome image signal of the current frame based on the video signal of a previous frame and the video signal of the current frame in such a manner that time integrated value of luminance in the another unit frame cycle period where display is being changed becomes larger than time integrated value of the luminance in still another unit frame cycle period after display is being changed when the gradation value of the video signal changes from a given unit frame cycle period to another unit frame cycle period; and monochrome image insertion drive control means for generating the monochrome image inserted video signal including the video part and the monochrome image part to which the first correction and the second correction are performed, and performing the display drive control by the monochrome image insertion drive performed on the display panel.

23. A non-transitory computer readable recording medium storing a display panel driving program for supplying, to a display panel, a monochrome image inserted video signals in which a unit cycle period including a first gradation voltage video part for providing video display according to a gradation value of a video signal and a second gradation voltage monochrome image part for providing monochrome display according to a gradation value of a monochrome image signal are repeated, and performing a display drive control by monochrome image insertion drive which starts insertion of monochrome image display scanning at an arbitrary timing of video display scanning for the display panel, which enables a computer to execute functions including:

a first correcting function which performs a first correction for correcting response delay from the monochrome display to the video display by correcting the gradation value of the video signal or the gradation value of a monochrome image signal of a current frame based on the gradation value of the video signal of the current frame;

a second correcting function which performs a second correction on one of the gradation value of the video signal of the current frame that is corrected by the first correction function and the gradation value of the monochrome image signal of the current frame based on the video signal of a previous frame and the video signal of the current frame in such a manner that time integrated value of luminance in the another unit frame cycle period where display is being changed becomes larger than time integrated value of the luminance in still another unit frame cycle period after display is being changed when the gradation value of the video signal changes from a given unit frame cycle period to another unit frame cycle period; and a monochrome image insertion drive control function which generates the monochrome image inserted video signal including the video part and the monochrome image part to which the first correction and the second correction are performed, and performs the display drive on the display panel control by the monochrome image insertion drive.

* * * * *